US006715826B2

(12) United States Patent
Bellows et al.

(10) Patent No.: US 6,715,826 B2
(45) Date of Patent: Apr. 6, 2004

(54) CHILD ACTIVITY CENTER, ENTERTAINMENT SYSTEM, AND COMPONENTS THEREOF

(75) Inventors: William B. Bellows, Wyomissing, PA (US); Paul B. Nelson, Elverson, PA (US); Julie M. Benson, Lancaster, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 09/987,121

(22) Filed: Nov. 13, 2001

(65) Prior Publication Data

US 2002/0043824 A1 Apr. 18, 2002

Related U.S. Application Data

(62) Division of application No. 09/319,000, filed on May 26, 1999.

(51) Int. Cl.[7] ..... A47B 39/00
(52) U.S. Cl. ..... 297/136; 446/227
(58) Field of Search ..... 297/5, 136, 137, 297/217.1, DIG. 11, 119; 482/66, 77, 78; 280/87.03, 87.051; 472/103, 105; 108/64, 65, 66; 312/239; 446/69, 117, 227, 236, 268, 320, 396, 489, 490, 476

(56) References Cited

U.S. PATENT DOCUMENTS

| | | | | |
|---|---|---|---|---|
| 8,478 A | | 10/1851 | Rice | |
| 196,730 A | * | 10/1877 | Wick | |
| 265,432 A | | 10/1882 | Peterson | |
| 432,378 A | | 7/1890 | Davidson et al. | |
| 496,739 A | | 5/1893 | Kennedy | |
| 2,580,980 A | | 1/1952 | Vrooman | |
| 2,605,987 A | | 8/1952 | Brown et al. | |
| 2,692,637 A | | 10/1954 | Rainwater | |
| 2,726,838 A | | 12/1955 | Ripley, Jr. | |
| 2,957,187 A | | 10/1960 | Raia | |
| 3,377,966 A | | 4/1968 | Bates et al. | |
| 3,479,973 A | | 11/1969 | Bartlett et al. | |
| 3,796,430 A | * | 3/1974 | Sudo | 297/5 X |
| 4,025,083 A | * | 5/1977 | Saint | 297/5 X |
| 4,025,107 A | | 5/1977 | Chippa | |
| D245,639 S | | 8/1977 | Powell, Jr. | |

(List continued on next page.)

FOREIGN PATENT DOCUMENTS

| | | |
|---|---|---|
| DE | 296 21 138 | 3/1997 |
| DE | 197 06 176 | 8/1998 |
| GB | 382194 | 10/1932 |
| GB | 103946 | 7/1969 |

OTHER PUBLICATIONS

Little Tikes "fun that lasts™" brochure, pp. 1, 4, and 32 (The Little Tikes Company 1996).

Little Tikes Activity Garden brochure, 1 pg. (The Little Tikes Company pre–May 1999).

Little Tikes Activity Barnyard brochure, 2 pgs. (The Little Tikes Company 1997).

Catalog, Graco® Beginnings, "Rocking Base Entertainment™," & "Bouncing Entertainer™," pp. 16–17 (1997).

Brochure, Evenflo®, "SuperSaucer™," 2 pages, (Cir. 04/97).

*Primary Examiner*—Peter R. Brown
*Assistant Examiner*—Stephen Vu
(74) *Attorney, Agent, or Firm*—Foley & Lardner

(57) ABSTRACT

A convertible activity center has a tray that can be locked in a closed loop position with an attached seat to contain an infant and unlocked with the seat removed to an open position, creating a play space from which a toddler can enter and exit at will, or interact with it from the outside. The activity center can also have convertible toys. The same toys that an infant can enjoy can be converted to toys suitable for an older infant or toddler.

51 Claims, 53 Drawing Sheets

U.S. PATENT DOCUMENTS

| | | | | |
|---|---|---|---|---|
| 4,084,273 | A | | 4/1978 | Haynes |
| 4,141,588 | A | | 2/1979 | Anderson |
| 4,160,553 | A | | 7/1979 | Fleischer |
| 4,237,796 | A | | 12/1980 | Gordon et al. |
| 4,306,372 | A | | 12/1981 | Lin |
| 4,342,465 | A | | 8/1982 | Stillings |
| 4,351,521 | A | | 9/1982 | Erdos |
| D281,986 | S | | 12/1985 | Nottingham et al. |
| 4,565,409 | A | | 1/1986 | Hollonbeck et al. |
| D282,674 | S | | 2/1986 | Marschak |
| D295,397 | S | | 4/1988 | Brownlie et al. |
| 4,773,639 | A | | 9/1988 | Graves |
| 4,884,842 | A | | 12/1989 | Finkelstein |
| 4,889,389 | A | | 12/1989 | White |
| 4,958,842 | A | | 9/1990 | Chang |
| D315,644 | S | | 3/1991 | White |
| D317,956 | S | | 7/1991 | Klitsner |
| 5,071,149 | A | | 12/1991 | Perego |
| 5,178,438 | A | | 1/1993 | Beger |
| 5,203,581 | A | | 4/1993 | Jankowski |
| 5,211,607 | A | | 5/1993 | Fermaglish et al. |
| 5,356,196 | A | | 10/1994 | Chuang |
| 5,380,262 | A | | 1/1995 | Austin |
| 5,407,246 | A | | 4/1995 | Meeker et al. |
| 5,415,590 | A | | 5/1995 | Steingraber et al. |
| 5,451,093 | A | | 9/1995 | Petrie et al. |
| 5,454,745 | A | | 10/1995 | Spielberger |
| D368,813 | S | | 4/1996 | Patton |
| 5,518,475 | A | | 5/1996 | Garland |
| D372,746 | S | | 8/1996 | Mathews |
| D374,901 | S | | 10/1996 | Cacciola et al. |
| 5,586,622 | A | | 12/1996 | Hu |
| 5,590,892 | A | | 1/1997 | Hu |
| 5,688,211 | A | * | 11/1997 | Myers ..... 297/5 X |
| 5,700,201 | A | | 12/1997 | Bellows et al. |
| 5,704,576 | A | | 1/1998 | Meeker et al. |
| 5,728,030 | A | | 3/1998 | Hsieh |
| 5,732,999 | A | | 3/1998 | Petrie |
| 5,733,165 | A | | 3/1998 | Kelley |
| D395,467 | S | | 6/1998 | Bellows |
| 5,845,977 | A | | 12/1998 | Neukam et al. |
| 5,857,944 | A | | 1/1999 | Cone et al. |
| 5,897,089 | A | | 4/1999 | Lancaster et al. |
| D409,261 | S | | 5/1999 | Kelley |
| 5,934,747 | A | | 8/1999 | Garland |
| 5,944,240 | A | | 8/1999 | Honma |
| 6,000,750 | A | | 12/1999 | Rossman et al. |
| 6,048,290 | A | * | 4/2000 | Chen et al. ..... 297/137 |
| 6,073,404 | A | | 6/2000 | Norfleet |
| 6,135,032 | A | | 10/2000 | Ko |
| 6,179,376 | B1 | | 1/2001 | Meeker et al. |
| 6,361,105 | B1 | | 3/2002 | Turner et al. |

* cited by examiner

CHILD ACTIVITY CENTER, ENTERTAINMENT SYSTEM, AND COMPONENTS THEREOF

This application is a divisional of application Ser. No. 09/319,000, filed May 26, 1999, hereby incorporated by reference.

BACKGROUND

Stationary infant activity centers, designed to safely amuse and contain pre-ambulatory infants, are a recent development in the juvenile furnishings market. See for instance U.S. Pat. No. 5,857,944 issued to Cone et al.; U.S. Pat. No. 5,700,201 issued to Bellows, et al.; U.S. Pat. No. 5,688,211 issued to Myers; and U.S. Pat. No. 5,407,246 issued to Meeker, et al. These activity centers use a cloth sling seat, with two leg openings, that allows an infant to stand. The seat is designed to support an infant in the upright position and is rotatably supported relative to its base or main frame so that the seated infant can rotate relative to the base or floor. The seat is also resiliently supported so that the seated infant can bounce up and down. The base can be rounded to allow rocking. These activity centers include a waist height tray. Some have a toy built into the tray (see U.S. Pat. No. 5,700,201) or detachably attached to the tray (see U.S. Pat. No. 5,407,246). Some are adjustable for the infant's size or weight.

These infant activity centers provide a confined environment for an infant from the time the infant is old enough to hold up his or her head, typically at about six months of age, until he/she is able to walk, typically at about twelve months of age. These centers, however, have a limited product life because as soon an infant becomes a toddler, i.e., is able to walk, he or she will usually not tolerate such a confined environment. Thus, the product life often becomes only four to seven months. Some infants do not want to be confined as soon as they can crawl effectively, in which case the product may be in use for even less time.

It is desirable to extend the use of the activity center by making it also appropriate for toddlers. This involves allowing the toddler to move in and out of the activity center at will and providing activities that appeal to toddlers. The present invention meets this need.

SUMMARY

The present invention relates to an activity center and components thereof, including a leg assembly and a tray assembly, which are part of the activity center. The activity center can be converted so that the same unit can be used by a child first as an infant and then as a toddler. The present invention also relates to toys that are usable with the activity center. These toys can be converted from infant use to toddler use.

According to one aspect of the invention, the activity center has a tray that can be configured as a closed loop to contain an infant and reconfigured in an opened configuration to create a play space in which a toddler can enter and exit at will. Thus, a toddler, particularly one who enjoys getting in or out of things, can play inside the activity center or interact with it from the outside. Convertible toys can be attached to or integrated with the activity center. The same toy structure that an infant may find amusing can be converted into a new toy configuration to amuse a toddler.

According to another aspect of the invention, the activity center comprises a base or base assembly (base), a plurality of legs or leg assemblies (legs) connected to the base, and a tray or tray assembly (tray) attached to the legs. The tray is configurable between an opened configuration or position and a closed configuration or position in which the tray forms an enclosure. The activity center include a seat that is detachably attachable to the tray. The seat is attached to the tray when the tray is in the closed configuration, surrounding the seat. The seat is detached from the tray when the tray is in the opened configuration.

The tray can have a pivotal joint, which is attached to one of the legs, and allows the tray to pivot between the opened position and the closed position, and free ends that are lockable together to the closed position. The tray comprises a first tray or member (first tray) and a second tray or member (second tray). The first tray has a first end portion and a second end portion. The second tray has a third end portion and a fourth end portion. The first and third end portions are coupled together and connected to one (third) of the legs. The first and second trays are configurable between the tray opened position and the tray closed position where the tray surrounds the seat. In the tray closed position, the second and fourth end portions are coupled together, with the first and second trays each connected to one (first, second) of the legs.

Specifically, the first tray can have a first hub and a first locking joint and the second tray can have a second hub and a second locking joint. The first hub has a first opening and the second hub has a second opening. The first and second openings can be aligned and the first and second locking joints locked when the tray is in the closed configuration. At least three fasteners can connect the first and second trays to the legs. The first hub can be on the first end portion and the first locking joint can be on the second end portion. The second hub can be on the third end portion and the second locking joint can be on the fourth end portion.

With the first and second hubs are overlapped with the first and second openings aligned, a third fastener can extend through the first and second openings and connect both the first and second trays to the third leg. The first tray has at least third and fourth openings through which a second fastener attaches the first tray to the first leg and the second tray has at least fifth and sixth openings through which a second fastener attaches to the second leg.

In the tray opened configuration, the first fastener attaches the first tray to the first leg through the third opening and the second fastener attaches the second tray to the second leg through the fifth opening. In the tray closed configuration, either the first or a fourth fastener can attach the first tray to the first leg through the fourth opening and either the second or a fifth fastener can attach the second tray to the second leg through the sixth opening. The first and second trays each can be C-shaped or semi-circular (complementary) so that the two tray together can form an enclosing configuration. Specifically, the first and second trays can be substantially annular with a central opening when the first and second locking joints are locked. In this respect, the fourth opening can be spaced farther away from the first opening than the third opening and the sixth opening can be spaced farther away from the second opening than the fifth opening.

The leg or leg assemblies each can have a sleeve extending uprightly from the base, a slider received in the sleeve and movable relative to the sleeve, a spring positioned between the sleeve and the slider and supporting the slider relative to the sleeve, and a leg member or leg received in the slider and adjustably mounted to the slider so that the position of the leg is adjustable relative to the slider. The tray is connected to the legs.

A height adjuster can be included for each of the legs (first, second, third). The legs each have an elongated wall having a plurality of slots formed along a longitudinal direction thereof. The height adjuster has a leg engaging member movably connected to the slider and biased toward and movable substantially perpendicularly to the elongated wall. The leg engaging member has a projection dimensioned to extend through the slot and hold the leg in position relative to the slider. Each leg can have a plurality of pairs of slots formed along the elongated wall. The leg engaging member can have a pair of slot engaging projections that can extend through the slot pair.

Each leg is adjustable between a spring lock out position, where an upper portion of the leg is substantially flush with an upper portion of the sleeve and an extended position where the leg is positioned higher than the sleeve.

The base can have a substantially convex surface that allows the base to rock and stowable stands selectively engageable with a surface to prevent the base from rocking.

According to another aspect of the invention, a convertible toy can be a ring loop toy comprising a substantially U-shaped member defined by a cross member and two spaced apart legs, and a connector that detachably connects the U-shaped member. The connector allows the toy to be mounted to the tray in a first configuration in which the legs extend below the tray and with the cross member extending above the tray and in a second configuration in which the legs extend above the tray and with the cross member extending below the tray.

At least one ring member having an opening can be used with this toy. In the first position, the ring member is movable across the cross member and, in the second position, the legs extending above the tray receive the ring member.

The cross member can form a bend between the two legs, and the legs can extend substantially parallel to each other. The associated tray has two spaced apart apertures that can receive the legs. Each of the two apertures can be oval to permit the legs to flex away from each other. Each of the two legs includes a groove that can engage the tray at a periphery of a respective one of the two apertures and lock the U-shaped member to the tray. The grooves of the two legs face each other. Each of the two legs has a first flanged portion and a second flange portion spaced from and opposite the first flanged portion, the spacing between the first and second flange portions defining the groove. The first and second flanged portions of one leg are opposite the first and second flange portions of the other leg. Each of the two legs can further include a third flanged portion formed diametrically opposite the first flanged portion. The third flanged portions of the two legs face away from each other so that the length across the first and third flanged portions of each leg is adapted to be greater than a longest length of either of the oval apertures.

The tray can include two pairs of opposed stabilizing ribs extending downward from a lower face of the tray. One pair can be located adjacent to one of the two apertures and another pair can be located adjacent the other of the two apertures. The stabilizing ribs is adapted to laterally supporting the U-shaped member.

According to another aspect of the invention, a toy for the present activity center can be a toy sorter. The toy sorter has a substantially hollow body configured in a shaped of a house having a plurality of differently configured openings that are adapted to receive objects having complementary configurations. The hollow body can comprise a base portion that is detachably attachable to the tray and a top portion attached to the base portion. The house shaped body can have a door hingedly mounted to the top portion and the base portion, a chimney, a roof, and two opposing sides. Each of the door, chimney, and the two opposing sides can have one of the configured openings. Each of the openings comprises one of a generally circular, rectangular, and triangular shape. The door can have a generally circular opening for passage of generally circular objects, the two sides respectively can have generally rectangular and triangular openings for passage of generally rectangular and triangular objects, respectively. The opening in the chimney can be sufficiently large to allow insertion of rectangular, triangular, and circular objects. The door can openable to access the objects inserted through the openings. The house shaped body can further include a roof section having a front side and a back side, and a reflecting surface on the back side of the roof section.

The base portion of the toy sorter can have securing members depending therefrom for attaching to the tray and the tray can have complementary securing members for intercepting the securing members of the base portion. The base portion securing members can be tabs located at a periphery of base portion and the complementary securing members can be apertures that releasably engage the tabs. The tabs and the complementary apertures enable the house shaped body to be mounted in different positions.

Another toy that can be included with the present activity center is a receptacle for holding an article. The receptacle has opposing first and second pivot members. The tray has a first aperture extending therethrough and opposing third and fourth pivot members that engage the first and second pivot members to form a pivot axis and to allow the tray to pivot and prevent the same from pivoting, depending upon the relative orientation between the first, second, third, and fourth pivot members.

The first and second pivot members can be first and second pivot shafts extending outwardly in the opposing directions and the third and fourth pivot members can be third and fourth apertures formed adjacent the first aperture to receive the first and second pivot shafts. The receptacle has first and second projections that engage the upper surface of the tray adjacent the first aperture. The first aperture is asymmetrical about the pivot axis so that when the first and second pivot shafts are respectively inserted in the third and fourth apertures to a stationary configuration, the first and second projections engage the tray from both sides of the pivot axis to prevent the tray from pivoting. When the first and second pivot shafts are respectively inserted in the fourth and third apertures to a pivot configuration, the second projection engages the tray from one side of the pivot axis, while the first projections clears through the other side of pivot axis to allow the receptacle to pivot and drop the article through the first aperture.

The first aperture can be divided into a first section and second section along a generally medial line extending across the pivot axis. The area of the first section can be smaller than the area of the second section. These sections each can be substantially semicircular for a substantially hemispherical receptacle. The first projection can be a lip extending peripherally around an opening thereof and the second projection can be a handle extending outwardly beyond the lip.

In the stationary configuration, the lip extends over the periphery of the smaller first section and the handle extends over the periphery of the larger second section. In the pivoting configuration, the handle extends over the periphery of the smaller first section, but the lip is insufficient to extend over the periphery of the second larger second section to allow the receptacle to pivot about the pivot axis and dump or drop the article through the first recess. The base of the activity can have a track that receives the dropped ball and guides that same. The track extends between a first end and a second end, the first end being located vertically below the first aperture and the second end being located at a relatively lower elevation than the first end.

Another convertible toy that can be included is a toy wand that can be mounted to the tray in a locked configuration or a removable configuration. The toy wand includes at least one annular ring. The tray can have a receptacle having at least one protuberance that engages the annular ring to maintain the toy wand secured to the tray. The toy wand is positioned to the removable configuration when the annular ring is cleared from the protuberance.

Another convertible toy that can be included is a toy holder detachably mounted to the tray. The toy holder is mounted to the tray as an article holder in one configuration and as a ball holder in another configuration. The toy holder comprises a pivotal body having ball holding members at one end and an article holding wall formed at another end, wherein the toy holder is mounted to the tray from the one end to convert to the article holder configuration and the toy holder is mounted to the tray from the other end to convert to the ball holder.

The toy holder can have first and second arms pivotally connected to each other, each arm having a ball holding member. The first and second arms are pivotal between a first position in which the arms move away from each other to allow removal and attachment of the ball thereto and a second position in which the ball holding members are collinearly aligned so as to rotatably support a ball therebetween. The first and second arms each include a floor portion and a side wall portion that mutually form a floor and a side wall when the toy holder is in the second position. The ball holding members can be journals adapted to engage a complementary diametrically opposed holes in the ball.

The tray can have a mount for releasably locking the toy holder to the tray. The mount comprises a recess and a lock that engages the first and second arms when the toy holder in positioned to the article holder configuration and that engages the side wall when the toy holder is positioned to the ball holder configuration. The lock can comprise a pair of resiliently biased fingers extending downwardly from the tray, each resiliently biased finger having at least one tab or hook that engages the arm or the side wall. The side wall is substantially cylindrical and has an inwardly extending lip to which the tab engages to lock the toy holder to the tray when the toy holder is in the ball holder configuration. Each resilient finger can have a pair of tabs, one for engaging the arm and another for engaging the lip. The pair of tabs can be offset from each other.

Another convertible toy can be a sound instrument and a storage compartment combination. The sound instrument can be attached to a lid pivotally mounted to the tray and movable to cover and open a compartment(s) formed in the tray. The lid can substantially occlude the storage compartment and supports the sound instrument on an exterior surface with respect to the occluded compartment. The lid is opened to reveal an interior surface of the compartment. The sound instrument can be a keyboard.

Another convertible toy can be a sheet holder comprising at least one planar member pivotally mounted to the tray. Each planar member can have at least on one side a cover adapted to hold a display sheet, which includes a photo.

BRIEF DESCRIPTION OF THE DRAWINGS

These and other features, aspects, and advantages of the present invention will become more apparent from the following description, appended claims, and accompanying drawings, which are briefly described below.

DETAILED DESCRIPTION

Figure 1:
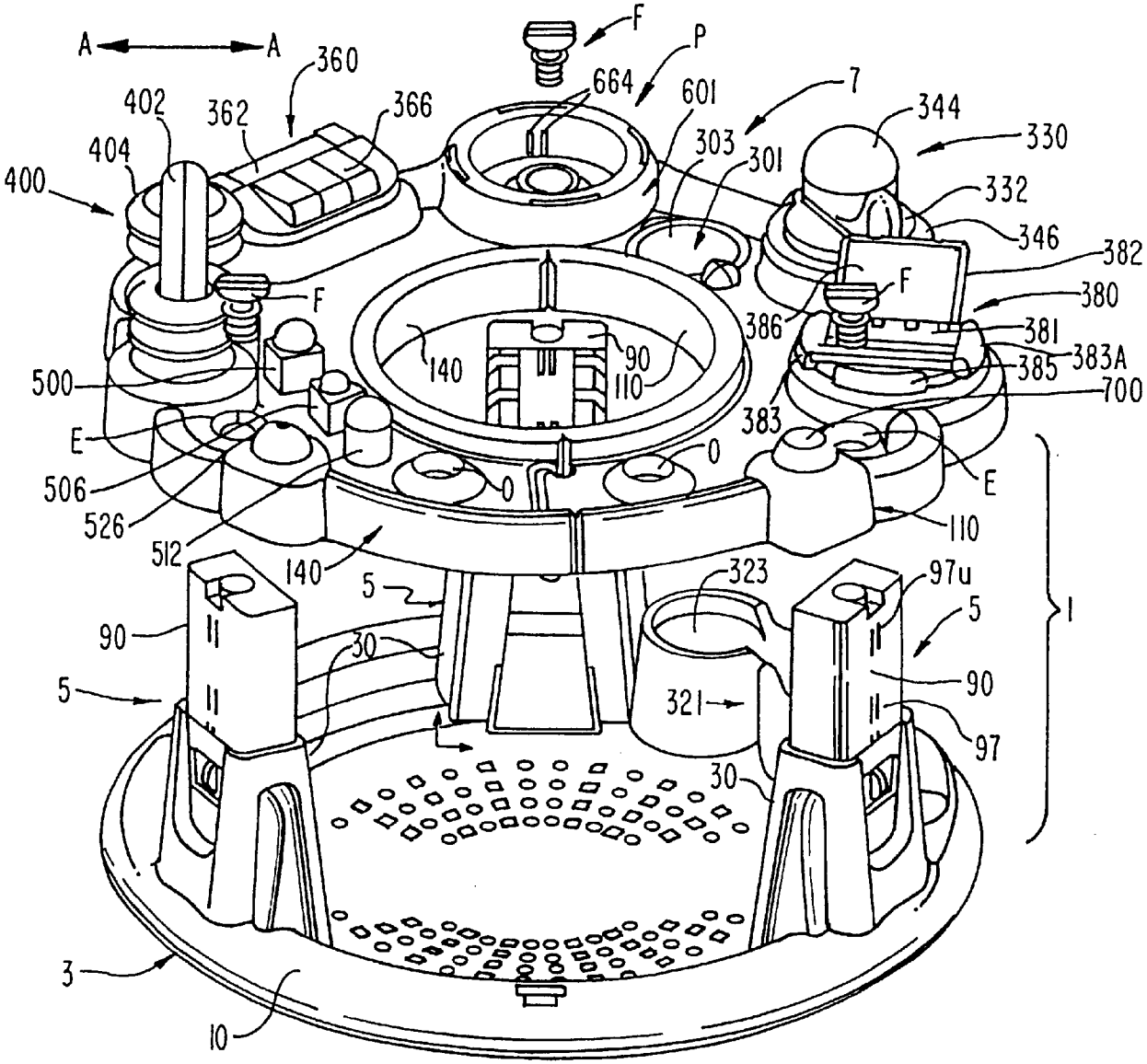
FIG. 1 is an exploded perspective view of the present convertible activity center in the closed position or configuration (primarily intended for infant use).
Figure 1A:
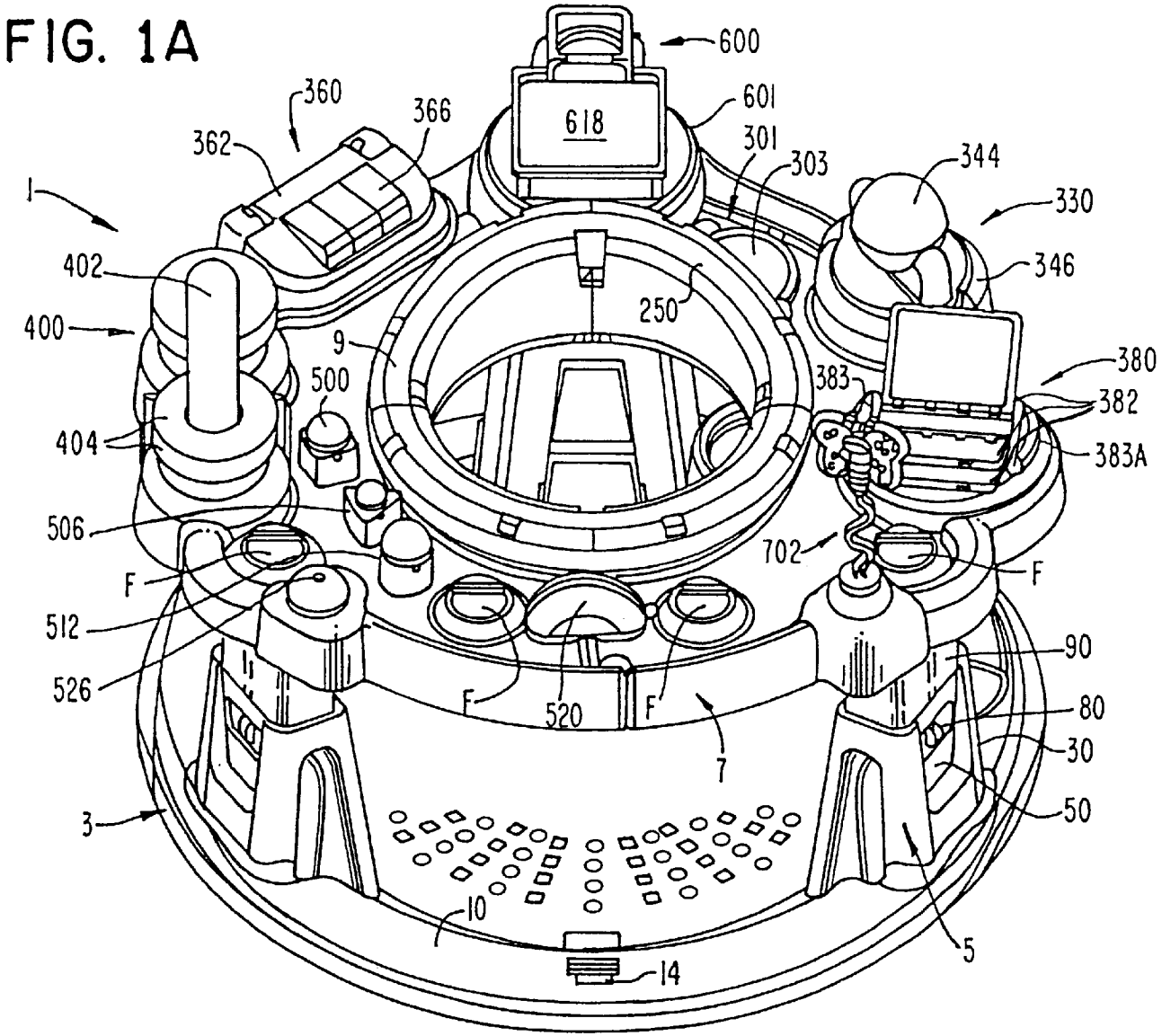
FIG. 1A is a view similar to FIG. 1 with a seat ring attached to a tray assembly thereof and the tray assembly mounted to legs extending from the base.
Figure 2:
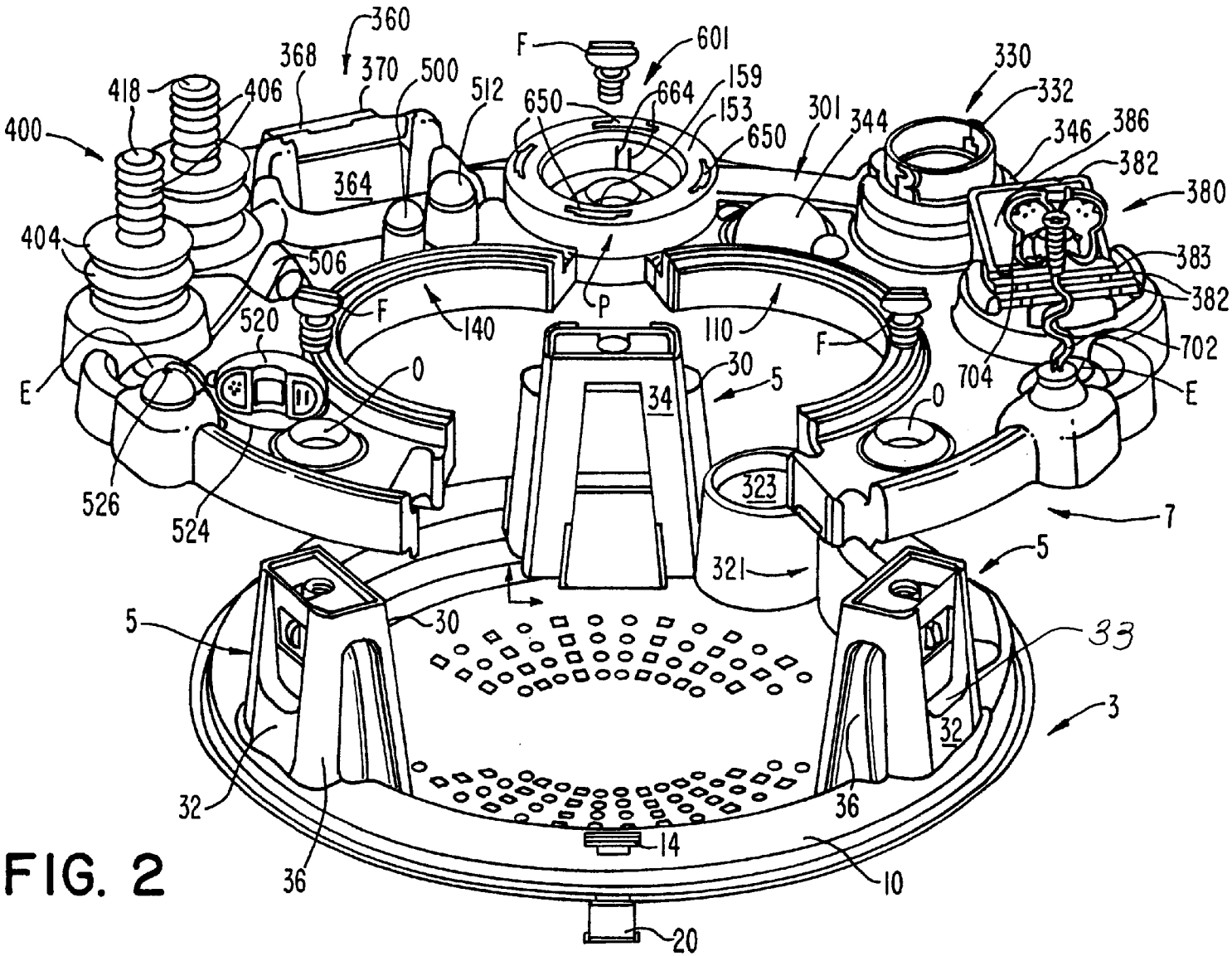
FIG. 2 is an exploded perspective view of the embodiment shown in FIG. 1 in the opened position or configuration (primarily intended for toddler use).

The present activity center 1, as shown in FIGS. 1–2, is convertible so that the same unit can be adapted for a pre-ambulatory infant and for a toddler who is starting to walk or can walk. For infant use, the activity center typically contains or restrains an infant. A toddler, on the other hand, needs an activity center that allows him or her to move about at will. The present activity center has a tray that is configurable to and from a closed position, in which the tray is closed (see FIGS. 1 and 1A), from and to an opened position (see FIGS. 2 and 2A), creating an opening extending into the center of the activity center 1 to provide a play space. This feature will amuse particularly those toddlers who enjoy getting in and out of things. Toddlers also can interact with the activity center 1 from the outside.

It is desirable to easily convert the activity center 1. It is also desirable to minimize adding or subtracting components. Extra components can become easily misplaced or lost. The present activity center 1 is adapted to be converted between the closed position (primarily intended for infant use) to the opened position (primarily intended for toddler use) with a few simple steps and without tools. Only one part, the seat, needs to be removed when converting the activity center 1 to the opened position for toddler use.

The tray associated with a conventional infant activity centers is typically too high for a toddler when the toddler is sitting on the base or floor. If the tray is too high, the toddler may be able to push the unit over. The springs that allow an infant to bounce up and down in the conventional infant activity center can also make the associated tray less stable. This becomes more pronounced when the tray is no longer annular or is not in an enclosed geometric configuration, i.e., when it is no longer in a closed loop. The present activity center 1 has adjustable legs that can lock out the spring-suspension function. With the legs in the spring locked-out position, the tray, which provides a play surface, can be maintained at a convenient level for the toddler, with the bounce springs deactivated and the tray supported directly on the base, i.e., the sleeve 30, to provide a safer playing environment. This provides a more stable environment when the tray is converted to the opened position.

Specifically, the present activity center 1 comprises a base assembly 3, a plurality of substantially identical leg assemblies 5 (three shown), a tray assembly 7, and a seat assembly 9. The activity center 1 can include one or more toys or detachable bodies 301, 330, 360, 380, 400, 500, 506, 512, 520, 600, and 702 described below, to provide an entertainment system.

Figure 5:
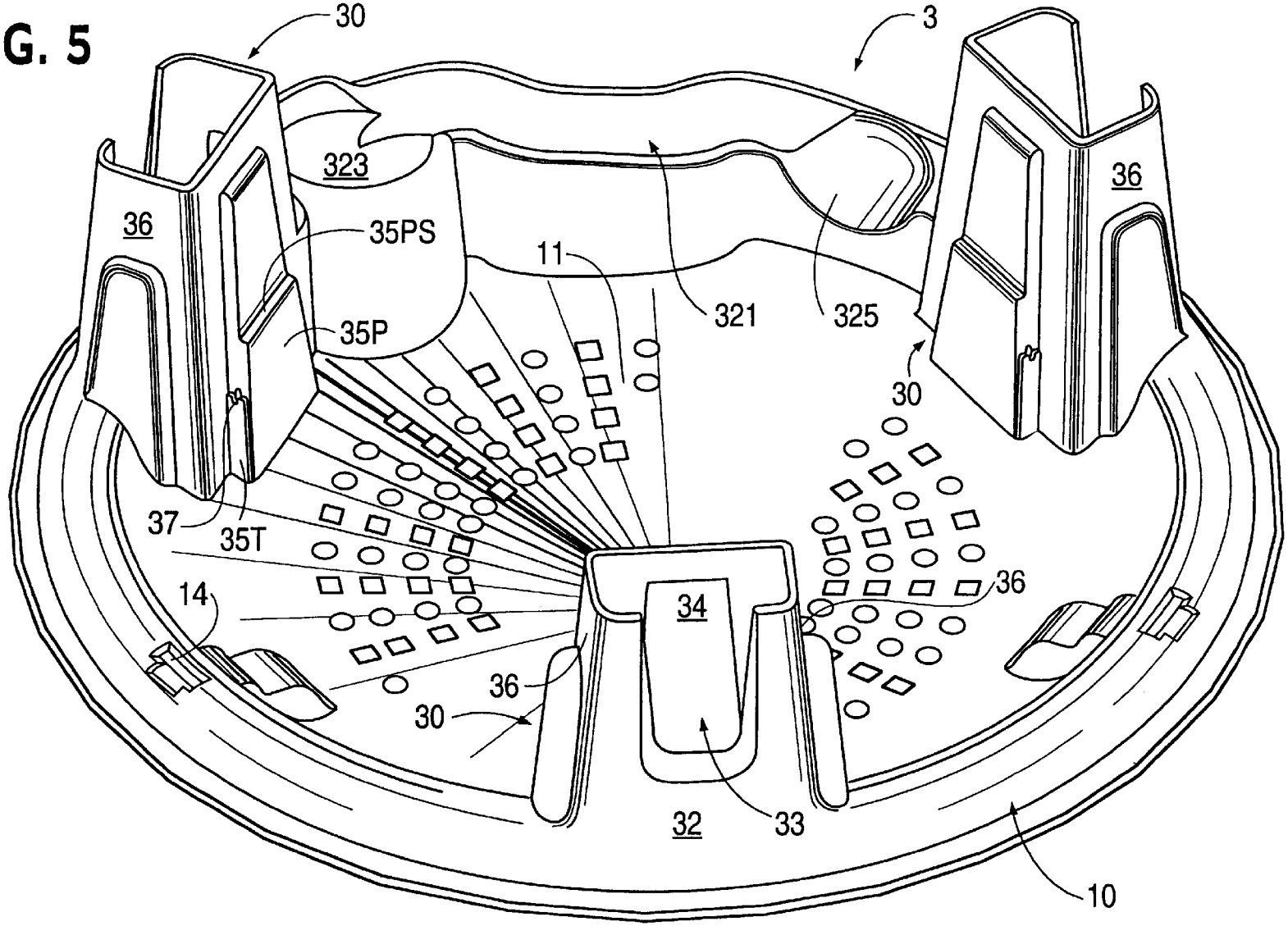
FIG. 5 is a perspective view of a base of the activity center, illustrating sleeves extending from the base and a ball track.
Figure 5A:
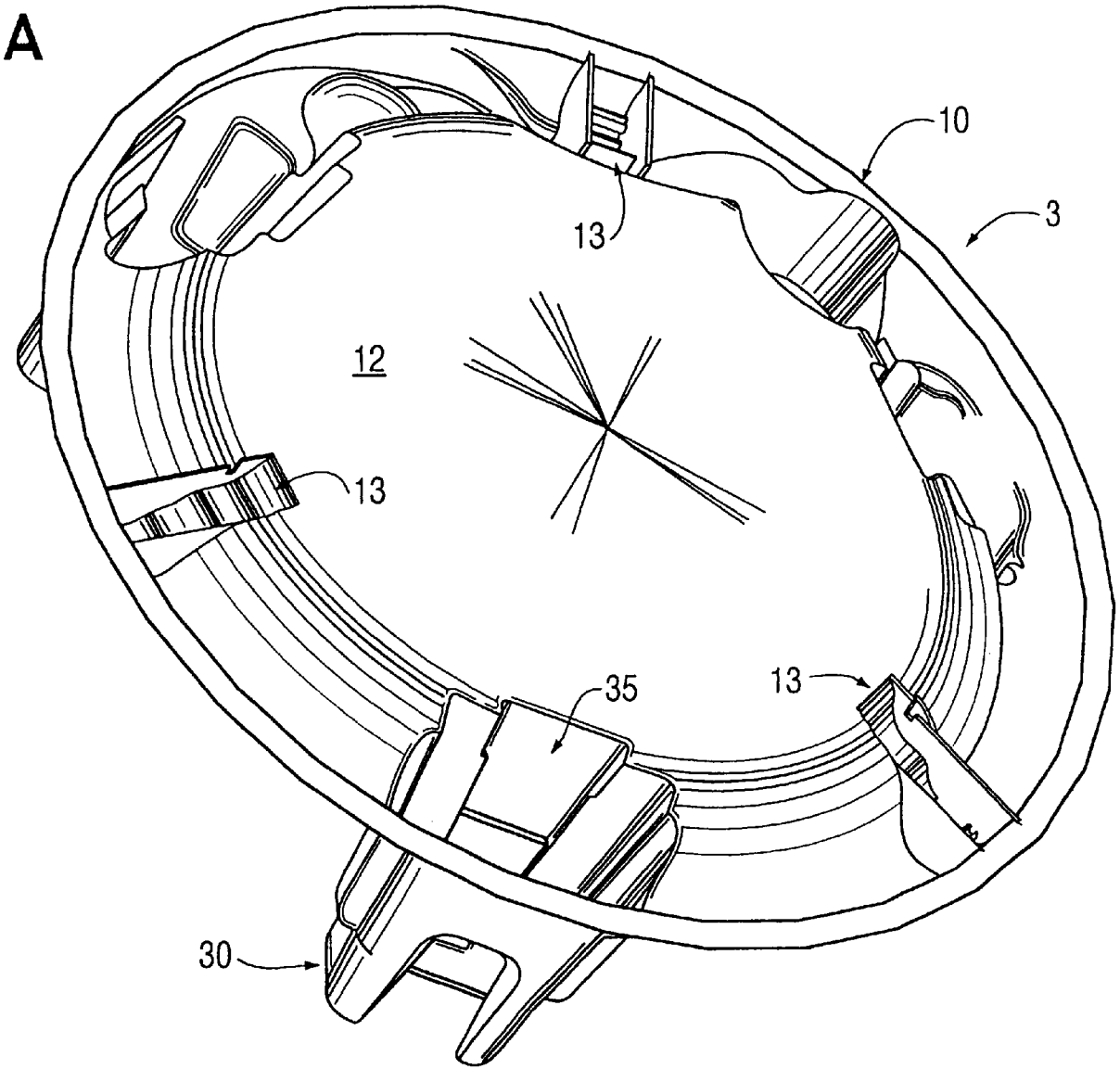
FIG. 5A is a bottom perspective view of the base.

Referring to FIGS. 5 and 5A, the base assembly 3 comprises a base 10, which can be saucer shaped, having a convex bottom 12 to allow rocking, a plurality of upstanding leg receiving sockets or sleeves 30, and feet or stands 20 (see FIGS. 2 and 6) that can be selectively moved to prevent the base 10 from rocking. Specifically, the base 10 is substantially circular in shape with an upper side 11, which is adapted to provide a surface on which an infant can stand and on which a toddler can sit. The upper side 11 can be concave as shown. As better shown in FIGS. 1, 2, and 5, the base 10 has three upstanding sleeves 30 that respectively support three legs 90, one on each sleeve 30. The embodiment shown has the sleeves 30 integrally or monolithically formed with the base 10, but they can be attached or detachably connected to the base 10 if so desired for ease of storage or manufacturability, etc.

FIG. 5A shows the base 10 with the stands 20 detached. Referring to FIGS. 5C and 6, the stands 20 (three in this embodiment) are detachably connected to the base and are selectively pivotal between a rock-enabling position and a rock-disabling position. FIGS. 2 and 5C show one of the stands 20 in the rock-disabling position, where the stand 20 extends outwardly so that it can engage the ground or floor. In the rock-enabling position, as shown in FIG. 1, the stand 20 is tucked or stowed away close to the base so that it does not engage the ground to allow the convex surface to rock.

Figure 5B:
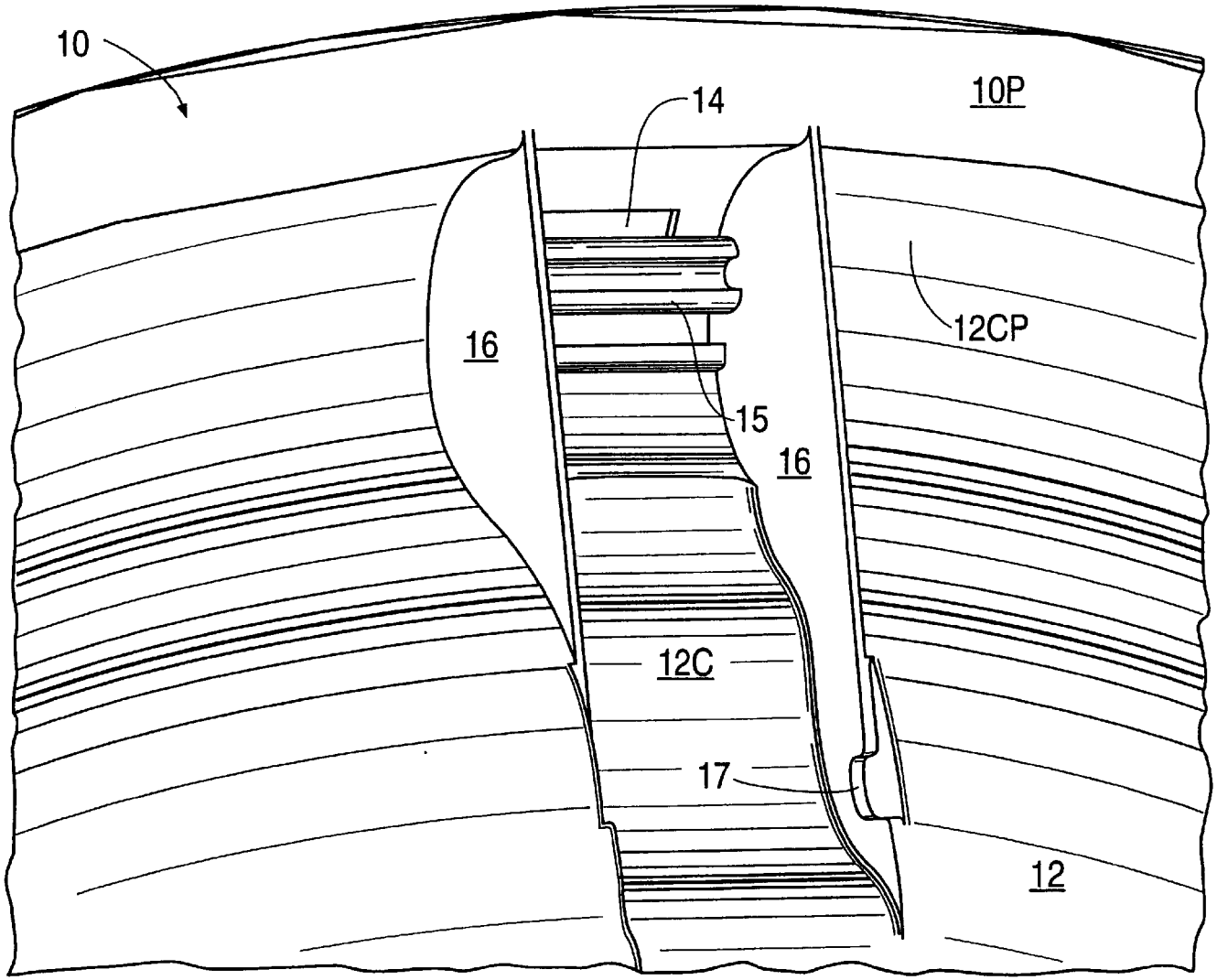
FIG. 5B is an enlarged detailed view of FIG. 5A, illustrating a stand mount.
Figure 5C:
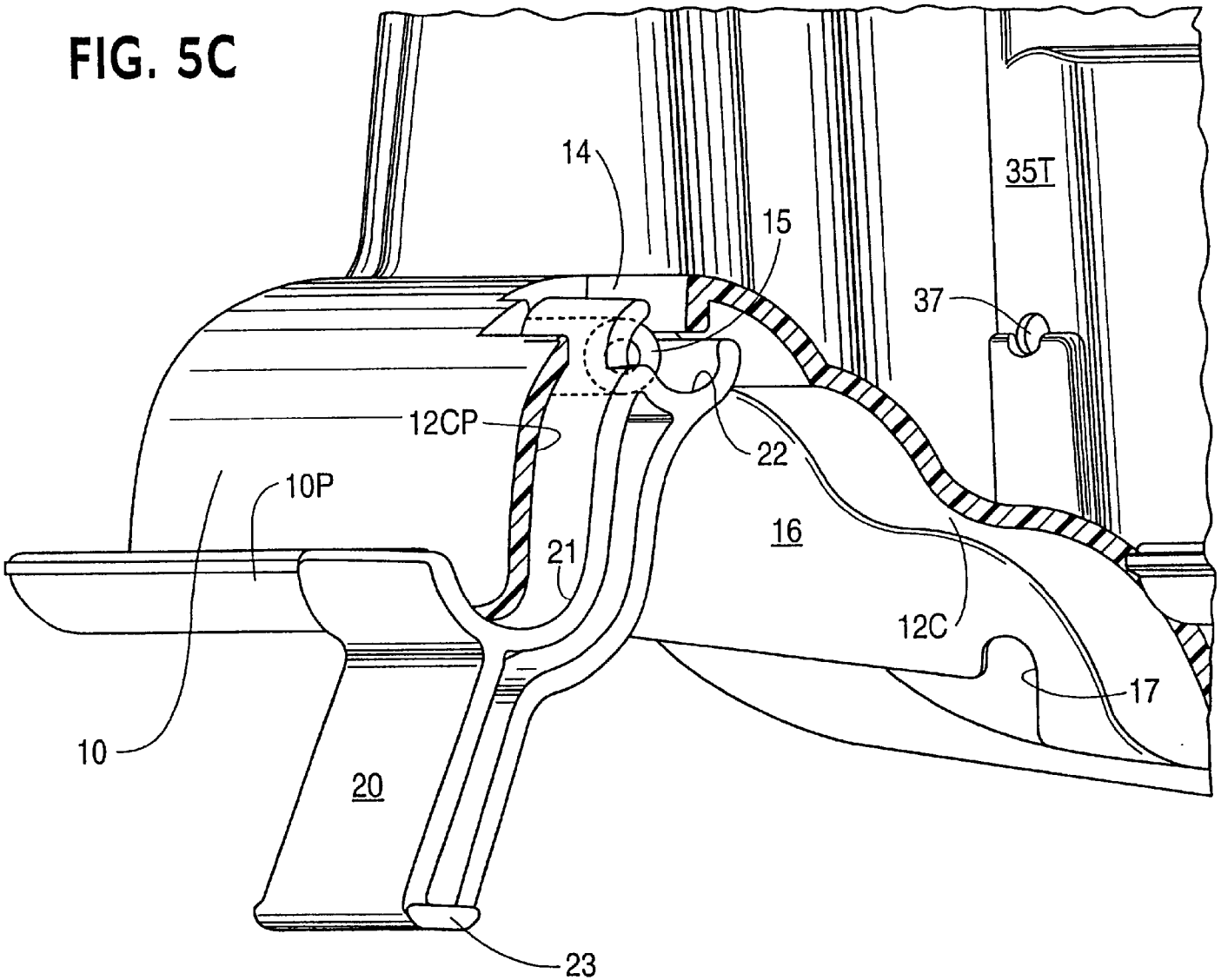
FIG. 5C is a sectional perspective view of the base with the stand in the extended position.
Figure 6:
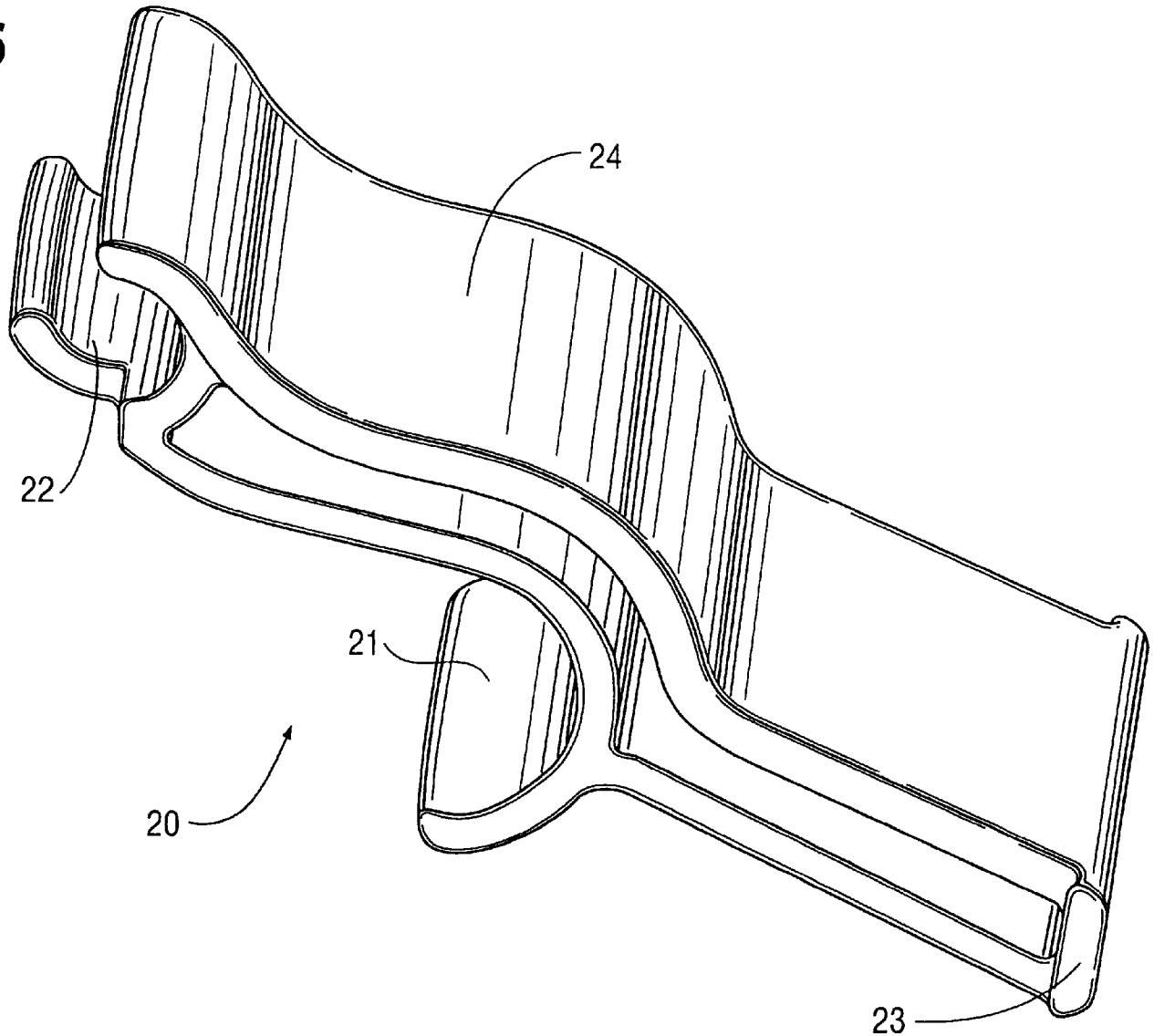
FIG. 6 is a perspective view of the stand.

Referring to FIGS. 5A–5C, three stand receiving connectors 13 are formed on the convex bottom 12, near its outer circumferential periphery 10P for the respective three stands 20 (see FIG. 6). Each connector 13 has a T-shaped slot 14 (see FIGS. 2 and 5) and a pivot shaft 15 spaced from and facing the slot 14. The pivot shaft 15 is spaced away from the slot 14 and held in position by a pair of spaced walls 16 extending generally downwardly from the bottom 12. The bottom 12 also has a pair of opposing recesses 17 formed on the walls 16. The recesses 17 receive the respective stand 20 and lock the stand 20 in the stowed position to enable rocking.

Referring to FIGS. 5B, 5C, and 6, each stand 20 is configured to the contour of the convex bottom 12 so that it tucks flush against the bottom 12 when rocking is enabled. Specifically, one side 24 of the stand 20 is contoured complementary to the contour 12C of the base bottom 12 extending between the spaced walls 16. One end of the stand 20 has a sleeve portion 22 that receives the pivot shaft 15 so that the stand 20 is pivotal about the shaft 15. The opposite end of the stand 20 has laterally extending portions 23 configured to be seated and retained in the recesses 17. The extending portions 23 can snap fit in the recesses. As more clearly shown in FIG. 5C, the opposite side 21 of the stand 20 is contoured complementary to the underside contour 12CP adjacent the periphery 10P of the base 10. The opposite side 21 can be configured to snap fit onto the base periphery 10P to maintain the extended position. The weight applied to the base 10 also keeps the stand 20 in the extended position.

Referring to FIGS. 1, 2, 7, 7A, 7B, 7C, 7F, 7G, and 7H, each of the three leg assemblies 5 includes the sleeve 30, a spring base 40, a slider 50, and a leg 90. The spring base 40 is attached to the sleeve 30, and with the slider 50 inserted in the sleeve so that the slider 50 is supported on at least one spring S positioned (see FIGS. 7 and 7A, where the spring S is schematically shown) between the spring base 40 and the slider 50. The leg 90 is inserted in the slider 50 so that the leg 90 is spring loaded or spring suspended relative to the sleeve 30.

The sleeve 30 is tubular, with the inner surfaces complementary to the shape of the slider 50 to allow the slider 50 to slidably move in the sleeve 30 while being spring suspended. The sleeve 30 has a first side 32, a second side 34 opposite the first side 32, and opposing third and fourth sides 36, 36 extending between the first and second sides 32, 34. Although the first and second sides 32, 34 of the embodiment shown are wider than the third and fourth sides 36, 36, the relative widths can be reversed so that the sides 36 are wider. The sleeve 30 and slider 50 also can have a round or oval configuration. The first side 32 has a substantially U-shaped cutout 33 that opens to the upper edge thereof. The second side 34 is adapted to receive the spring base 40.

Figure 7:
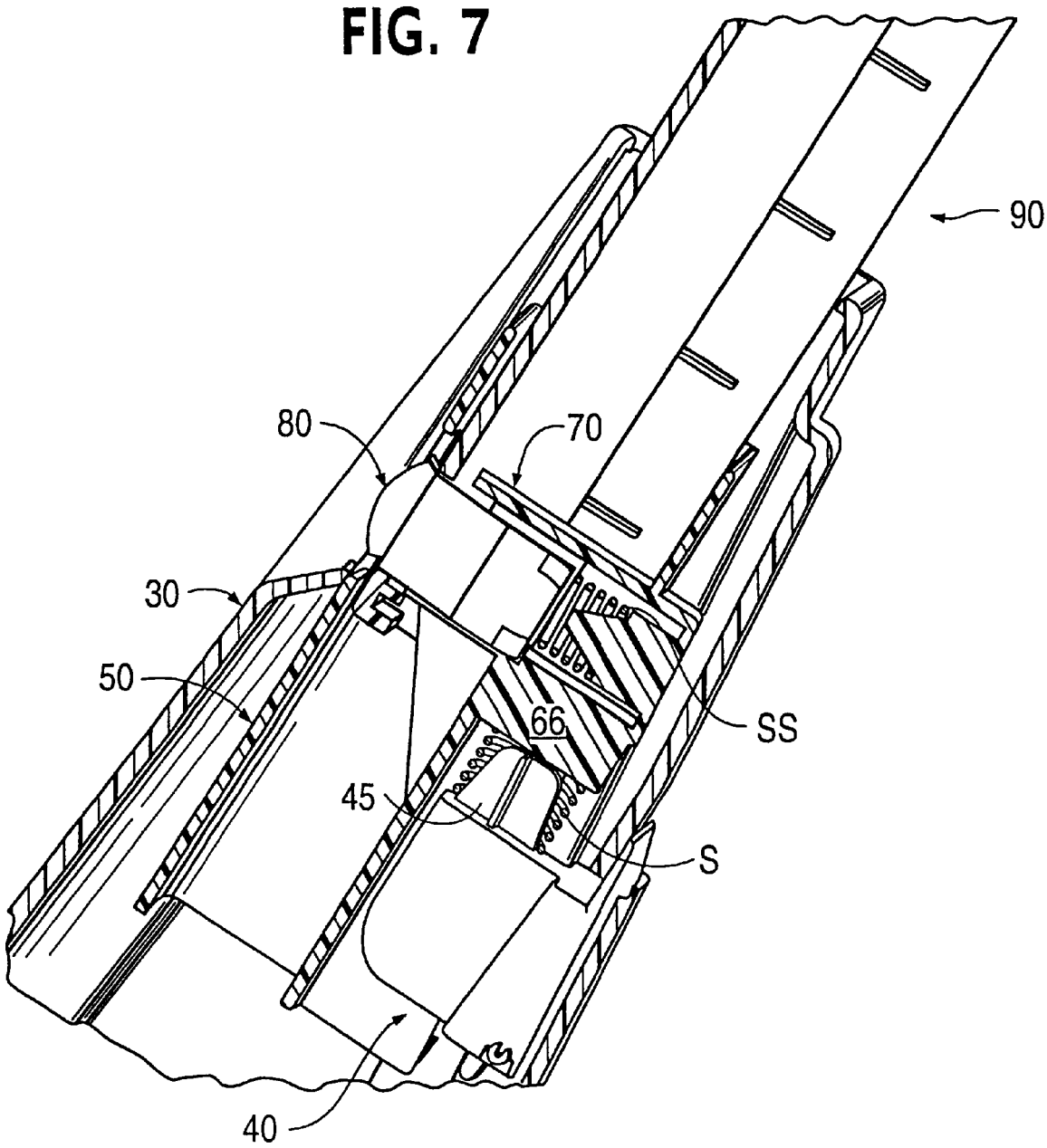
FIG. 7 is a cross-sectional view of the leg assembly with the sleeve in the fully compressed state.
Figure 7A:
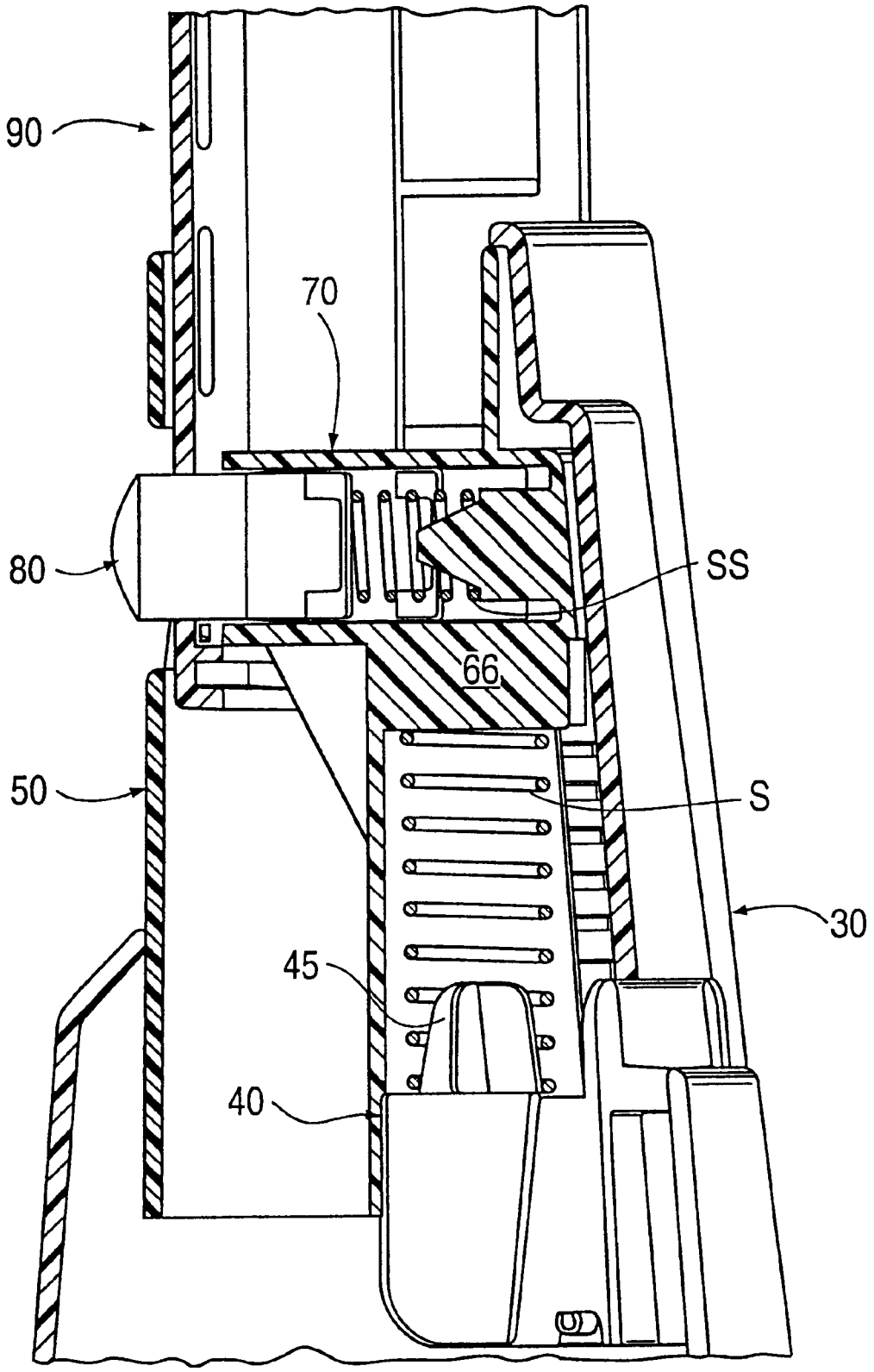
FIG. 7A is a cross-sectional view similar to FIG. 7, but with the sleeve in the relaxed or uncompressed state.
Figure 7B:
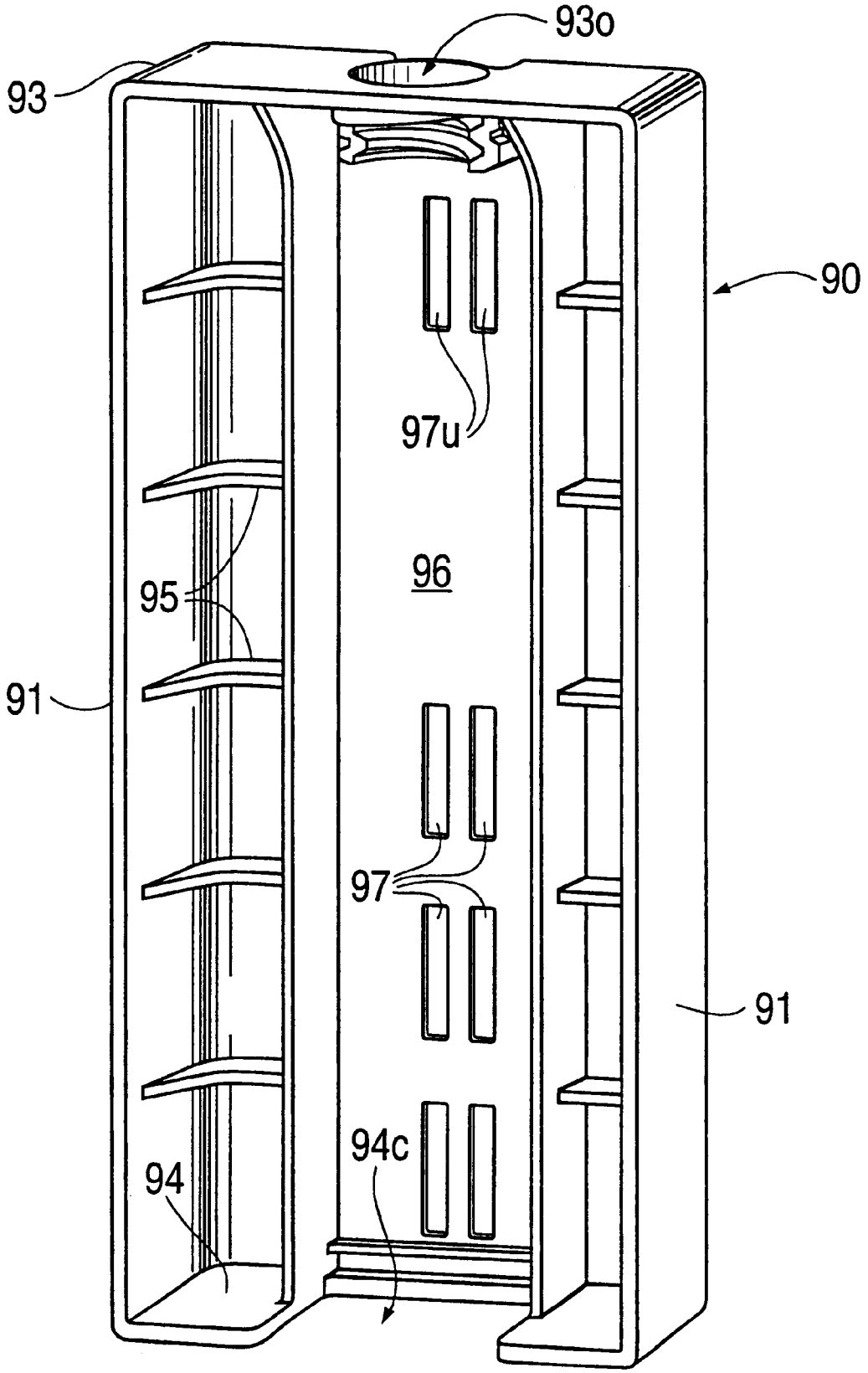
FIG. 7B is a perspective view of the leg.
Figure 7C:
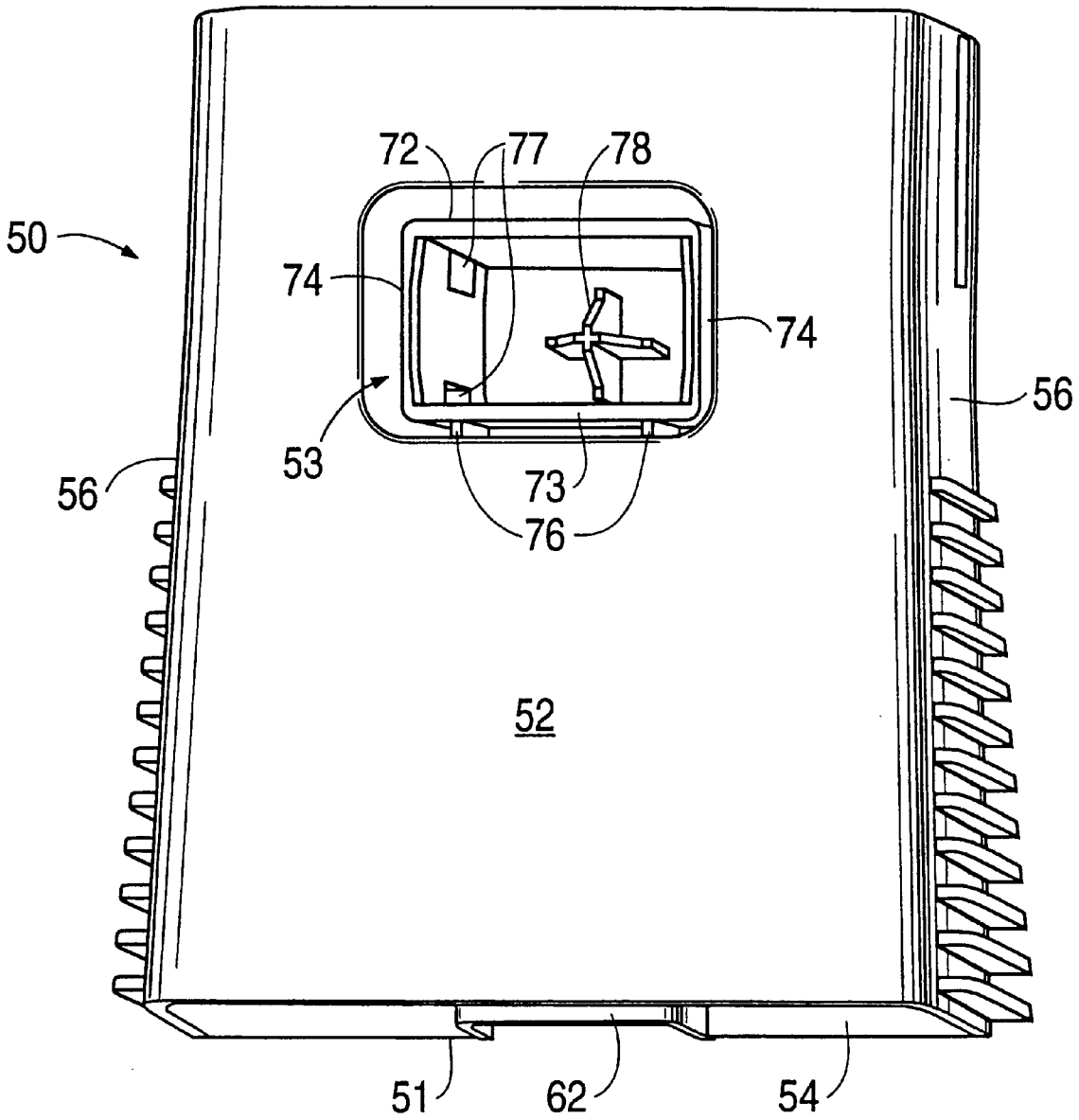
FIGS. 7C and 7D are perspective views of the slider.
Figure 7D:
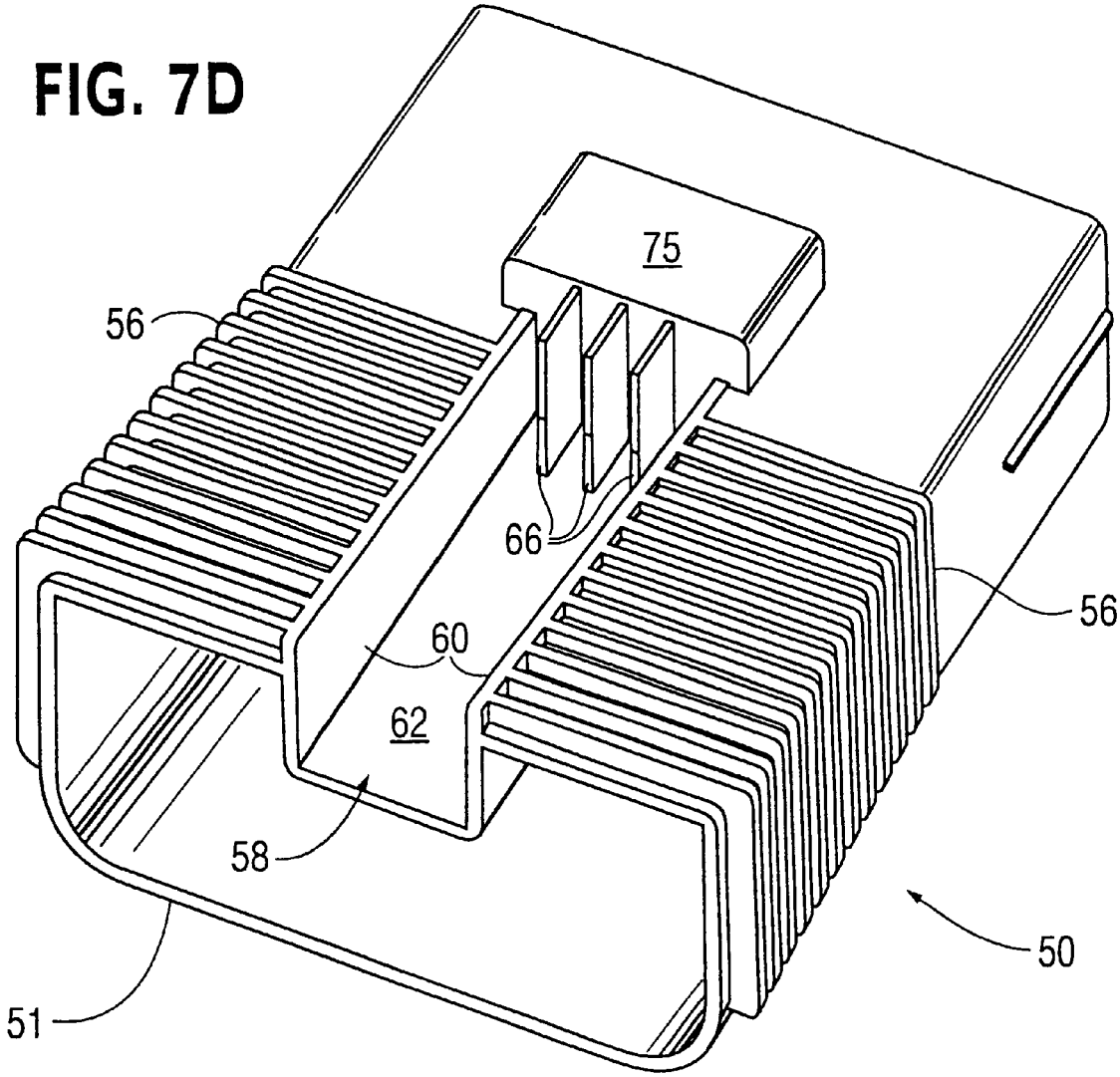
Figure 7E:
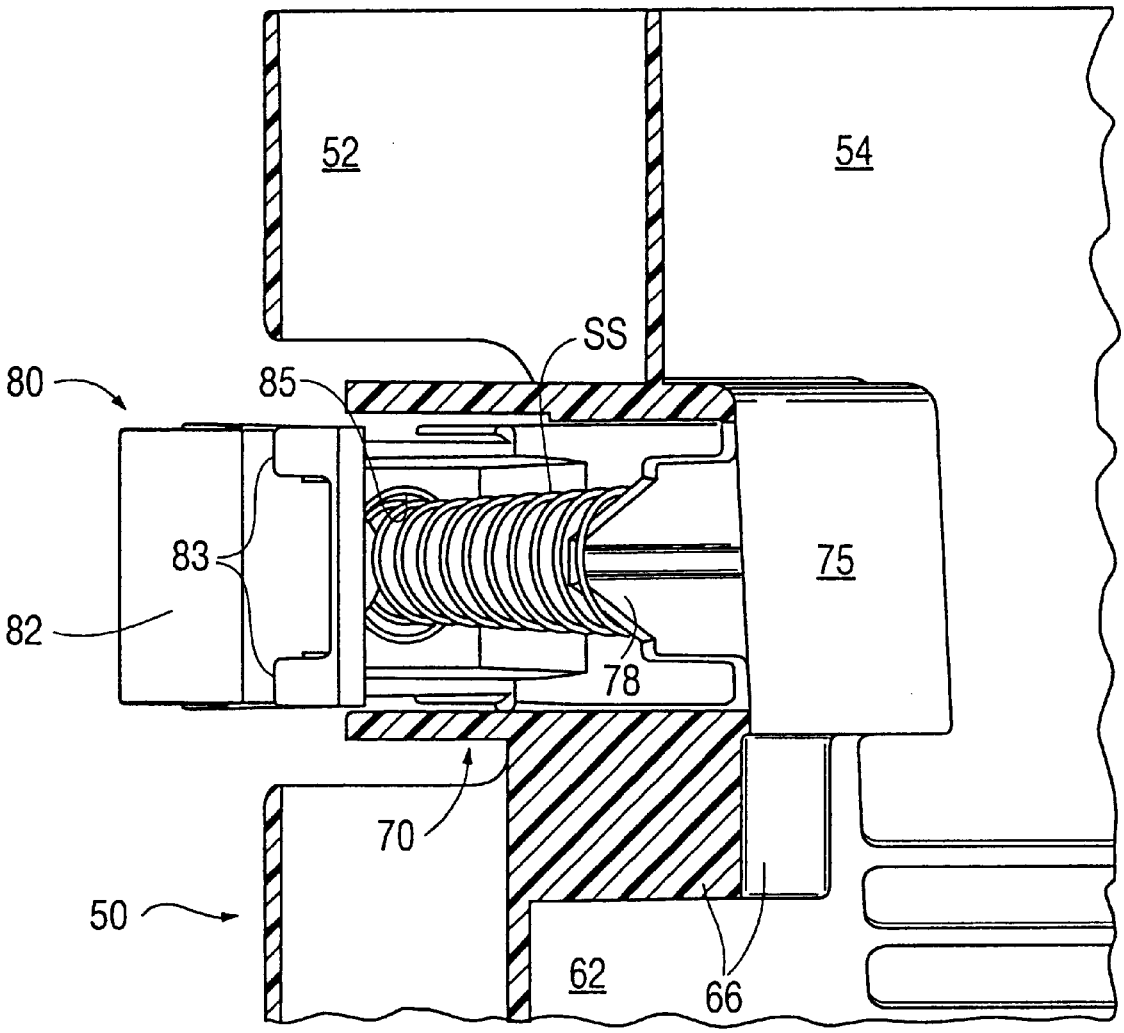
FIGS. 7E and 7F are various sectional perspective views of the slider assembled with a leg height adjustment button.
Figure 7F:
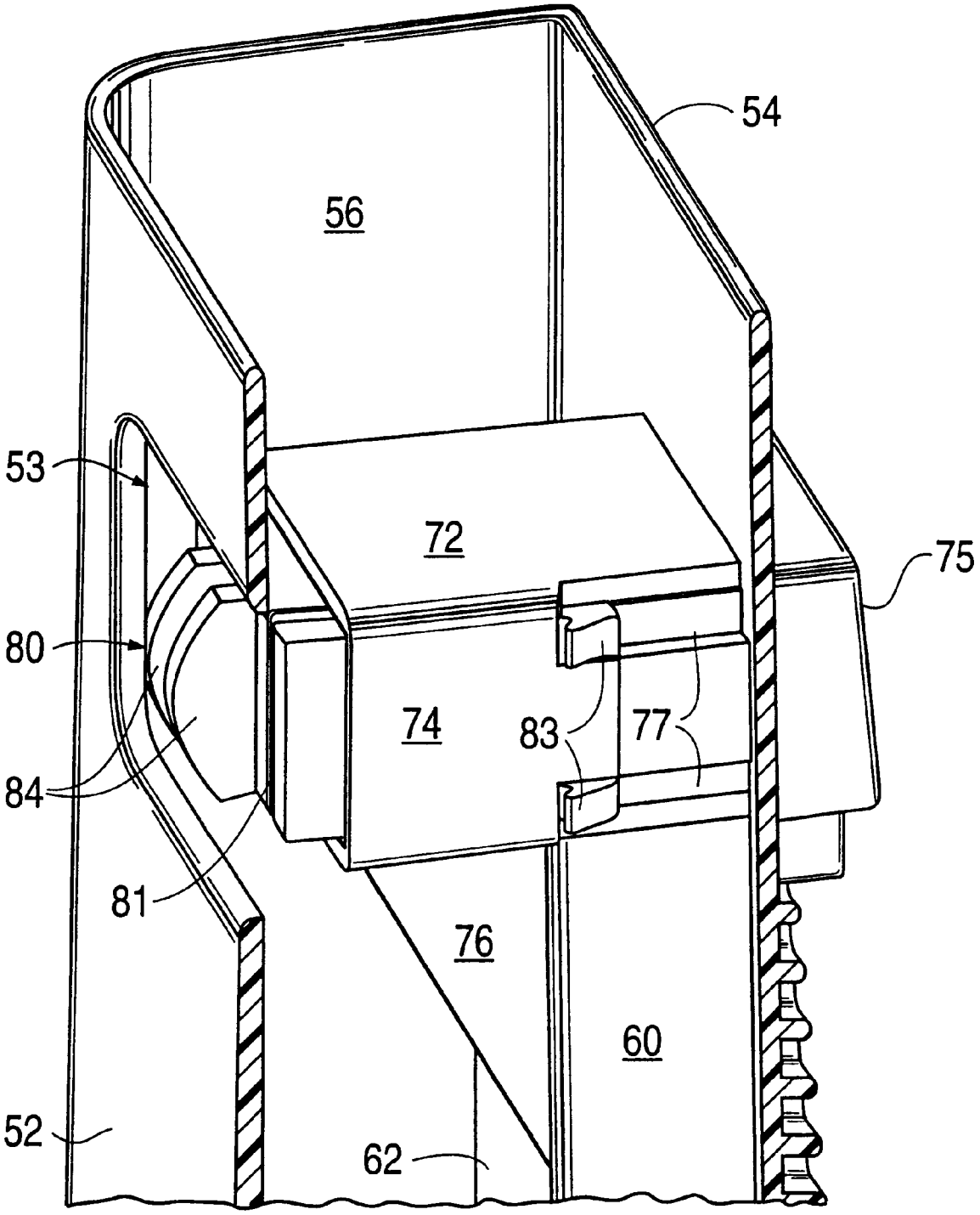
Figure 7G:
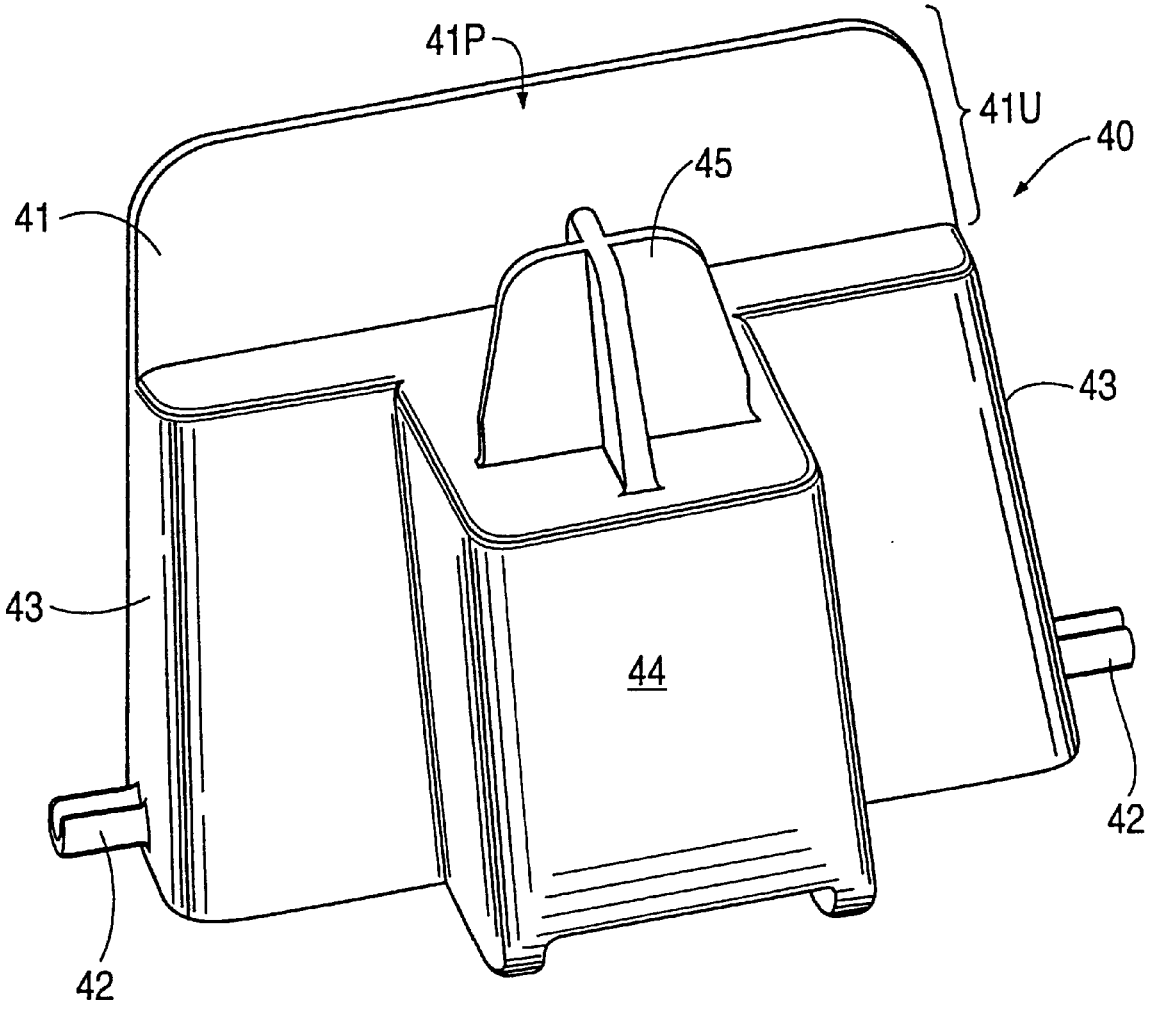
FIG. 7G is a perspective view of a spring base.
Figure 7H:
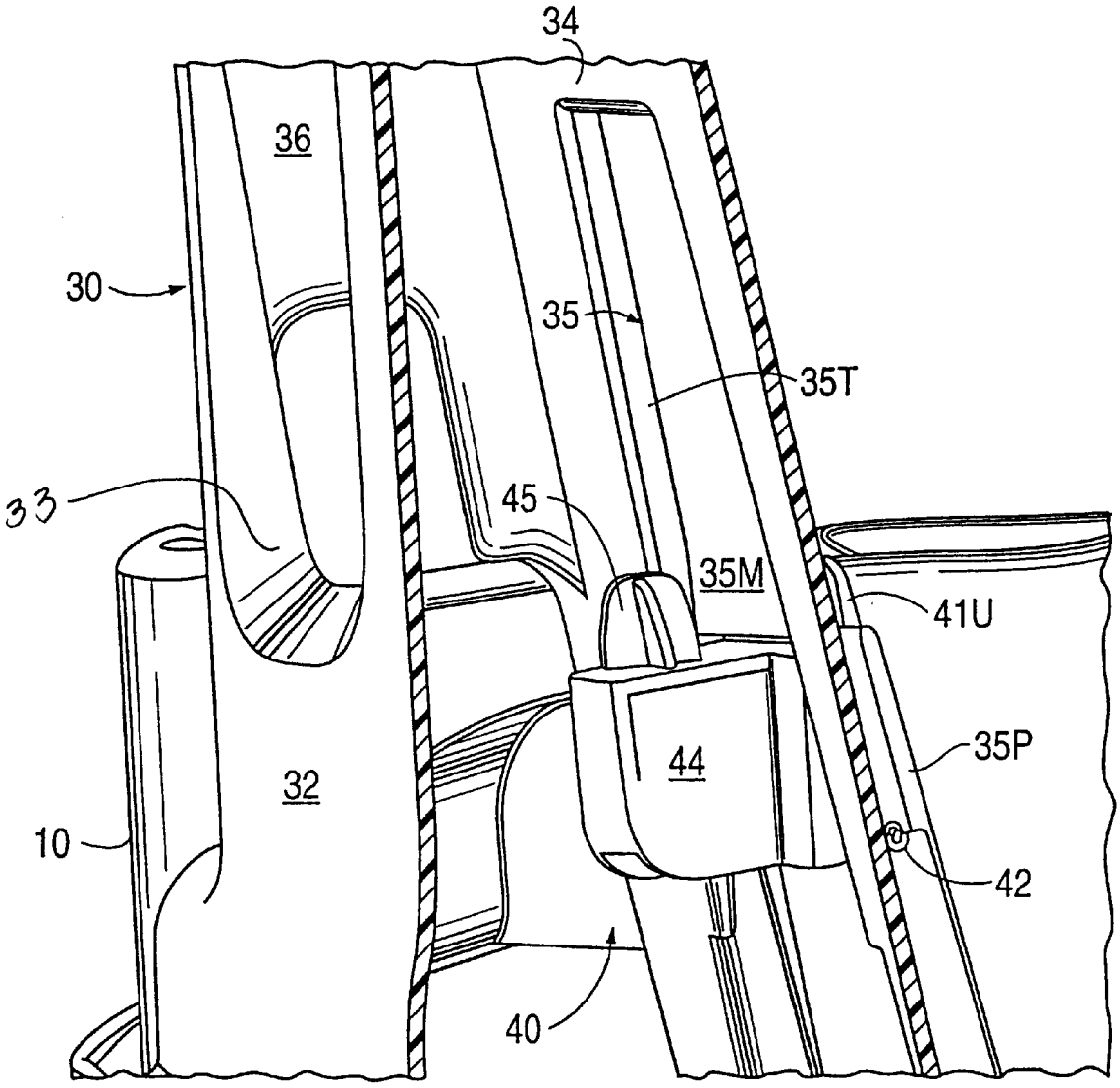
FIG. 7H is a perspective sectional view of the sleeve mounted with the spring base.

Referring to FIGS. 7G and 7H, the spring base 40 is configured to be supported on a recess 35 formed on the sleeve second side 34. The spring base 40 has a support member 41 having tapered side walls 43, forming a trapezoidal shape. The side walls 43 are complementary to the tapering side walls 35T, which form the recess 35. One side of the support member 41 is substantially planar. The planar side rests against a major surface 35M of a protruding wall 35P connecting the side walls 35T. A pair of opposing projections 42, 42 extend outwardly from the tapered side walls 43, 43. These projections 42 are received in opposing openings 37 formed on the tapering second side walls 35T. The side walls 35T protrude outwardly from the second side 34. The projections 42 extend through the openings 37 and fixedly support the spring base 40 on the sleeve 30. The projections can be snap fit into the openings 37. Alternatively, instead of the projections 42, a rod or shaft (not shown) can be inserted through the openings 37 and a corresponding hole can be formed through where the projections 42 would be located. The protruding wall 35P also has a slot 35PS extending horizontally. The slot 35PS is dimensioned to receive an upper end 41U of the support wall 41. The upper end 41U extends upwardly through the slot 35PS and prevents the spring base 40 from rotating about the projections 42. The spring base 40 can also be integrally formed with the sleeve 30.

The spring base 40 has a base 44 projecting from the opposite side of the substantially planar side 41P. The base 44 has a spring retainer 45 that extends vertically upwardly. The spring retainer 45 can be a cross or X-shaped vane, which can be tapered toward its free end, or any other suitable structure that can hold one end of a spring S.

FIGS. 7C and 7D show the slider 50 in detail. Referring to FIGS. 7 and 7A, the sleeve 30 receives the slider 50 to allow the slider 50 to slide relative to the sleeve 30. The slider 50 is supported and biased upwardly by the spring S, which can be a coil or helical spring, or other resilient device, such as a pneumatic spring, an elastomer, etc. Specifically, the slider 50 is substantially tubular and generally complementary with the sleeve's cross section so that the slider 50 can be positioned in the sleeve 30. The slider 50 has a substantially rectangular cross-section, with a first side 52, a second side 54 opposite the first side 52, and opposing third and fourth sides 56, 56 extending between the first and second sides 52, 54. The first side 52 has a substantially rectangular opening or window 53. The second side 54 has a substantially U-shaped recess 58 that accommodates the spring S (see FIGS. 7 and 7A).

The recess 58 is formed about the center of the second side 54 and extends vertically from its lower end 51. The recess 58 is defined by a pair of opposing walls 60 that are oriented substantially perpendicularly relative to the second side 54 and extend toward the first side 52. A cross wall 62, which is perpendicular to the opposing walls 60, joins the ends of the opposing walls 60. The opposing walls 60 are parallel to each other in the embodiment shown. The recess 58 opens into the lower end 51 of the slider 50. The recess 58 terminates at an end wall 64, which extends perpendicularly to the opposing walls 60 and the cross wall 62. At this end wall 64, spring retaining ribs 66 extend substantially perpendicularly therefrom and substantially parallel to the opposing walls 60. These ribs engage or abut one end of the spring S. The ribs 66 are substantially vertically aligned with the spring retainer 45 formed in the spring base 40. The spring S is confined in the recess 58, by the cross wall 62, the opposing walls 60, and the protruding wall 35P, and between the ribs 66 and the retainer 45.

Referring to FIGS. 7C, 7E, and 7F, the slider 50 has a guiding member 70 that extends from the second side 54 toward the first side 52. The guiding member 70 comprises opposing upper and lower walls 72, 73 and opposing second and third side walls 74, 74, which walls 72, 73, 74, 74 form a generally tubular member having a rectangular or square cross section. The guiding member 70 extends outwardly from both opposing surfaces of the second side 72, as seen from FIGS. 7E and 7F. The portion extending on the outer side of the second side 72 has an end wall 75. The free end of the guiding member 70 is positioned near and aligned with the window 53. Spacing is provided between the inner surface of the first side 52 and the free end of the guiding member 70, sufficient to allow passage of the leg 90. Referring to FIG. 7F, one or more strengthening ribs 76 can connect the guiding member 70 and the cross wall 62.

The third and fourth side walls 74 each have at least one elongated slot 77 that receives a part of a height adjusting button 80 (see FIGS. 7, 7A, and 7F). In the embodiment shown, each of the third and fourth side walls 74, 74 has two slots 77 (see FIGS. 7C and 7F). A spring retainer 78 extends substantially perpendicularly from the end wall 75 toward the slider first side 52. The spring retainer 78 has a cross or X-shaped vane, which can taper or narrow toward its free end. The taper helps to center one or more springs SS (schematically shown in FIG. 7E) that bias the button outwardly toward the slider first side 52.

Figure 8:
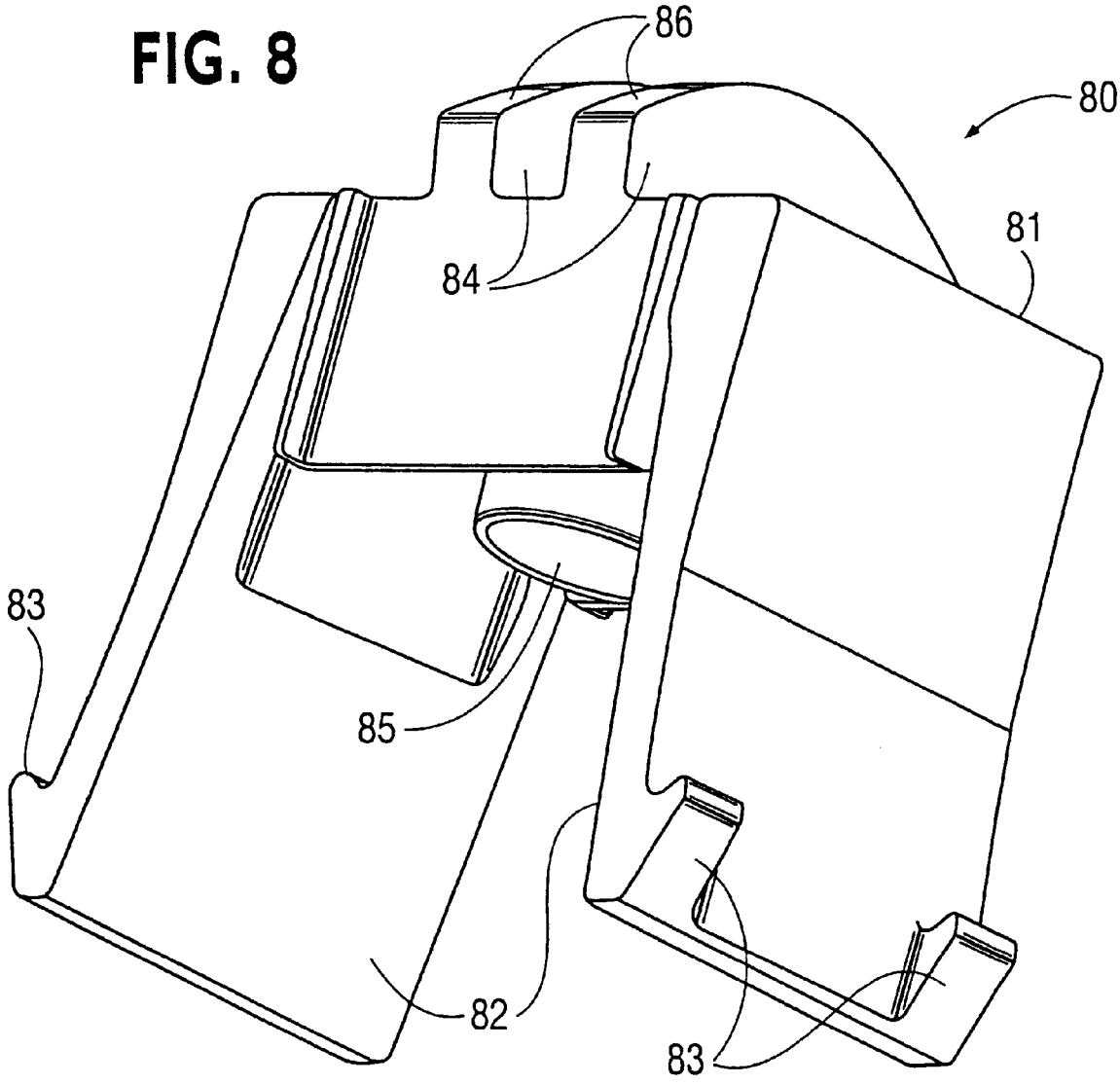
FIG. 8 is a perspective view of the height adjustment button.

Referring to FIGS. 7, 7A, 7E, 7F, and 8, the height adjusting member or button 80 is substantially U-shaped, comprising a cross member 81 joining a pair of opposing legs 82, 82. These legs 82 can flare out slightly as shown in FIG. 8. The legs 82 each have a pair of locking tabs 83 that are received in the respective slots 77, as shown in FIG. 7F. Each slot 77 receives one of the locking tabs 83 and guides the button 80 in the guiding member 70. The slots 77 limit the amount of the button movement. Referring to FIG. 7F, the distal edges (nearer the free end of the guiding member 70) of the slots 77 engage the tabs 83 and prevent the button 80 from sliding off the guiding member 70. The spring SS biases the button 80 to this position. The outward flaring of the legs 82 biases the legs 82 against the third and fourth side walls 74 and retains the tab from sliding or coming off the slots 77.

Referring to FIG. 8, at least one leg supporting projection 84 projects substantially perpendicularly from an outer surface of the cross member 81. In the embodiment shown, a pair of parallel leg supporting projections 84 are included. Each projection 84 has a curved peripheral surface 86 that can act as a cam, on which the leg 90 can slide. Referring to FIGS. 7E and 8, the cross member 81 has a spring retainer 85 extending outwardly from its inner surface, opposite the projections 84. The retainer 85 shown here is a cylindrical member that extends perpendicularly from the inner surface of the cross member 81. Any other spring retaining configuration can be used, depending on the spring used.

Referring to FIG. 7E, the spring SS is sandwiched between the two spring retainers 78 and 85. The spring SS biases the height-adjusting button 80 away from second side 54 of the slider 50 toward its first side 52 as shown in FIG. 7F. The slots 77 are dimensioned so that the projections 84 can protrude beyond the outer surface of the first side 52 of the slider 50. In this respect, the U-shaped cutout 33 in the sleeve 30 permits the slider, with the protruding projections 84, to move up and down without any interference from the sleeve.

Referring to FIGS. 7 and 7A, each leg 90 is configured to selectively slide in the respective slider 50 and lock to the slider 50 in a desired (height) position. The leg 90 has a substantially U-shaped cross section. Specifically, the leg 90 comprises elongated opposing first and second side walls 91, 91 joined by an elongated cross wall 92, a top wall 93, and a bottom wall 94. The leg 90 can also have stiffening ribs 95 and 96. The cross wall 92 slides in the gap formed between the free end of the guiding member 70 and the inner surface of the slider first side 52. The bottom wall 94 has a cutout 94*c* dimensioned to clear the guiding member 70, the walls 60, 62 forming the recess 58 in the slider 50, and the base 44 of the spring base 40 so that the leg 90 can slide relative to the slider 50 without any hindrance when adjusting the height.

The top wall 93 has an opening 93*o* with a threading or a bayonet mount for receiving a fastener F having a threading (see FIG. 1 and FIG. 9B) or a bayonet connector. The cross wall 92 has a plurality pairs of longitudinally or vertically aligned slots 97, which are dimensioned and spaced to accommodate the height adjusting projections 84. Each projection 84 extends through the respective slot 97, as shown in FIGS. 1, 7, and 7A, and supports the respective leg 90 in a fixed position relative to the slider 50. The leg height position can be adjusted relative to the base 10 by pushing the projections 84, sliding the respective leg 90 up or down and allowing the projections 84 to extend through the desired slots 97, which lock the leg 90 to the slider 50. The slots 97 can be sufficiently narrow so that it does not catch a finger or part thereof, while supporting the leg 90. Note that a single narrow projection, designed to prevent finger jamming, may not suitably support the leg 90 relative to the slider 50. Moreover, a single narrow projection is more difficult to operate (push) as it provides a less surface. A wider projection 84 to accommodate easier manipulation means a wider slot, which can catch a finger or part thereof.

Because each slider 50 is spring loaded, i.e., suspended relative to the sleeve 30 using at least one spring S, the tray assembly 7, which is attached to the legs 90, is supported under a spring suspension. This allows a child seated in the seat to bounce. The legs 90 also can be locked to a spring lockout position, where the springs S become deactivated. Specifically, when the projections 84 engage the uppermost slot 97*u*, the top wall 93 is substantially flush with or slightly below the upper end of the sleeve 30, as shown in FIG. 2, so that the tray assembly 7 engages the upper end of the sleeve 30. This position locks out or deactivates the spring suspension since the tray assembly 7 is supported directly on the sleeve 30. This lockout position is also the lowest position to which the legs 90 can be adjusted. Because the legs 90 are at their lowest position and the spring S can no longer operate, this position provides a stable play surface (tray) at a safe and convenient level for a toddler seated on the base, as well as a toddler playing outside the activity center 1.

The tray assembly 7 comprises a generally annular shaped tray 100 that is movable between an opened position and a closed position. In the embodiment shown, the tray 100 comprises a right-side tray 110 (FIG. 3) and a left-side tray 140 (FIG. 4). The ends of these trays 110 and 140 are connected so that the trays are pivotally movable. Specifically, referring to FIGS. 3 and 3A, one end of the right-side tray 110 has a hub 120 and the other end of it has a locking joint 130. Referring to FIGS. 4 and 4A, the left-side tray 140 is similar in shape (substantially semi-circular) as the right-side tray 100 so that the right and left-side trays 110, 140 together can form an annular tray configuration. The left-side tray 140 has a complementary hub 150 and a complementary locking joint 160. In the embodiment shown, the left-side hub 150 is stacked or aligned over the right-side pivot hub 120. The right and left side joints 130, 160 have a dovetail locking configuration. Each of the left and right-side trays also has a pair of spaced openings E, O for passage of a threaded portion of the fastener F and for accepting the same. One opening O is for fastening to the respective leg 90 in the opened position and the other opening E is for fastening to the leg 90 in the closed position.

Figure 3:
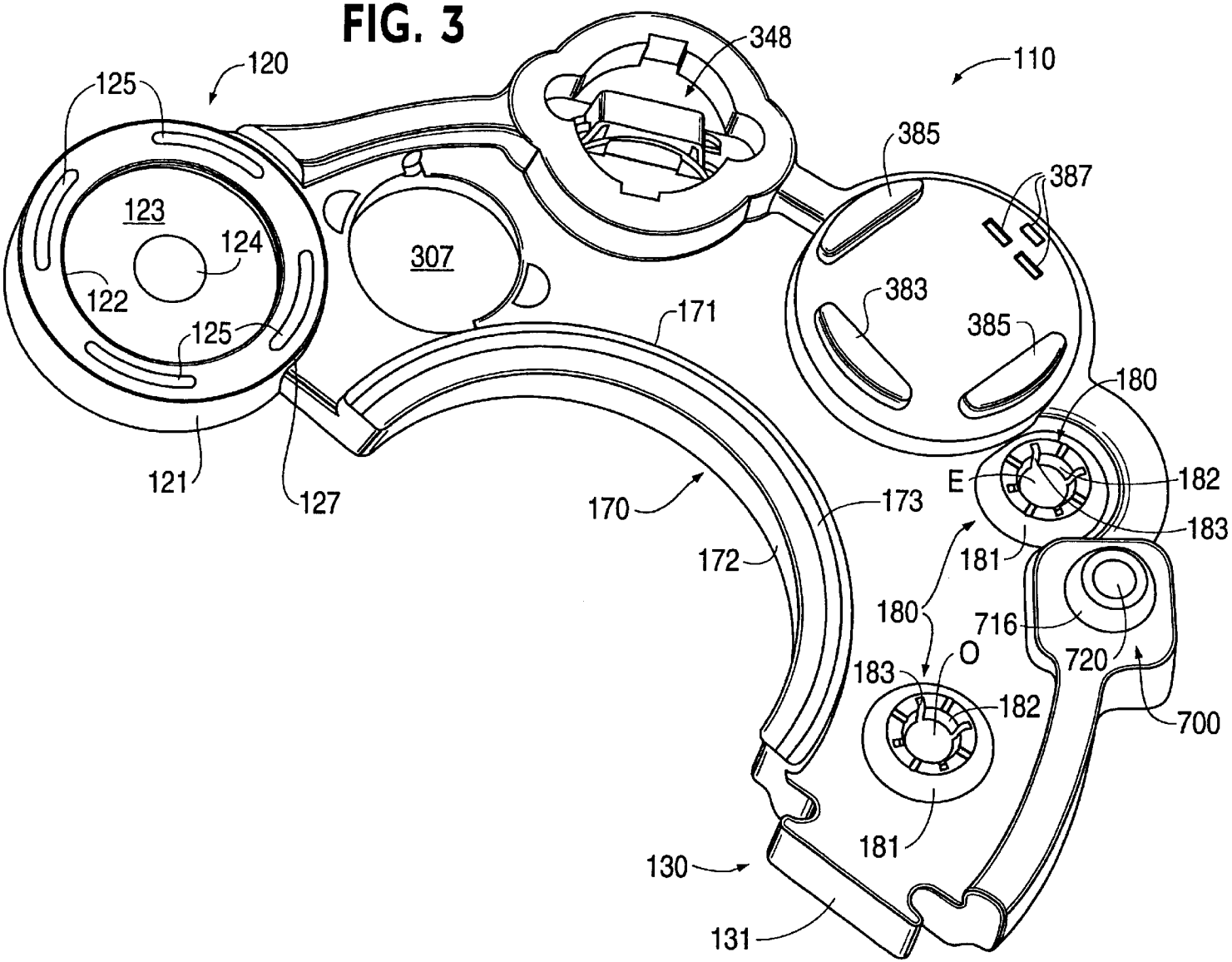
FIG. 3 is a top perspective view of a right-side tray of the tray assembly.
Figure 3A:
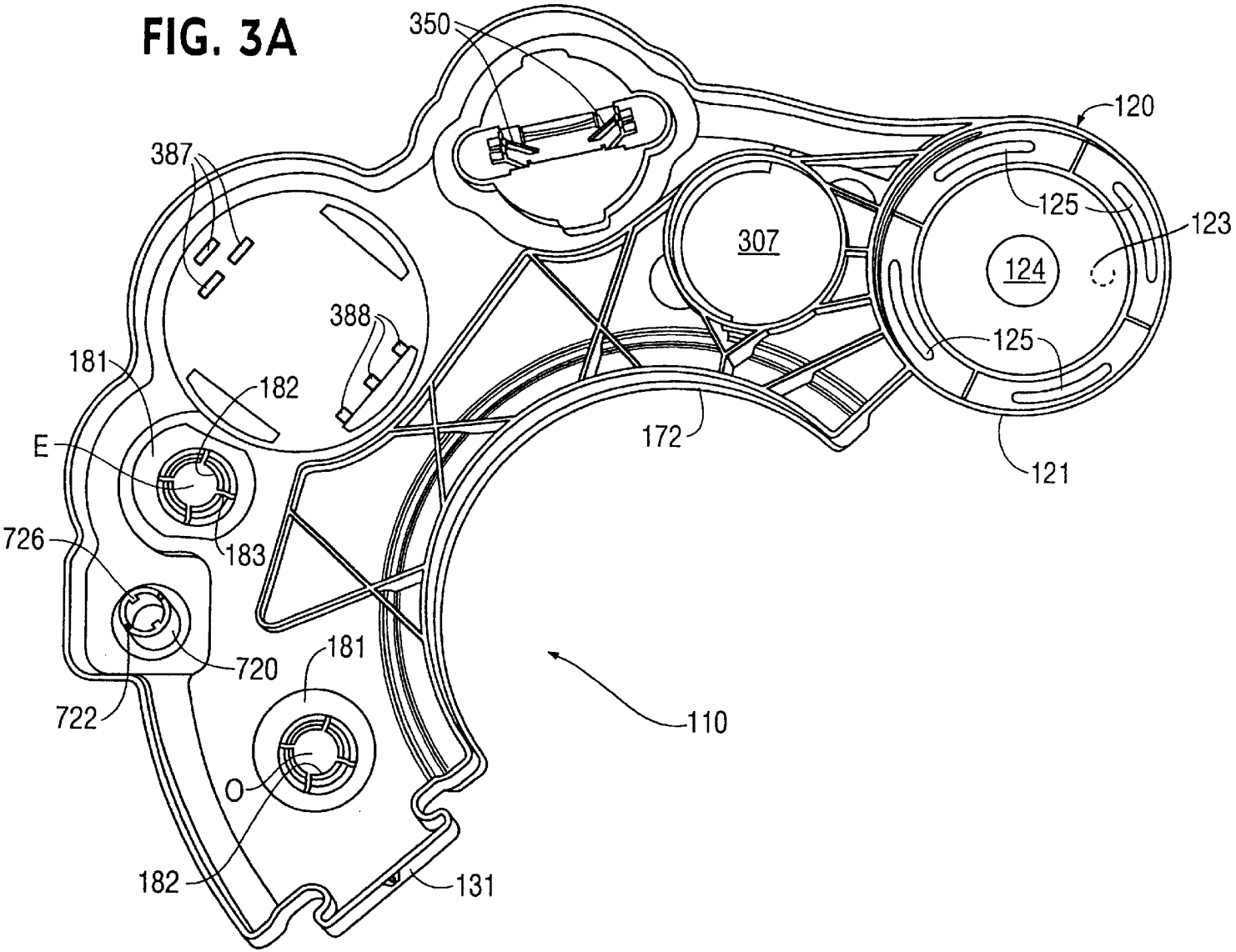
FIG. 3A is a bottom perspective view of the right-side tray.
Figure 4:
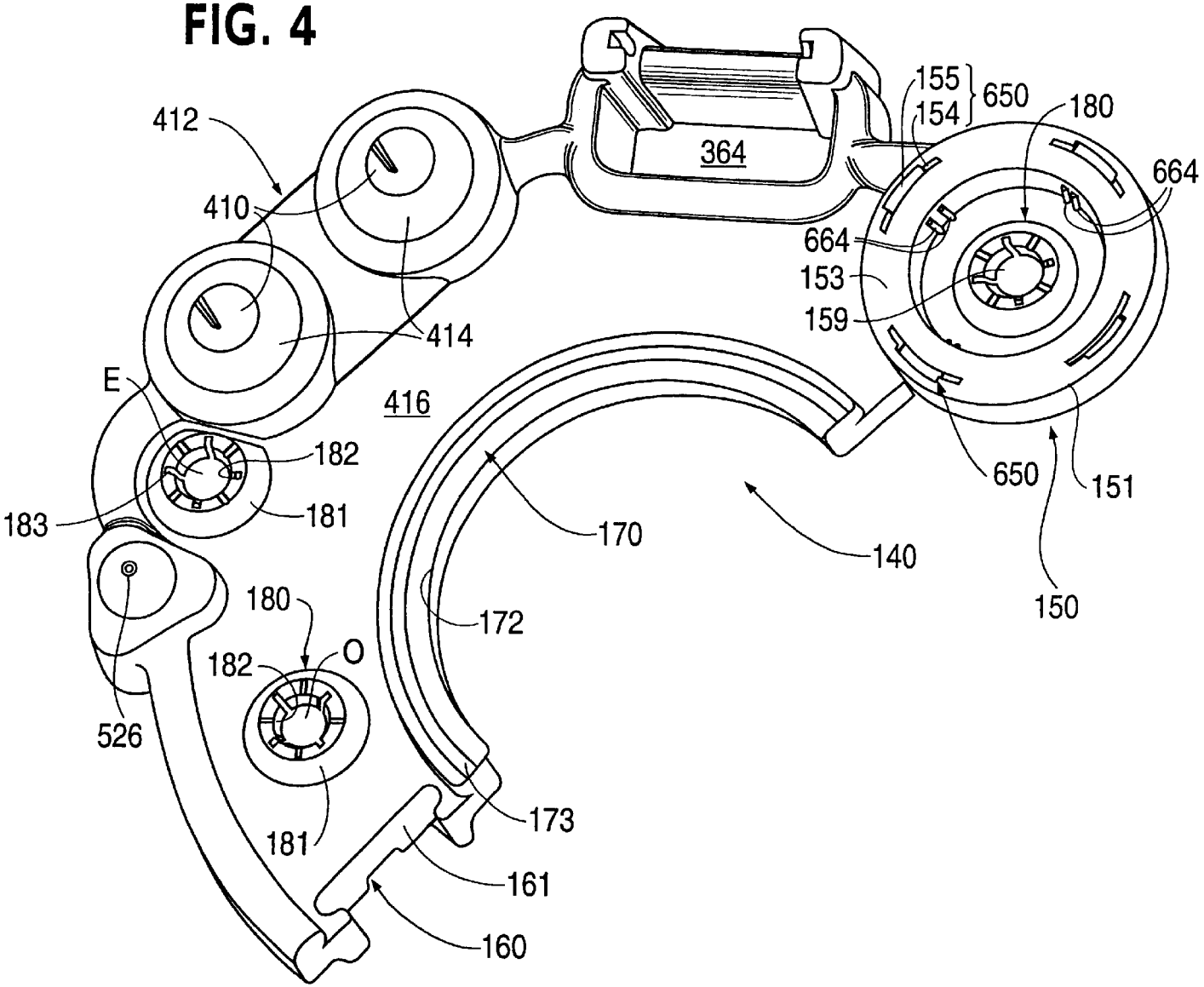
FIG. 4 is a top perspective view of a left-side tray of the tray assembly.
Figure 4A:
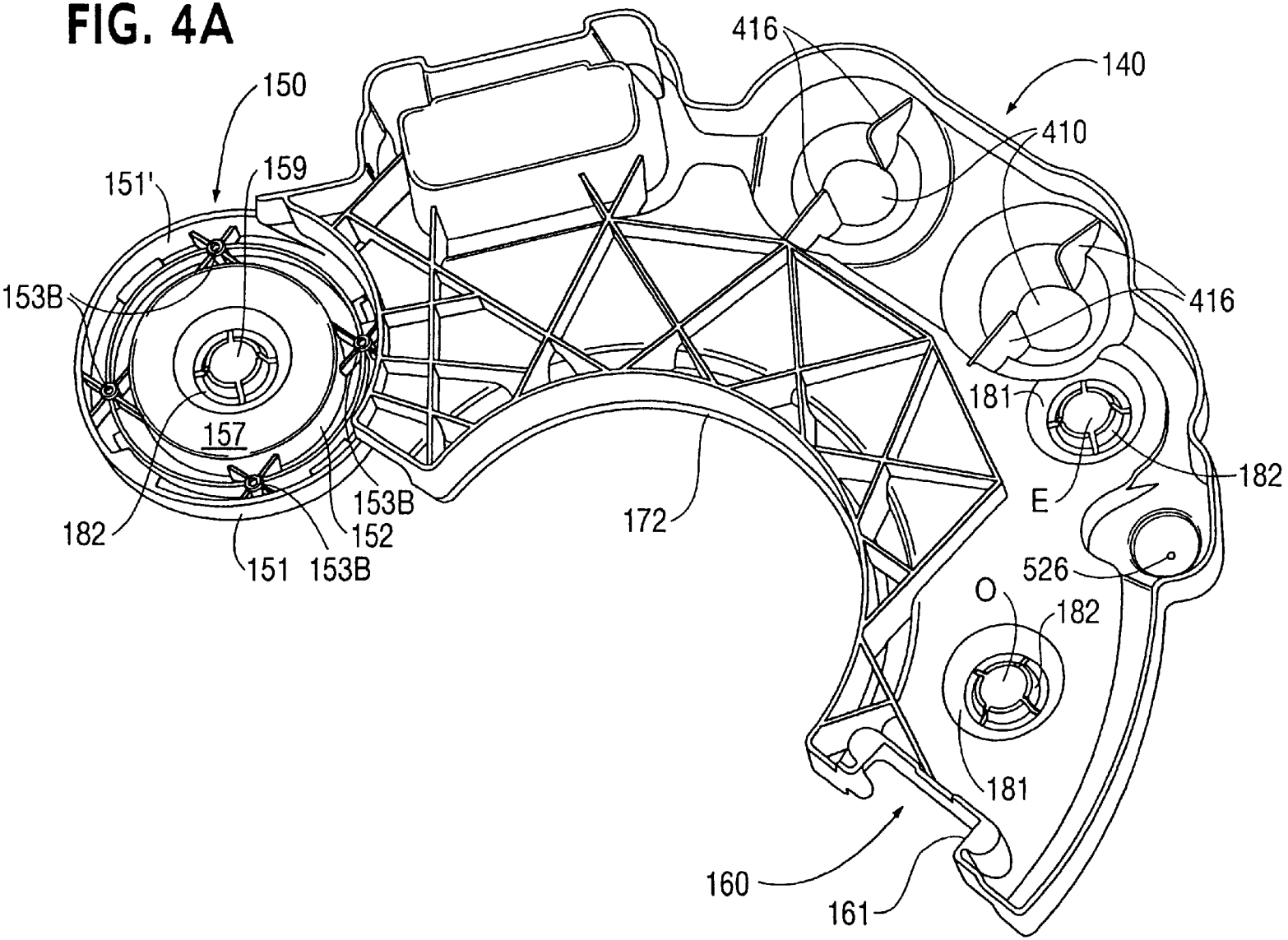
FIG. 4A is a bottom perspective view of the left-side tray.

Referring to FIGS. 3 and 3A, the right-side hub 120 comprises a substantially cylindrical member 121 at one end of the right-side tray 110 and a cap portion 122 covering a top end of the cylindrical member 121. The cap portion 121 has a recessed annular bearing surface 123 with a central opening 124. A plurality of slots 125 (four shown) are formed around the periphery of the cap. These slots 125 are equally spaced apart circumferentially. The right side locking joint 130 comprises one of a wedge-shaped portion 131, e.g., a tenon, and a complementary cutout 161, e.g., a mortise. Although the right-side locking joint 130 is shown with the tenon 131, any side can have the tenon 131 and the other side the mortise 161.

Referring to FIGS. 4 and 4A, the left-side hub 150 comprises an outer cylindrical member 151 and an inner cylindrical member 152. An annular portion 153 joins the upper ends of the inner and outer cylindrical member 151, 152, and holds them concentrically together. The annular portion 153 also has a plurality of equally spaced slots 154 (four shown). These slots 154, however, each have an adjoining shorter slot 155 extending from its outer peripheral side to form a generally T-shaped slot 650. The slots 650 are adapted as part of a toy mount 601 for attaching a toy described below. A cap portion 156 closes the lower end of the inner cylindrical member 152. The lower surface of the cap portion 156 forms a bearing surface 157 that can en gage the bearing surface 123 of the right-side hub 120. The cap portion 156 has a raised portion 180 having an opening 159 adapted for passage of the threading portion T of the fastener F (see FIG. 1B). Referring to FIG. 4A, the bearing surface 157 is annular, conforming to the annular shape of the bearing surface 123. In the embodiment shown, the left-side locking joint 160 has the mortise 161.

Referring to FIG. 4A, a plurality of screw bosses 153B (four shown) extend downwardly from the annular portion 153. These bosses 153B are alignable with the slots 125 formed in the right side tray 110. The left and right trays 140, 110 can be held together by screws, which can be steel screws, so that the trays can rotate relative to each other. The degree of rotation relative rotational displacement is determined by the arc length of the slot 125.

To convert the activity center 1 for toddler use, the house toy 600 is removed from the tray assembly 7. The fasteners F connecting the hubs 120, 150 and the right and left side trays 110, 140 to the legs 90 are unscrewed to disconnect from the tray assembly 7. The mortise and tenon 161, 131 are disconnected to open the tray assembly, i.e., by pivoting the trays. When the tray assembly is removed from legs 90, it provides sufficient play or flexibility to allow the mortise and tenon 161, 131 to move vertically away from each other. The legs 90 then can be locked in the lowest position. The fasteners F are fastened through the openings O in the left and right side trays and the aligned opening 124, 159 in the connecting hubs 120, 150. This will bring the underside of the tray to bear against the sleeves 30.

The right and left-side trays 110, 140 each have a similar raised portion 180 surrounding each opening E and O. Each raised portion 180 has a tapered or conical outer portion 181 and inner portion 182, which joins the outer portion 181. The inner portion 182 can be tapered or conical and has a plurality of slits 183 (four shown) that allow the inner portion 182 to expand so that a larger object can pass through, such as a fastener F.

Figure 1B:
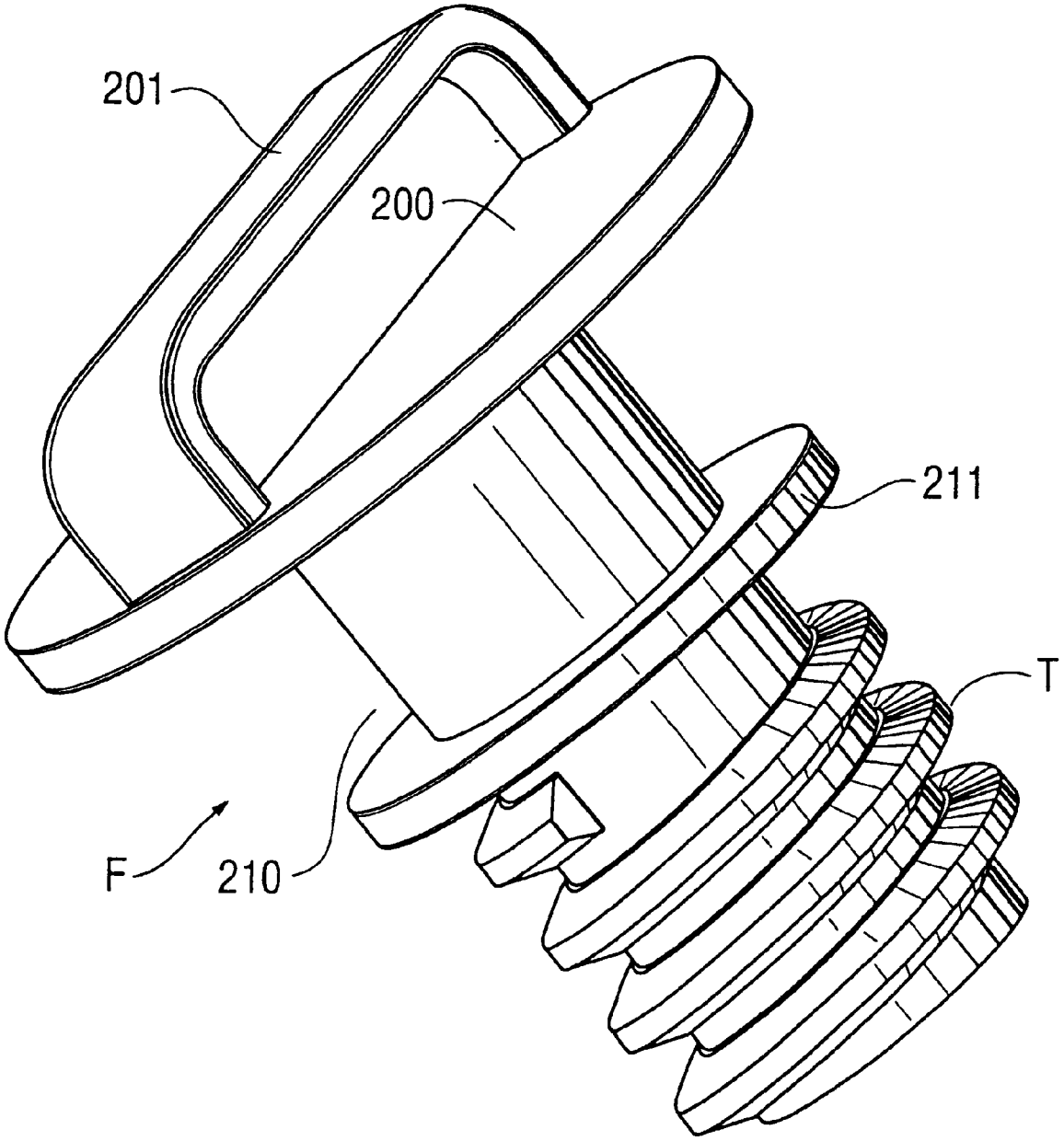
FIG. 1B is a detailed perspective view of a fastener that can be used to connect the tray assembly.
Figure 2A:
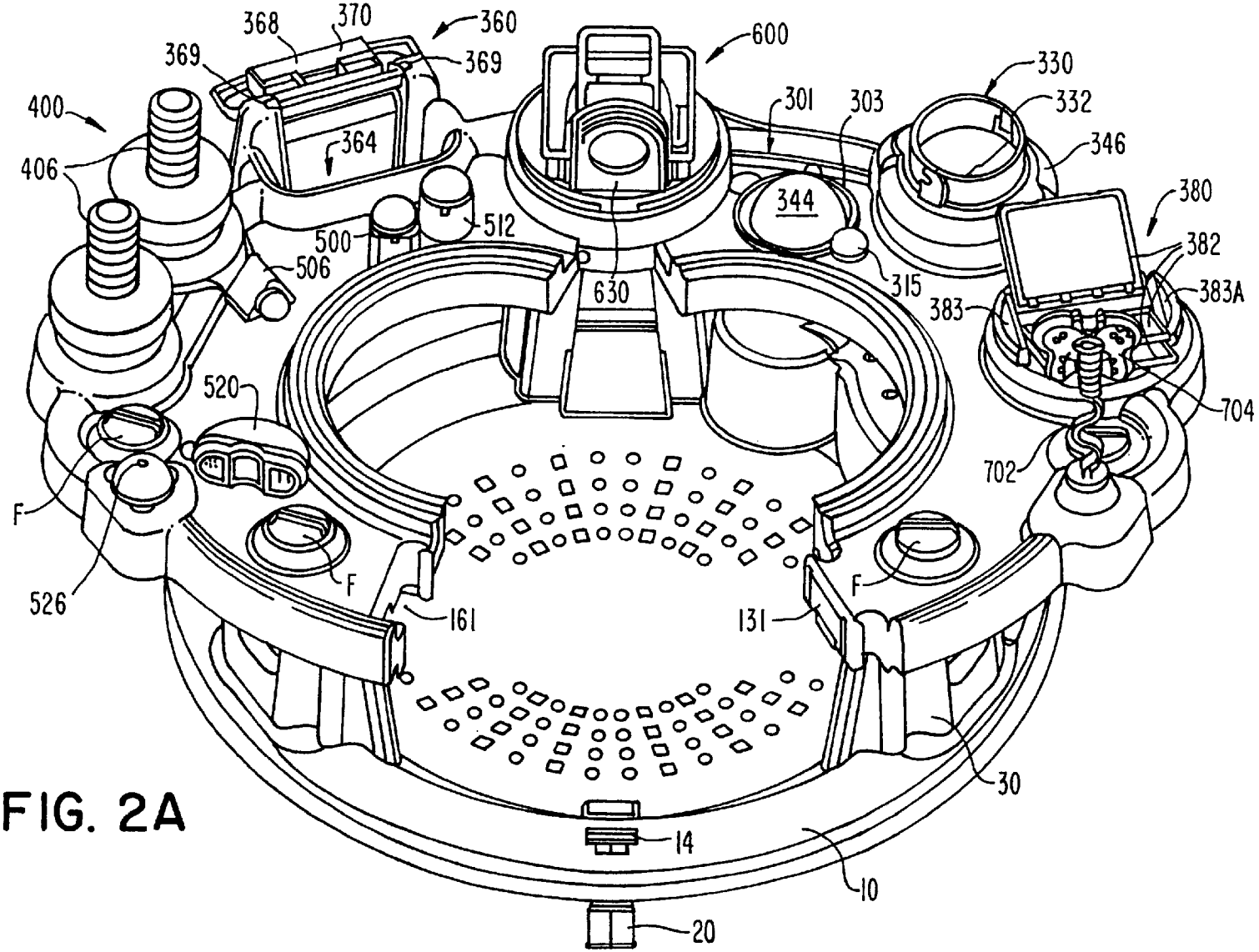
FIG. 2A is similar to FIG. 2, with the tray assembly locked in the opened position to the legs extending from the base.

Referring to FIG. 1B, the fastener F comprises a disk-shaped head 200 having a handle 201 that extends orthogonally outwardly from one side thereof and a threaded shaft 210 extending orthogonally outwardly from the opposite side. The threading T on the shaft can be any conventional type, including a bayonet type connector. Preferably, the threading is a quick release type, such as an acme or worm thread. A shaft 210 has a stop flange 211 adjacent the end of the threading. The stop flange 211 is set at a predetermined spacing from the head 200. This spacing is preferably slightly larger than the height of the inner portion 182. Each opening 159, E, and O, at the terminal end of the inner portion 182, can be smaller than the stop flange diameter. The slits 183 allow the inner portion 182 to expand when the flange 211 is inserted therethrough. The inner portion 182 contracts to its normal dimension, where the stop flange 211, which has a larger diameter, abuts against the smaller terminal end of the conical inner portion 182 to retain the fastener F in place. The head 200 is dimensioned to fit flush in the conical inner portion as shown in FIG. 2A. The opening 124 in the right-side hub is dimensioned larger than the flange 211 so that the flange 211 can extend through the bearing surface 123 and directly engage the leg 90. This enables the bearing surfaces 123, 157 to contact each other. The fasteners F are preferably made of any suitable plastic material.

The right and left trays 110, 140 each have a semi-circular seat mounting rail 170 extending uprightly therefrom as shown in FIGS. 3 and 4. Each rail 170 has an outer lip 171 formed at its upper outer periphery and an inner lip 172 formed at its upper inner periphery. These lips 171, 172 extend generally in the radial direction. When the trays 110, 140 are in the closed position, the two semicircular seat mounting rails 170 form a circle configuration to allow the seat to rotate relative to the tray assembly.

Figure 9:
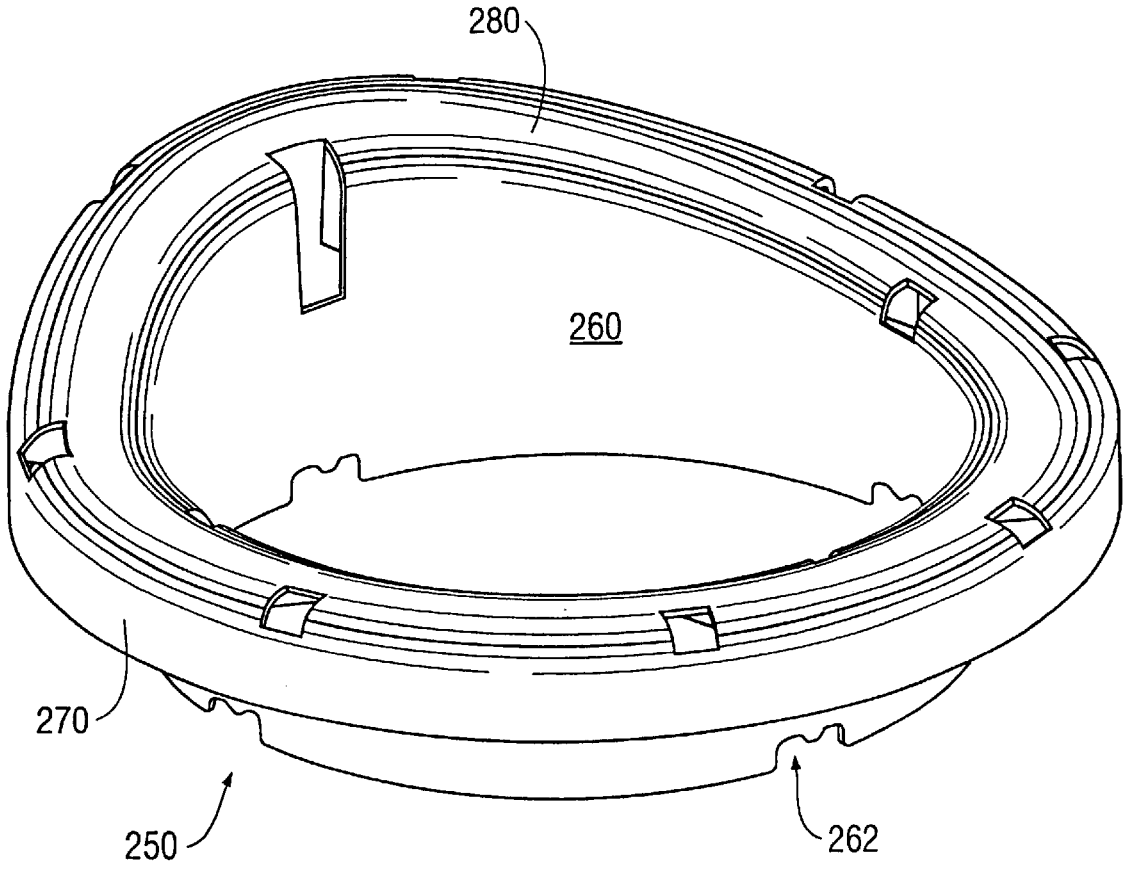
FIGS. 9 and 9A are top and bottom perspective views of a seat ring.
Figure 9A:
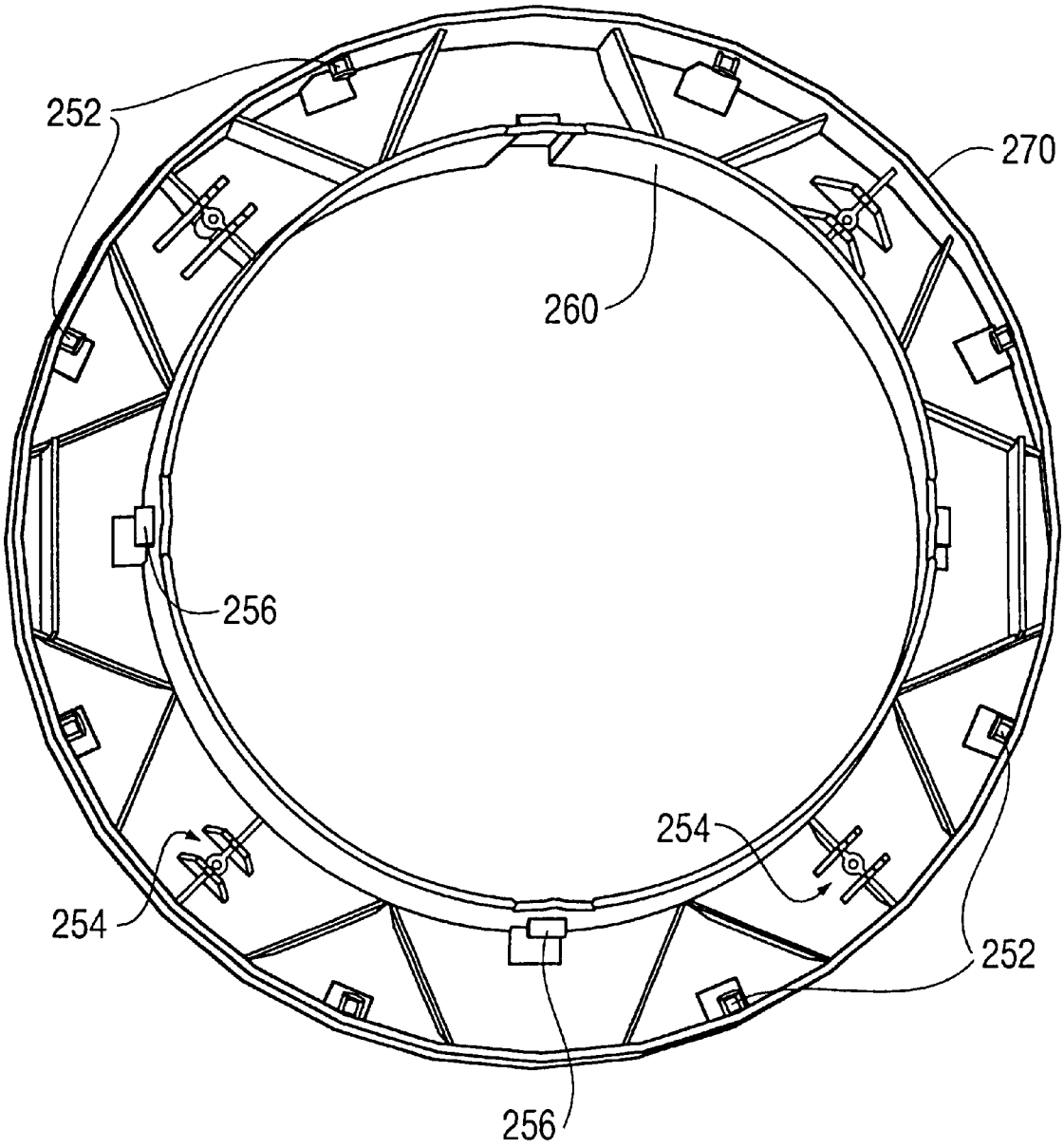

Referring to FIGS. 9 and 9A, the seat assembly 9 comprises a seat ring 250 and a cloth sling (not shown) attached to the seat ring in a conventional manner. The cloth sling can include a back support. The cloth sling is preferably made of a soft, cushioned material and includes two leg holes to allow the infant's legs to pass through and reach the upper surface 11 of the base 10. The seat ring 250 has a plurality of hooks 252 on the underside of the seat ring 250 to which the cloth sling can be attached. The underside of the seat ring 250 can have bearing mounts 254, which can mount a bearing ring assembly (not shown). The bearing ring assembly can have bearings or rollers that engage a groove 173 formed on the upper surface of the seat mounting rails 170.

Figure 9B:
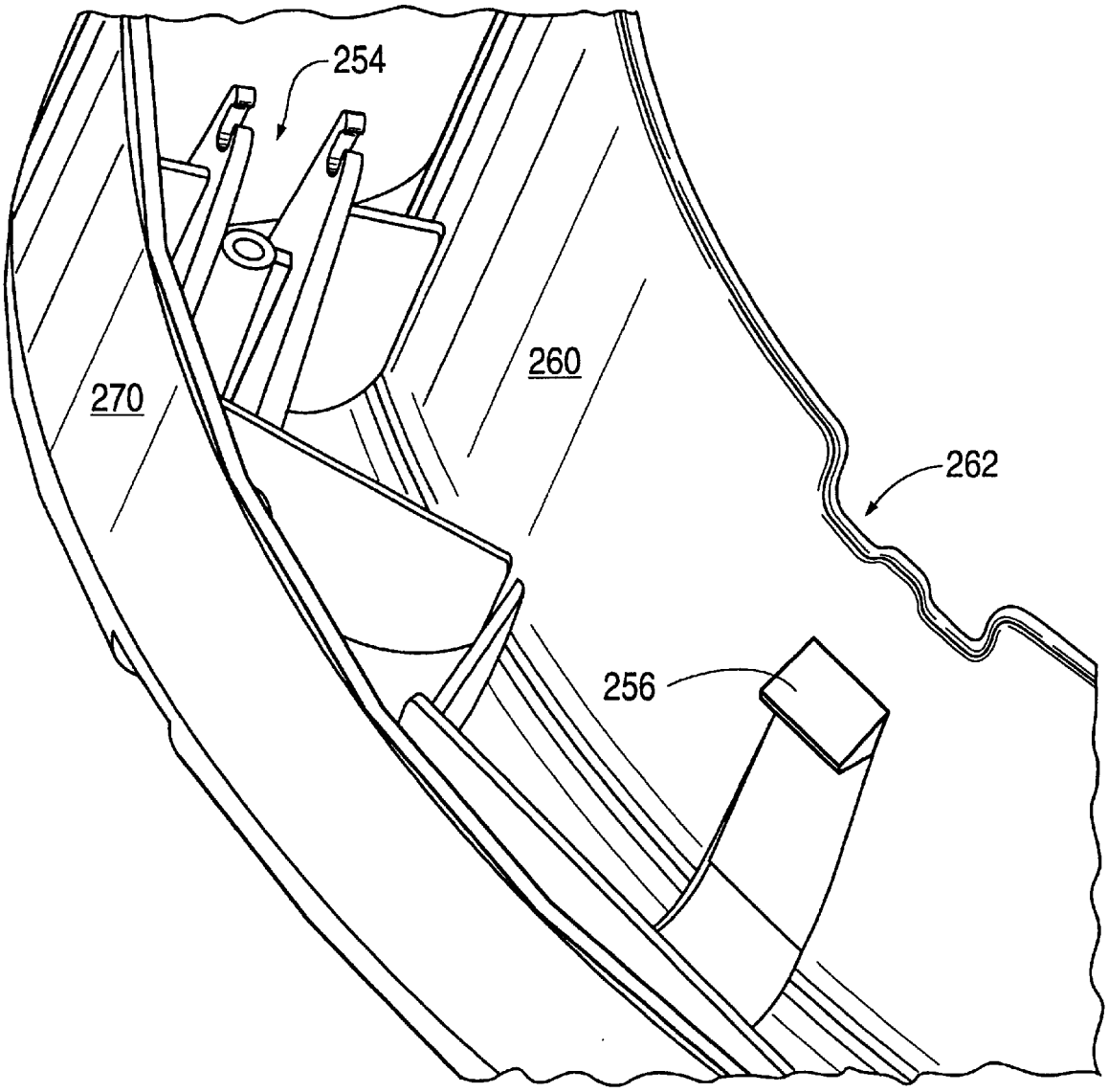
FIG. 9B is a detailed view of a seat ring mount.

The seat ring 250 further has a plurality of tabs 256 (four shown) that releasably secure the seat ring 250 to the rails 170. The tabs 256 engage the inner lip 172 to securely retain the seat assembly 9 to the tray assembly 7. Specifically, the seat ring 250 comprises a substantially cylindrical inner wall 260 substantially concentric with a substantially cylindrical outer wall 270. An annular cap portion 280 connects these cylindrical walls 260 and 270 at their upper ends. The back side of the seat ring can be made taller for back support. Referring to FIG. 9B, the tabs 256 are formed on the outer surface of the cylindrical inner wall 260. The seat assembly 9 is attached to the tray assembly 7 by pushing the ring member 250 onto the rail. The cammed surface on the each tab 256 allows insertion. The seat ring 250 is removed from the rail 170 by pulling each tab 256 off the inner lip 172, one at a time, while lifting the seat assembly 9. To accommodate easier removal, the cylindrical inner wall 260 can have finger grooves 262 formed below each tab 256, as better illustrated in FIG. 9B.

In operation, FIG. 1A shows the tray in the closed position (infant use). Referring to FIGS. 2, 3, 4, and 4A, to assemble the tray assembly 7, the left-side hub 150 is aligned above the right-side hub 120 and connected together using screws or fasteners as described before. The inner surface 151' of the outer cylindrical member 151 is dimensioned so that it fits snuggly over the protruding outer upper surface 127 of the right-side cylindrical member 121, with the openings 124, 159 aligned. If the tray assembly is to be converted to a closed position, the tenon 131 and the mortise 161 are locked together by lowering the mortise 161 onto the tenon 131. The tray assembly 7 can then be attached to the legs 90 by inserting one fastener F through the aligned openings 124, 159, 93*o*, and rotating the fastener F by hand in the tightening direction. The right and left-side trays 110, 140 are respectively fastened to the other two legs 90 by extending a fastener F through each opening E and the opening 93*o* formed in the respective leg 90 and tightening the fasteners F. The seat assembly 9 is then attached to the tray assembly 7. In this position, an infant can be seated with his or her legs extending to the upper side 11 of the base 10. The legs 90 can be adjusted to accommodate height of the tray assembly 7 and thus the seat height. In this position, the stand can be in the rock-enabling position or in the rocking-disabling position to prevent rocking.

To convert to the opened position (toddler use) from the closed position, the tray assembly 7 is removed by loosening the three fasteners F. The legs 90 are then locked to their lowest setting. The mortise 161 and the tenon 131 are unlocked. Once these joints 130, 160 are disconnected, the right and left-side trays 110, 140 can pivot away from each other to the opened position. Using the openings O, the right and left-side trays 110, 140 are fastened to the respective legs 90, while the hubs 120 and 150 are connected to the third leg, using the fasteners F.

Toys that are developmentally appropriate for an infant may not be appropriate for an older infant or toddler. The same toys that can amuse and stimulate an eight-month-old infant will not be as interesting for an eighteen-month-old toddler. Toys for an infant should be securely attached to the tray to prevent the infant from throwing them on the floor. With more developed motor skills, a toddler needs toys with separate parts that can be moved, such as pushed through holes, stacked on posts, placed into compartments, etc. Older toddlers enjoy toys that can be used for acting out roles. Two complete sets of toys, one for infant and one for toddler, would be expensive and leave the consumer with parts that must be stored and that can get lost.

The present entertainment system can include the above described activity center 1 with toys that can be converted by the parent from infant toys to toddler toys, without either adding or removing parts. The converted toys are adapted to present the toddler with more age-appropriate activities. These toys can have moving parts that are attached to the tray in the infant position, but can be separated from the tray for toddler use. These toys include, for example, a ball drop toy 301, a tumbler/container holder 330, a musical instrument/pocket with lid 360, a toy book 380, a convertible ring loop/stackable ring toy 400, a plurality of geometric toys 500, 506, 512, a play phone 520, a toy shape sorter house 600, and a teether/toy wand 702.

Figure 3B:
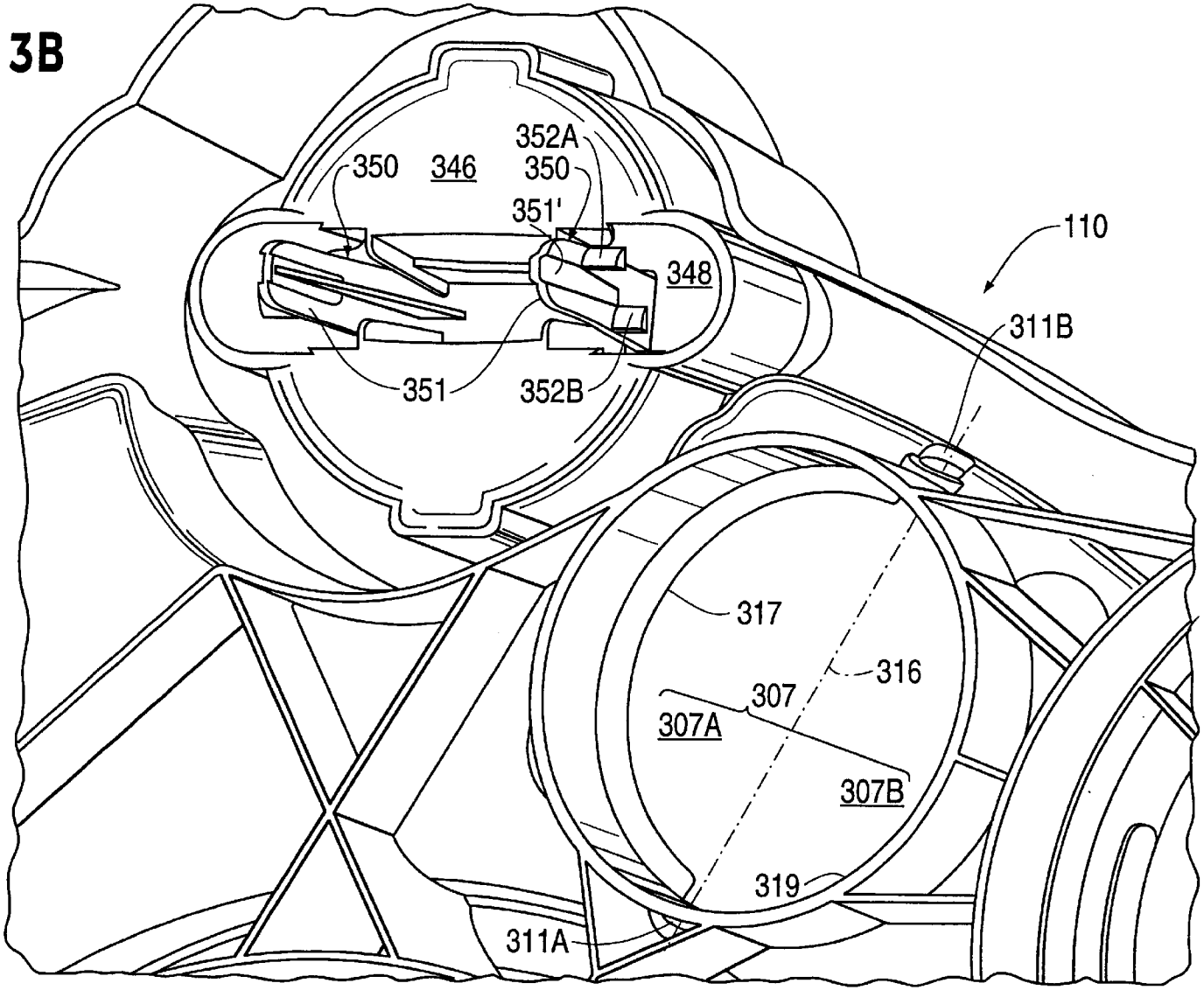
FIG. 3B is an enlarged detailed view of FIG. 3A, illustrating toy mounts.
Figure 3C:
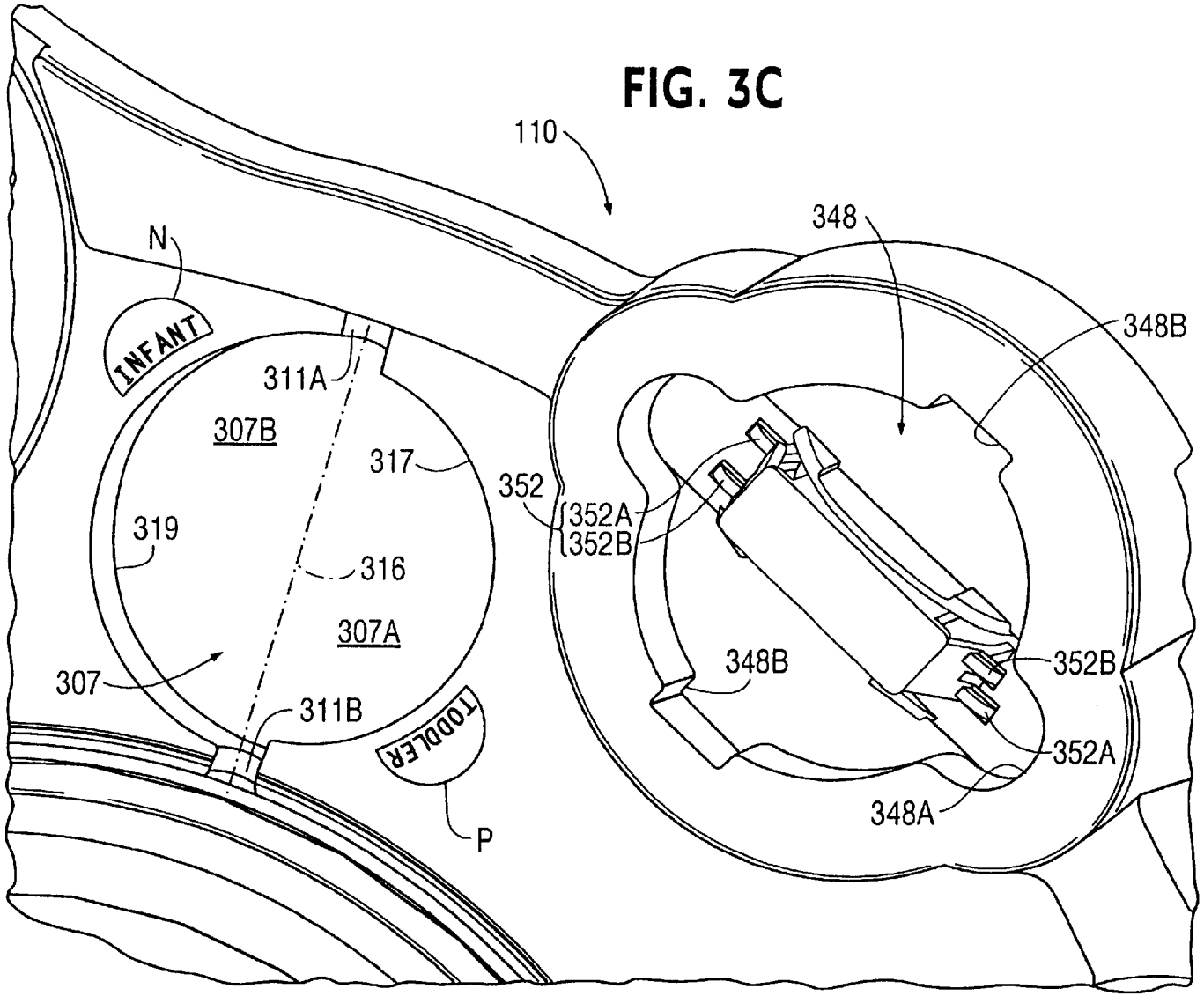
FIG. 3C is an enlarged detailed view of FIG. 3, illustrating the toy mounts shown in FIG. 3B from the other side.
Figure 15:
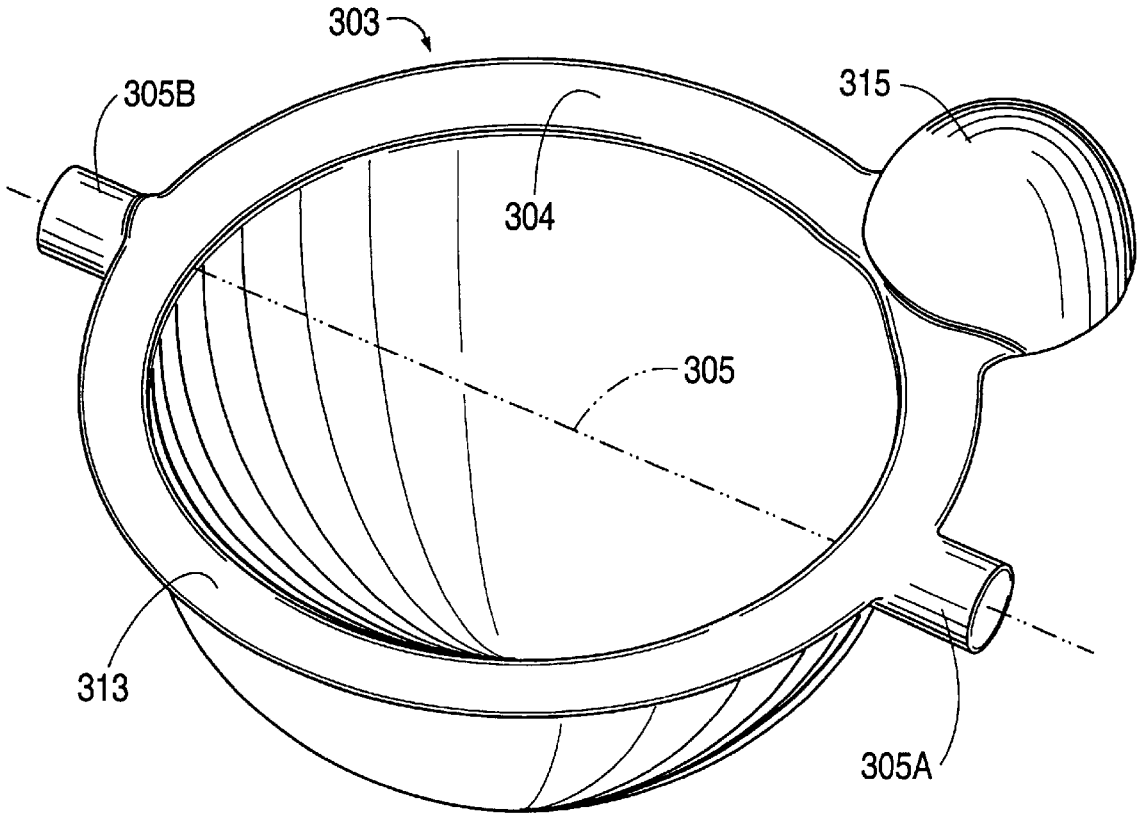
FIG. 15 is a perspective view of a ball drop/snack holder.

FIGS. 1, 1A, 2, 2A, and 15 illustrate the ball drop toy 301 in the ball drop configuration. This ball drop toy 301 can be converted between the ball drop configuration and a snack cup configuration. Referring to FIG. 15, the toy 301 comprises a receptacle 303 having a pivot axis 305 defined by collinearly aligned pivot pins 305A and 305B extending diametrically opposite from the periphery or rim 304 of the receptacle 303. The receptacle 303 can have, as shown, a generally hemispherical shape with a circular rim 304. Referring to FIGS. 3B and 3C, the receptacle 303 is seated in an aperture 307 formed in the tray 110. The aperture 307 can be defined anywhere suitable in the tray assembly 7. The pivot pins 305A and 305B are pivotally supported in diametrically opposing pivot holes 311A and 311B formed adjacent the aperture periphery.

The size of the holes 311A and 311B with respect to the pivot pins 305A and 305B, and the relative positioning of the holes 311A and 311B, enable the receptacle 303 to be releasably retained in the aperture 307. The pivot pins 305A, 305B and the respective holes 311A, 311B can be configured to snap fit so that the toy 301 can be readily removed from the tray. For example, at least one of the receptacle 303 and the tray assembly 7 can be elastically deformed slightly to allow the pivot pins 305A, 305B to be axially separated from the holes 311A, 311B and detach the receptacle 303 from the tray 110.

Due to the symmetry of the rim shape (circular), on either side of the pivot axis 305, the receptacle 303 maybe reversibly attached to the tray 110. Referring to FIG. 3C, if the pivot pins 305A and 305B respectively occupy the holes 311A, 311B, the receptacle 303 can be detached from the tray 110, reoriented, and reattached to the tray 110 with the pivot pins 305A and 305B occupying the holes 311B, 311A, respectively.

Referring to FIG. 15, the receptacle 303 can include a projection 315, such as a handle 315, that projects outwardly from the rim 304. Another projection, such as a lip 313, extends radially from the rim 304 and substantially encircles the receptacle rim 304. The handle 315, however, projects outwardly beyond the lip 313. Referring to FIG. 3B, the aperture 307 is substantially circular, defined by two semicircular sections 307A and 307B. As better shown in FIG. 3C, one semicircle section 307A is relatively smaller than the other semicircular section 307B. The smaller section 307A is sized and shaped to clear the outer surface of the hemispherical shaped receptacle 303, but not the lip 313. The relatively larger section 307B, however, is sized and shaped to clear the lip 313. An imaginary medial line 316, i.e., across the approximate middle of the aperture 307, divides the perimeter of the aperture 307 into two diametrically opposing portions 317 and 319, which lie on opposite sides of the pivot pins 305A and 305B. The sizes and shapes of the perimeter portions 317, 319 relative to the lip 313 and the handle 315, and the relative orientation of the receptacle 303 with respect to the aperture 307, determine whether the receptacle 303 is in a stationary configuration or a pivotal configuration.

Referring to FIGS. 3C and 15, the toy 301 is non-pivotally (stationarily) mounted to the tray 110 when the pivot pins 305A and 305B are respectively inserted in the holes 311A and 311B (so that the handle 315 lies over a recessed portion N). In this stationary configuration, the lip 313 overlaps the first perimeter portion 317 and prevents the receptacle 303 from rotating in one direction. The handle 315 overlaps the second perimeter portion 319 so that the handle prevents the receptacle 303 from rotating in the opposite direction. Thus, the lip 313 and the handle 315 prevent the receptacle 303 from pivoting about the tray 110 when it is mounted in this configuration.

The toy 301 is pivotally mounted to the tray 110 when the pivot pins 305A and 305B are respectively inserted in the holes 311B and 311A (so that the handle 315 lies over a recessed portion P, which lies diametrically opposite the recessed portion N). In the pivoting configuration, the lip 313 and the handle 315 both overlap the first perimeter portion 317 to prevent the receptacle 303 from rotating in the one direction. The second perimeter portion 319, however, being larger than the lip 313, allows the lip 313 to clear and enable the receptacle 303 to rotate.

The stationary configuration of the receptacle 303 provides a bowl that may be used to hold snacks for an infant. In the pivoting configuration, the receptacle 303 may be used to pass or drop a ball 344 (see FIGS. 1 and 2A) or other objects through the tray 110. When pivoting the receptacle 303 from the first pivot position to the second pivot position, the receptacle 303 is generally inverted, revealing the aperture 307 to the ball or other object. Under the influence of gravity, the ball or other object passes through the aperture 307 from the upper side of the tray 110 to its lower side. Of course, the ball or object must be sized and shaped to pass through the aperture 307 while pivoting the receptacle.

Referring to FIGS. 2A and 5, after passing through the aperture 307, the ball or other object may be received on a ball track 321 fixed to or formed on the base 10 of the activity center 1. The ball track 321 captures and guides the ball 344 or other object to the base 10 so that a toddler sitting on the base 10 can receive the ball. Specifically, ball track 321 guides the ball along a prescribed path, from a ball capturing or receiving portion 323, which is positioned underneath the aperture 307, to a ball release portion 325 of the ball track 321. The ball receiving portion 323 is at a relatively greater elevation than the ball release portion 325. Thus, gravity moves the ball or other object along the ball track 321. At the ball release portion 325, the ball track 321 can include a ramp 326, allowing the ball or other object to continue its motion onto the base 10. Alternatively, the ball release portion 325 can include a stop (not shown) for limiting the motion of the ball or other object to prevent the same from rolling or falling onto a central portion of the base upper side 11.

Figure 16:
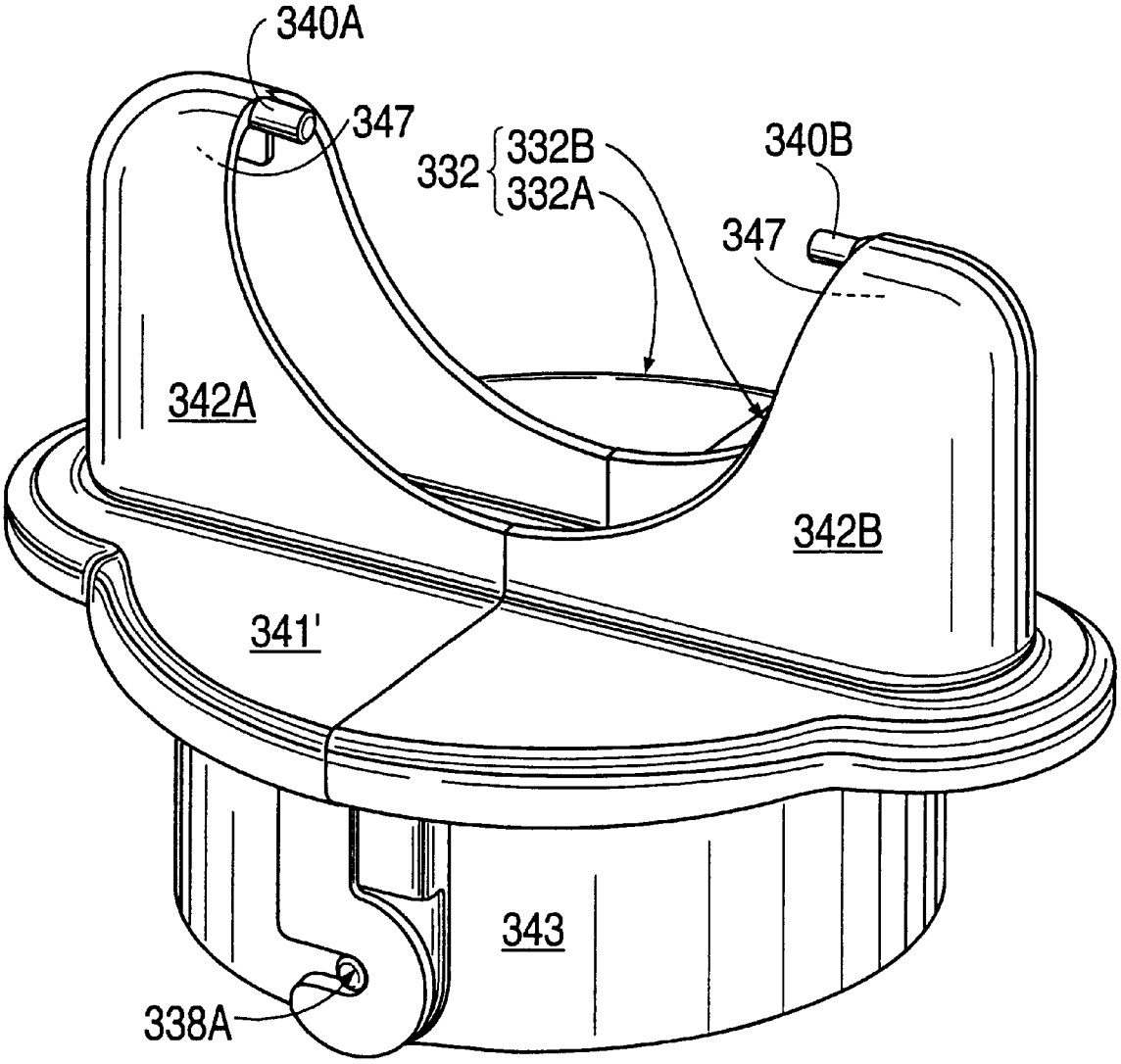
FIG. 16 is a perspective view of a tumbler/container holder.
Figure 16A:
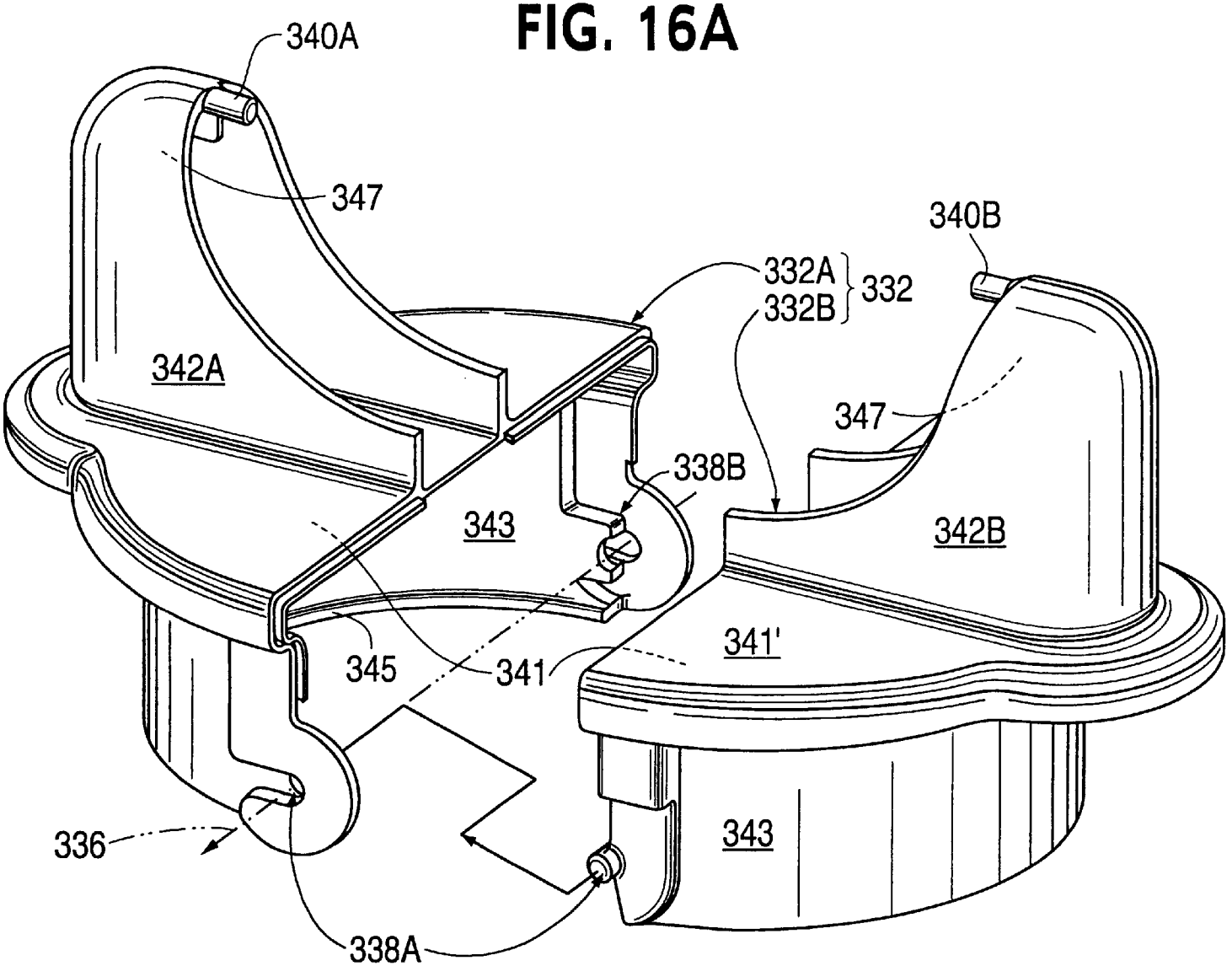
FIG. 16A is an exploded perspective view of a tumbler/container holder of FIG. 16.

Referring to FIGS. 16 and 16A, the tumbler/container holder 330 can be also releasably mounted to the tray 110. This toy 330 is also convertible between a tumbler holder that rotatably supports a ball 344 (see FIG. 1) and a container holder (see FIG. 2) that can hold a container, such as a cup or bottle. The holder toy 330 comprises a Y or yolk-shaped body 332 comprising a first portion 332A pivotally and detachably connected to a second portion 332B. The first and second portions 332A, 332B are relatively pivotal about an axis 336 defined by cooperating male and female hinge pieces 338A, 338B formed on the respective first and second portions 332A, 332B. The range of pivotal motion in both the open and closed states of the body 332 is defined by corresponding abutting relationships between the first and second portions 332A, 332B. For example, referring to FIG. 16A, at the lower end, one of the first and second portions 332A, 332B can have a bevel or an angled surface 344 and at the abutting lower end of the other of the first and second portions 332A, 332B can have a vertical or angled surface (not shown). The abutting surfaces are configured to permit the first and second portions 332A, 332B to pivot outwardly so that the journals 340A and 340B respectively formed on the support arms 342A, 342B move away from each other (to the open position).

When the body 332 is in the closed state, the journals 340A, 340B face each other, aligned collinearly. These journals 340A, 340B are adapted to rotatably support a ball 344 therebetween. In particular, the journals 340A, 340B are inserted in diametrically opposing recesses or holes (not shown) formed in the ball 344. Pivoting the first and second portions 332A, 332B away from each about the axis 336 increases the distance between the journals 340A, 340B and extracts the journals 340A, 34B from the holes formed in the ball 344. Each half of the ball can be translucent, clear, or colored. The ball can contain one or more beads of various size and color to create noise and visual stimulation. The ball 344 is also sized to fit through the aperture 307 in the tray 110.

In the configuration for receiving and supporting a container or other article, e.g., a drink cup or bottle, the first and second portions 332A, 332B mutually define a floor 341 for supporting the container and a substantially cylindrical side wall 343 for generally surrounding and receiving the container. The cooperating male and female hinge pieces 338A, 338B are formed on the respective portions of the cylindrical side wall 343 associated with both of the first and second portions 332A, 332B. The side wall 343 also includes an inwardly extending lip 345.

The toy 330 is reconfigured to receive and support a member, e.g., a drink cup, by extracting the body 332 from a fixture 346 formed in the tray 10. Referring to FIGS. 3, 3A, 3B, 3C, 3D, and 3E, in addition to providing a recess 348 for receiving the toy 330 in either configuration, e.g., receiving the side wall 343 or the support arms 342A, 342B, the fixture 346 includes a lock 350 that locks the body 332 to the tray 110. The lock 350 has a pair of spaced apart, resiliently biased fingers 351 extending downwardly from the tray 110. Each finger 351 has at least one tab 352 that can engage the lip 345 when the body 332 is mounted in the configuration for rotatably supporting a ball, or an underside 347 of the respective support arm 342A, 342B (adjacent the journals 340A, 340B) when the body is mounted in the configuration for receiving and supporting a container. In the embodiment shown, each resiliently biased finger 351 has two offset tabs 352, a lower one 352A and an upper one 352B. To release the tumbler/container holder toy from either position in the tray, the resiliently biased fingers are squeezed toward each other and the tumbler/container is simply lifted from the tray.

Figure 3D:
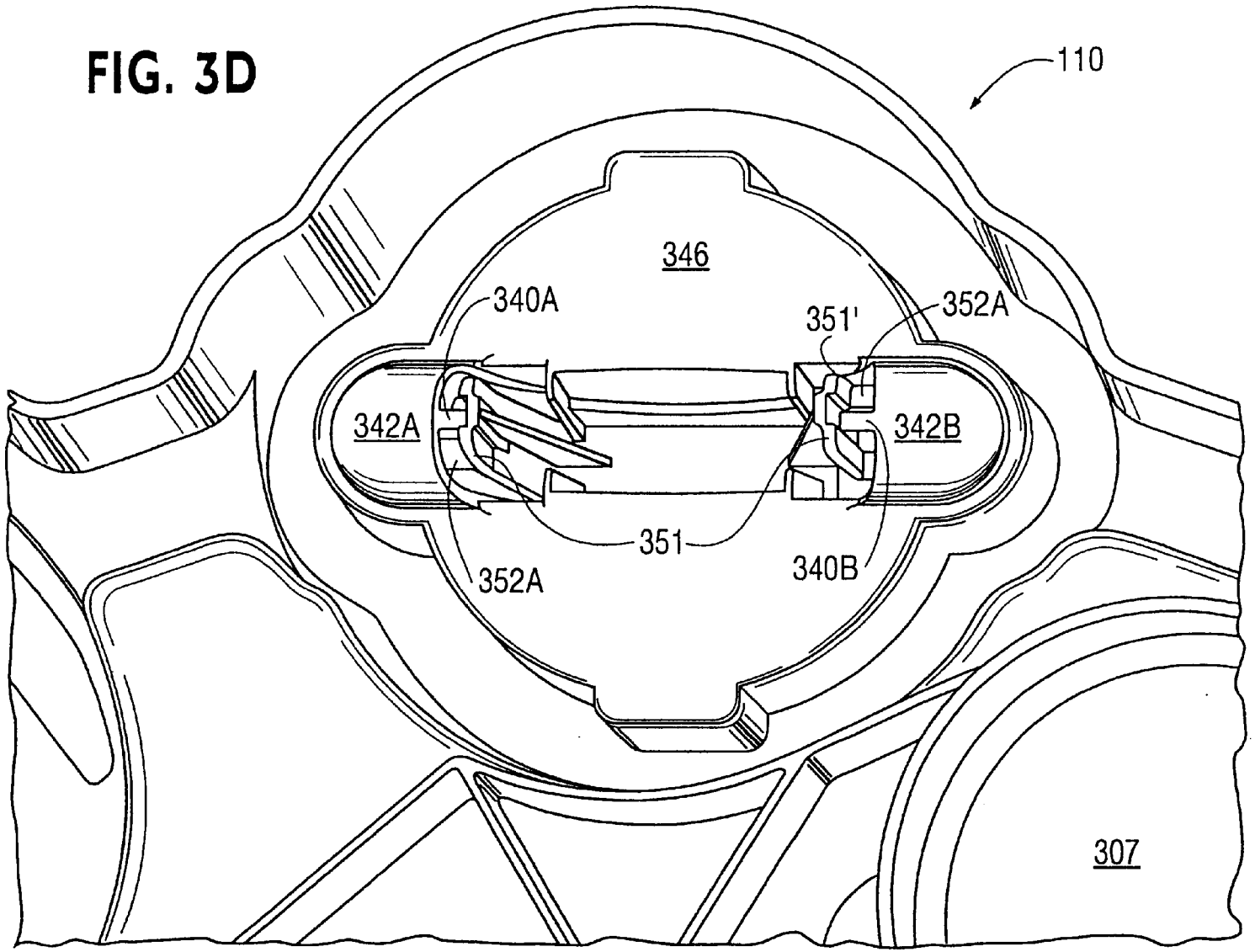
FIG. 3D is an enlarged detailed view illustrating a toy mount, mounting a toy in one configuration.
Figure 3E:
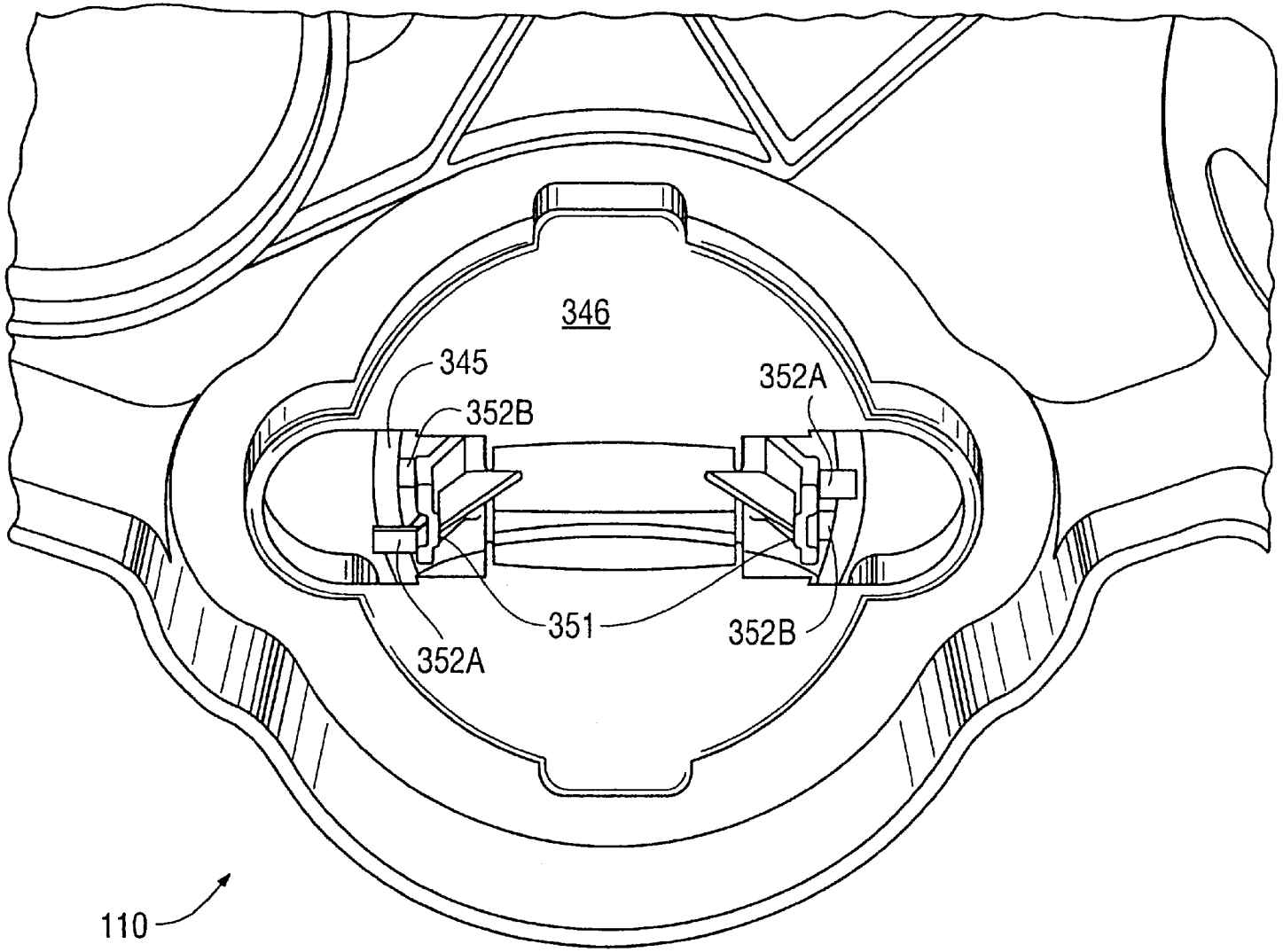
FIG. 3E is similar to FIG. 3D, illustrating the same toy mounted in another configuration.

Referring to FIG. 16, the height from the surface 341' abutting against the tray 110 to the underside 347 of the support arms 342A, 342B adjacent the journals 340A, 340B, is generally greater than the height, from the lower surface (floor) 341 to the lip 345 of the side wall 343. Referring to FIGS. 3B and 3C, two separate and offset tabs 352A, 352B are provided to accommodate both engaging portions 347, 345. Referring to FIG. 3D, in the container holder configuration, the lower tabs 352A engage the undersides 347 of the support arms 342A, 342B. Referring to FIG. 3E, in the ball holder configuration, the upper tabs 352B engage the lip 345. If the heights or the engagement distances are substantially equal, only one tab 352 on each arm 351 is needed.

As more clearly seen from FIGS. 3D and 3E, the lower tabs 352A are offset from each other about the journals 340A, 340B. The upper and lower tabs 352B, 352A of each arm 352 are also offset. That is, the tabs 352A, 352B are not vertically aligned or centered about the longitudinal axis of the arm 351. Instead, they are laterally offset as shown in FIGS. 3D and 3E. The lower tabs 352A are offset to clear the journals 340A, 340B of the body 332 as it is slid during insertion and removal. In this respect, each arm 351 has a longitudinal groove or channel 351' to accommodate the ends of the journals 340A, 340B so that these journals do not interfere with insertion and removal of the body 332.

Referring to FIGS. 3C and 3D, the tumbler/container holder receiving recess 348 is generally circular and has a pair of diametrically opposing openings 348A, 348A, each of which is substantially semicircular, extending radially outwardly. These openings 348A are complementary to the shape of the arms 342A, 342B to receive the same, as shown in FIG. 3D. The recess 348 further has a pair of diametrically opposing slots 348B, 348B formed radially outwardly and spaced about 90 degrees from the openings 348A. These slots 348B provide clearance for the hinge pieces 338A, 338B protruding from the cylindrical side wall 343.

A musical instrument toy may also be detachably attached to either tray 110, 140. The musical instrument toy 360 shown in the present embodiment is attached to the left-side tray 140. This toy 360 is convertible between a musical instrument (see FIGS. 1, 1A) and a storage compartment (see FIGS. 2 and 2A). The toy 360 comprises a lid 362 pivotally journalled on the tray 140 and a storage compartment 364 formed in the tray 140 (see FIGS. 2A and 4). In the musical instrument configuration, the lid 362 occludes the mouth 365 of the storage compartment 364. A keyboard 366 is supported on the exterior of the lid 362. The keyboard 366 controls a tone generator 368 powered by an electrical power source 370, e.g., a battery. The tone generator 368 and the battery are closed in a space between the lid 362 and the keyboard 364. Although an electrically powered tone generator controlled by a keyboard can be included, other types of electrical or acoustic instruments, e.g., a percussion instrument, may be supported on the lid 362. The lid 362 is pivotally mounted to the tray 140 to provide access to the interior of the compartment 364. A pair of snap fingers can be provided in the tray at the two pivot pin holes 369 to hold the lid in place. The compartment 364 provides a space in which objects may be placed, stored, and removed as desired.

FIGS. 1 and 2 also show the toy book or photo album 380. The toy 380 comprises at least one planar member 382 having a hinge along its one longer edge 381. The hinge is adapted to pivotally mount the planar member 382 to the tray 110. The hinges can comprise a pair of opposing pivot pins (not shown) collinearly aligned, extending outwardly in the opposing direction from the edge 381, and an opposing pair of slotted retainers 383, which have pivot pin receiving openings or slots 388. These slotted retainers 383 can be attached to the tray 110 or formed integrally therewith. At least one slotted retainer 383A is detachably attachable to the tray 110. As shown in FIG. 3, the tray 110 can have slots 387 (three shown) that can engage a corresponding number of prongs or tabs formed in the detachable slotted retainer 383A. The detachable retainer 383A allows insertion and removal of the planar member(s) 382. Two opposing retainers 385 also can be integrally formed with the tray 110.

As shown in FIGS. 1 and 2, three planar members 382 are mounted adjacent to each other in substantially parallel orientation to each other. Each of these planar members 382 can include a removable transparent cover 386 to function as a page holder. The cover 386 can be attached to the planar member 382, for instance, using interlocks and elastically deformable snap connections, or permanently attached at its edges, leaving one opening for insertion of a photo or sheet. The toy 380 is convertible to the extent that different display sheets having various images may be retained under the cover 386, i.e., against the planar member 382. The display sheets can include photographs, artwork, or may be preprinted sheets supplied with the entertainment system. The planar members 382 and the retainers 383, 385 may be differently colored. The covers can also be translucent, clear, or colored.

Figure 10:
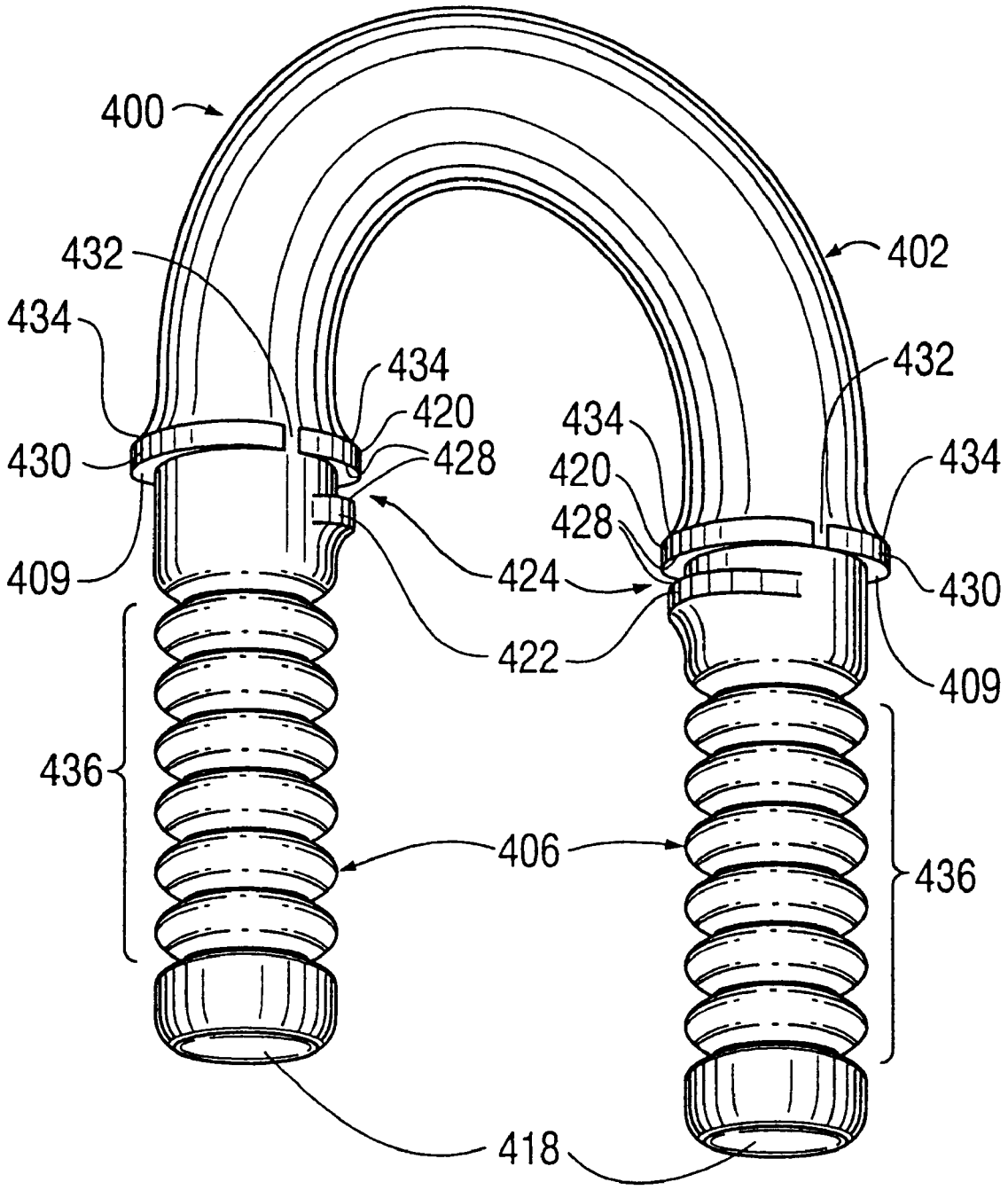
FIG. 10 is a perspective view of a ring toy.
Figure 10A:
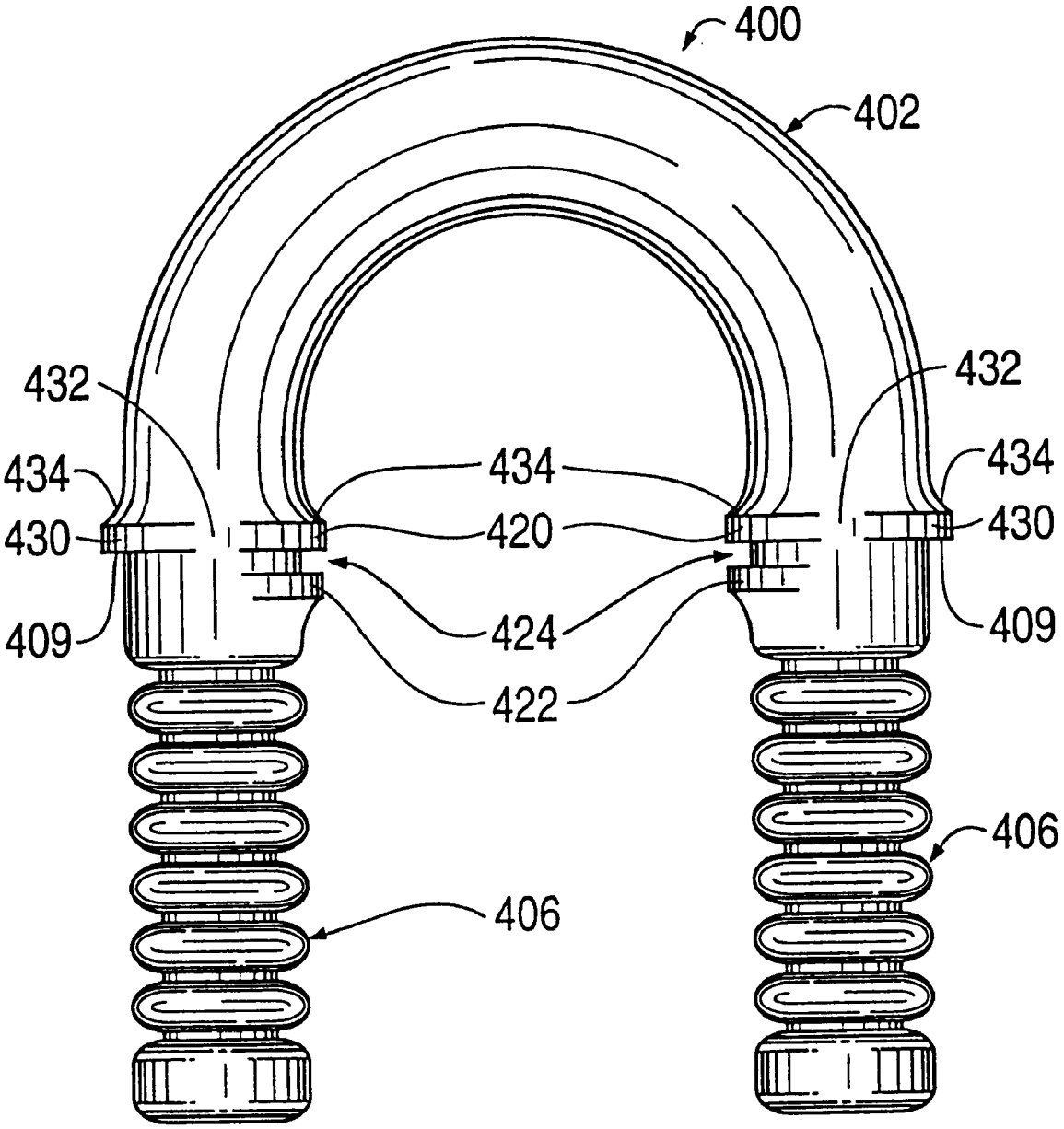
FIG. 10A is a front or back view of the ring toy of FIG. 10.
Figure 10B:
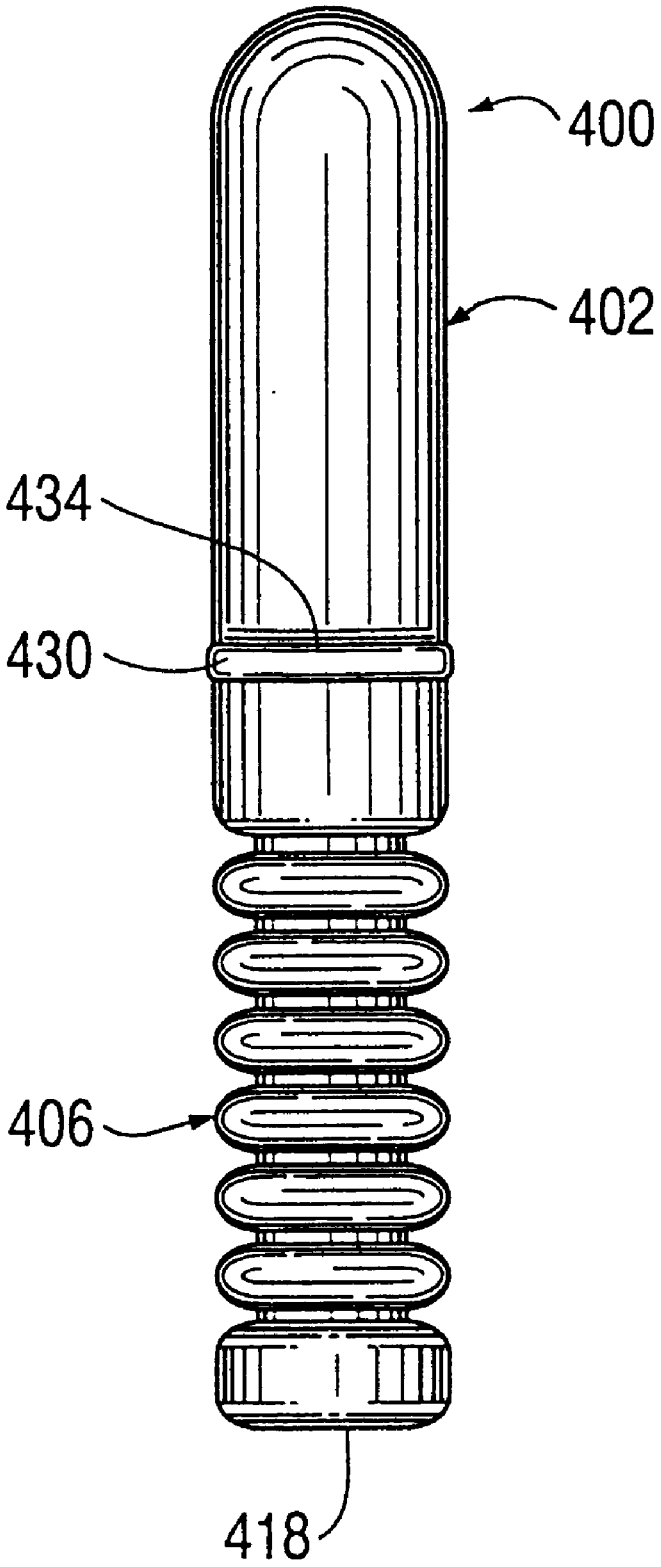
FIG. 10B is a right or left side view of the ring toy of FIG. 10.
Figure 10C:
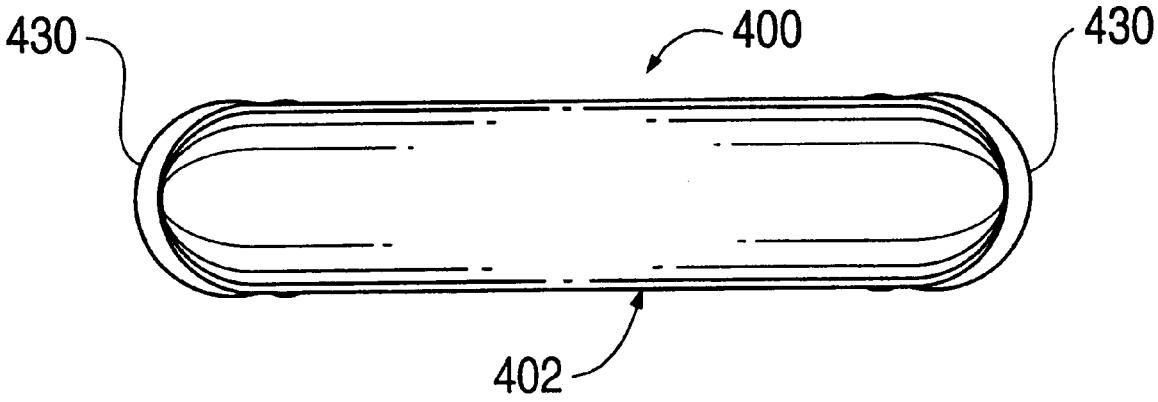
FIG. 10C is a top view of the ring toy of FIG. 10.
Figure 10D:
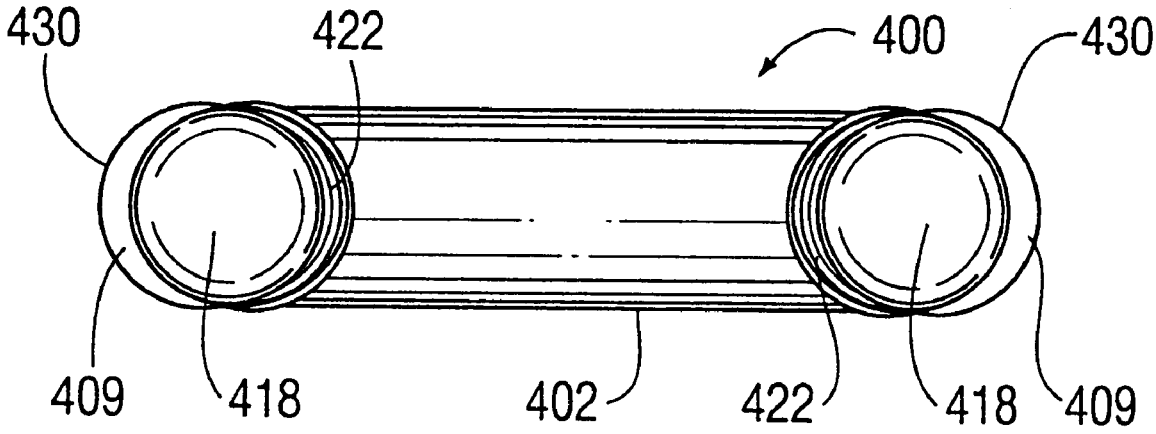
FIG. 10D is a bottom view of the ring toy of FIG. 10.

FIG. 10 shows the ring loop toy 400 that can be converted between an infant configuration (FIG. 1) and a toddler configuration (FIG. 2). The ring loop toy 400 generally includes a U-shaped member 402 and one or more ring members 404 for sliding engagement over the first member 402. The U-shaped member 402 includes two legs 406 joined by a cross member 408, as shown in FIG. 10.

Referring to FIGS. 4 and 4A, the U-shaped member 402 is mounted to the left-side tray 140 by positioning each leg 406 through a respective aperture 410 formed through the tray 140. As better shown in FIG. 4, the tray 140 can include a toy mount section 412 in the form of two ringed portions 414 that rise above the upper planar surface 416 of the tray 140. Viewing the tray 140 from below, as seen in FIG. 4A, each aperture 410 has a pair of opposed stabilizing ribs 416, which are designed to minimize the U-shaped member 402 from moving laterally in the direction of arrows A—A, relative to the tray 140. The stabilizing ribs 416 can have lateral reinforcements at the tray juncture. If the U-shaped member 402 is pulled or pushed by an infant or toddler during play, the stabilizing ribs 416 operate to maintain the legs 406 of the toy 402 in a substantially vertical orientation, i.e., substantially perpendicular to the upper planar surface 416 of the tray 140. This is advantageous in the toddler configuration where the ring members 404 are not secured to the U-shaped member 402, but can be removed by the toddler.

In the infant configuration shown in FIG. 1, the U-shaped member 402 is mounted from the top of the tray 140 so that the cross member 408 extends upwardly from the tray 140, and the legs 406 extend below the tray 140. In this configuration, the ring members 404 are positioned on the toy 400 so that they may be slid by the infant from one side of the cross member 408 to the other side of the cross member 408. The ring members 404 remain secured to the U-shaped member 402.

The ring loop toy 400 is convertible from the above described position suitable for an infant to another position suitable for a toddler. As shown in FIG. 2, the U-shaped member 402 is inserted from the underside of the tray so that the cross member 408 extends below the tray 140 and the legs 406 extend upwardly through the tray 140. The toddler may remove the ring members 404 from the legs 406, stack the ring members 404 on the legs 406, or transfer the ring members 404 from one leg 406 to the other. Although two ring members 404 are shown mounted to each leg 406, it will be understood that the toy 400 may include more or fewer ring members 404.

Referring to FIG. 10, the connecting mechanism for connecting the toy 400 to the tray includes, on each leg 406, a first flanged portion 420 and a second flanged portion 422 opposite to and spaced from the first flanged portion 420. The flanged portions 420 and 422 extend from an inwardly facing side of each leg 406. The spacing between flanged portions 420 and 422 on each leg 406 defines a groove or gap 424 that receives a peripheral edge portion 426 (see FIG. 4) of the respective aperture 410. Opposing inner faces 428 of the flanged portions 420 and 422 can engage or sandwich the upper and lower surfaces (peripheral edge portions 426) surrounding the aperture 410. The groove 424 is dimensioned to be larger than the thickness of the tray 140 at the peripheral edge portion 426 of the apertures 410.

To install the toy 400, a parent can flex the legs 406 slightly outwardly away from each other to allow passage of flanged portions 422 through the apertures 410. Once the grooves 424 are aligned with the apertures 410, relaxing the legs 406 moves the legs 406 toward each other to a neutral (unflexed) position, at which the opposing surfaces 428 of the flanged portions 420 and 422 can contact the peripheral edge portion 426 of the respective aperture 410 and lock the toy 400 to the tray 140. The flanges 420 and 422 act as stops, preventing the U-shaped member 402 from moving up and down.

The two apertures 410 are preferably oval in shape to accommodate the outward leg flexing, with the long axis of the two apertures 410 being collinearly aligned. In this respect, each leg 406 has a third flanged portion 430 diametrically opposite the first flanged portion 420 and extending outwardly from an outwardly facing side of each leg 406 (mirroring the first flanged portion 420). The combined length across the first and third flanged portions 420, 430 is greater than the longest length of the apertures 410. The first and third flanged portions 420, 430 act as a stop and prevent the U-shaped member 402 from being inserted too deeply through the apertures 410 regardless of whether the legs 406 are flexed or are in a neutral position. The first and third flanged portions 420, 430 can taper off into the respective leg 406. Between the first and third flange portion, flattened areas 432 exist. The cross member 408 can terminate at where outward tapers 434 of the first and third flanged portions 420, 430 terminate. The outward tapers 434 can be configured complementary to the inner portion of the ring members 404 to ensure that the ring members 404 stack evenly on either side of the cross member 408.

When a parent wants to convert the toy 400 from the infant configuration to the toddler configuration, or viceversa, the parent simply holds the legs 406, pulls them slightly apart to disengage the peripheral edge of the apertures 410 from the grooves 424, and lifts or lowers the U-shaped member 402, depending on the starting configuration.

The two legs 406 and the cross member 408 can be substantially circular in cross section, and the ring members 404 can have holes of a greater diameter than the diameter of the cross member 408 and the legs 406, excepting that region of the legs 406 forming the flanged portions 420, 430. The ring members 404 may be slid across the cross member 408 and over the ends 418 of legs 406.

A substantial portion of each leg 406 is shaped or corrugated. The corrugated portion 436 extends from the second flanged portion 422 to the leg's terminal end 418. The corrugated portion 436 can provide some flexibility and resiliency to the leg 406 so that it can flex upon impact or application of force.

Figure 11A:
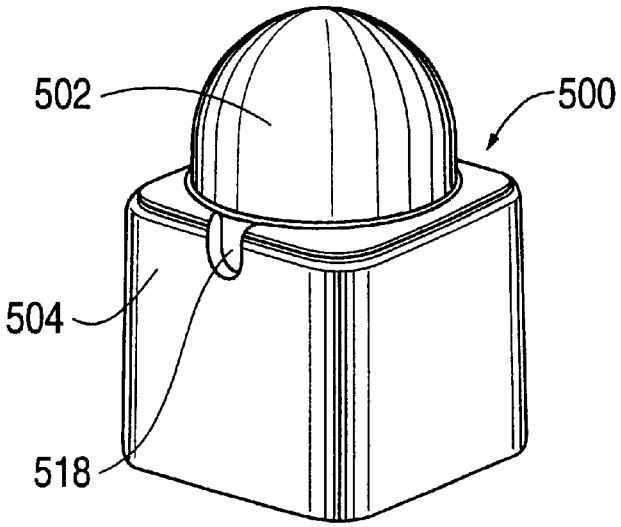
FIGS. 11A, 11B, and 11C are perspective views of the various geometric shaped toys.
Figure 11B:
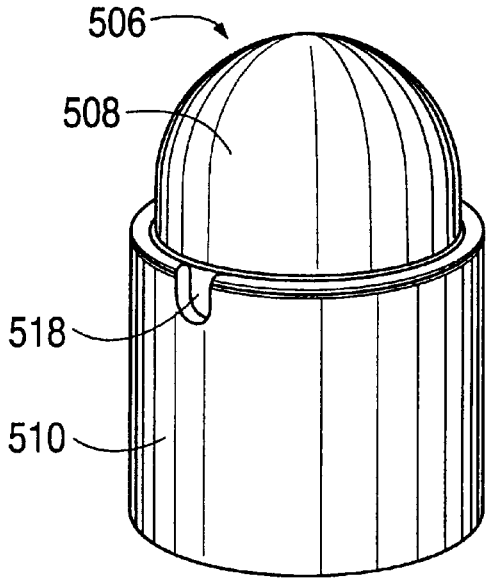
Figure 11C:
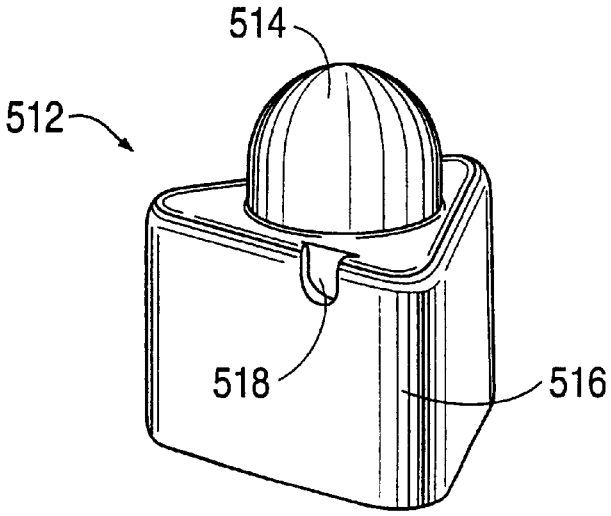

Referring to FIGS. 11A, 11B, and 11C, the geometric toys 500, 506, and 512 each have a rounded portion 502, 508, 512 and a polygonally shaped portion 504, 510, 516. The toy pieces are named after the cross sectional shape of their respective polygonally shaped body. FIG. 11A shows a rectangular toy piece 500 having the rounded portion 502 and a rectangular (or square) body 504. FIG. 11B shows a circular toy piece 506 having the rounded top portion 508 and a cylindrical body 510. FIG. 11C shows a triangular toy piece 512 having the rounded top portion 514 and a triangular body 516. Each piece 500, 506, 512 can be made hollow and can include two opposing apertures 518 (only one shown). These toy pieces can be strung together by running a string or other tie member through their apertures 518. These toy pieces can be placed on the trays 110, 140, or tied to the activity center 1.

Figure 12:
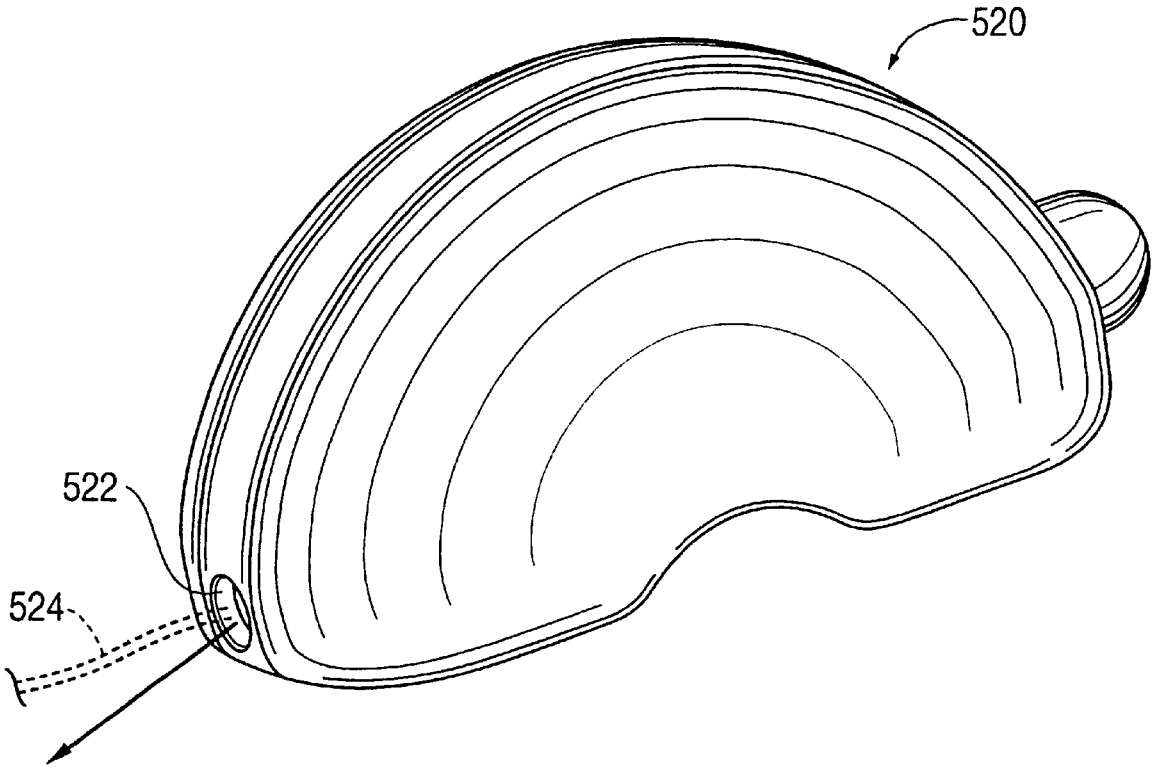
FIG. 12 is a perspective view of a phone toy.

FIG. 12 shows a play phone piece 520. The phone piece 520 includes a tie member 524 threaded through an aperture 526 or an eye member formed on the tray 140 (see FIG. 1). This tie member 524 also can be threaded through the apertures 518 of the toy pieces 500, 506, and 512 to connect them to the phone piece 520 in a train-like assembly. Referring to FIG. 2, the phone underside is configured to mimic a regular phone having a play earpiece, a play numeric pad, and a play mouthpiece. On its upper side, the phone piece 520 may be painted or configured like a dog or other animal or other playful character pleasing to infants and toddlers.

In the infant configuration shown in FIG. 1, the toy pieces 500, 506, 512 are shown positioned on the upper planar surface 416 of the tray 110 and 140. The toy pieces are preferably strung together for infants, along with the phone piece (not shown in FIG. 1) in the above discussed train-like assembly, with the end of the string or time member 524 attached to a bottom surface of the tray 110 and 140 through an aperture in the tray, such as the aperture 526 shown in FIG. 1. Because the phone piece 520 and toy pieces 500, 506, and 512 can be assembled to each other and to the tray, these pieces are less likely lost or thrown by the infant.

In the toddler configuration, the toy pieces 500, 506, and 512 can be detached from the phone piece by untying the end of the tie member 524 threaded through aperture 526 and sliding the toy pieces off of the tie member 524. The phone piece 520 may then be rethreaded through the aperture 526 to be used by the toddler as a play phone. The toy pieces 500, 506, and 512, freed from the tie member 524, may be moved by the toddler around the activity center 1, and used with the convertible toy house 600.

Figure 13:
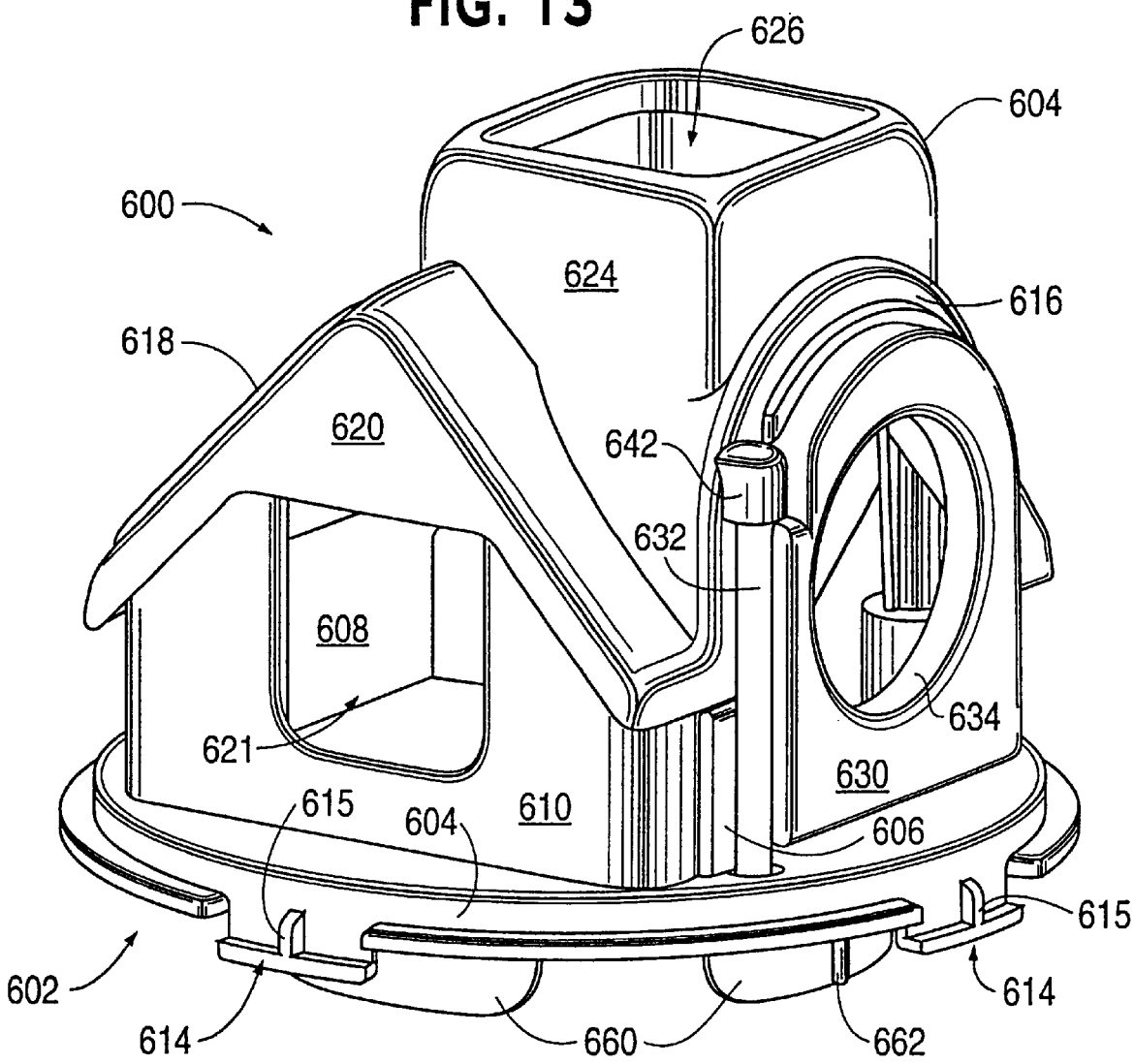
FIG. 13 is a front perspective view of a toy house.
Figure 13A:
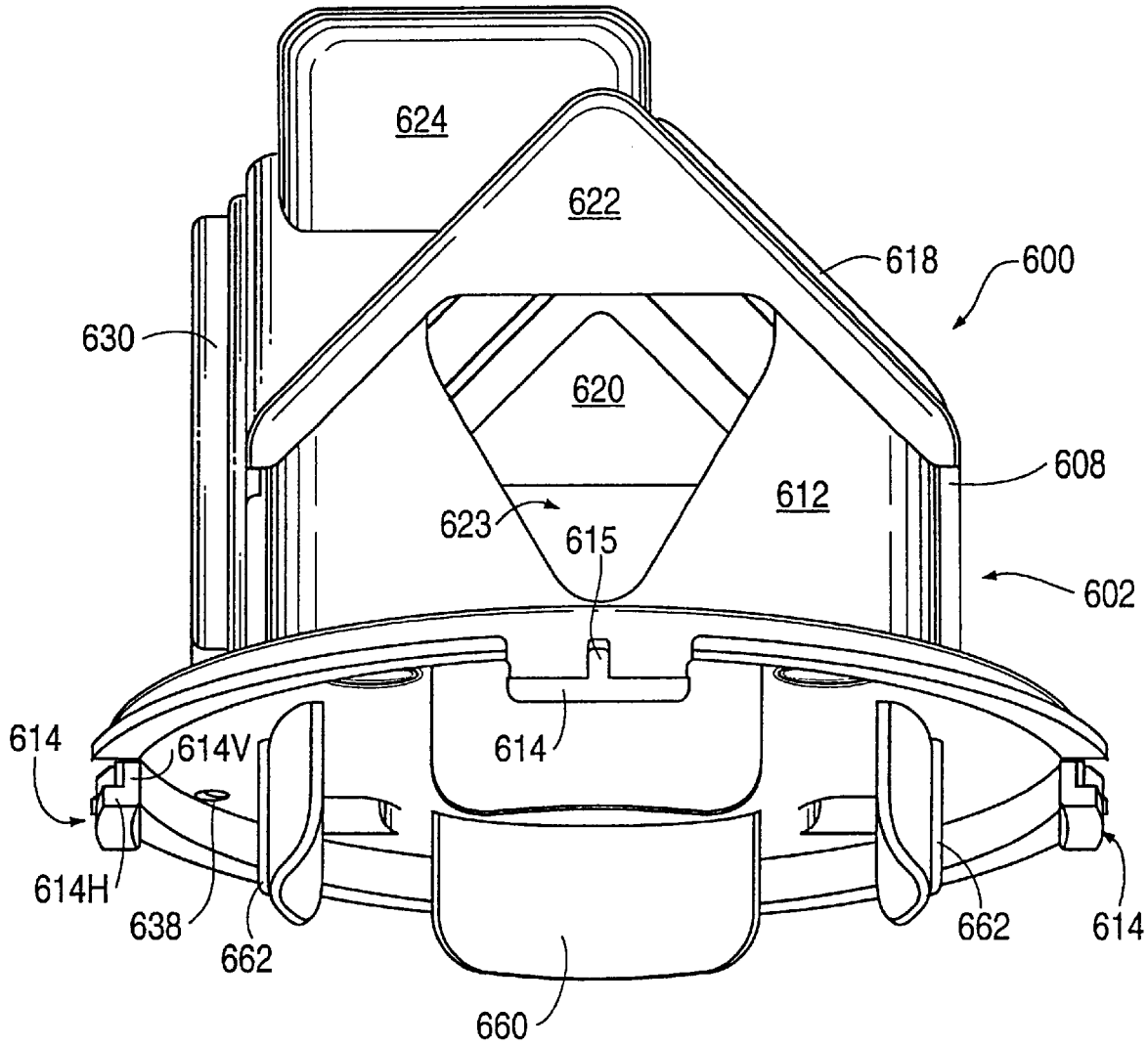
FIG. 13A is a bottom perspective of the toy house of FIG. 13.
Figure 13B:
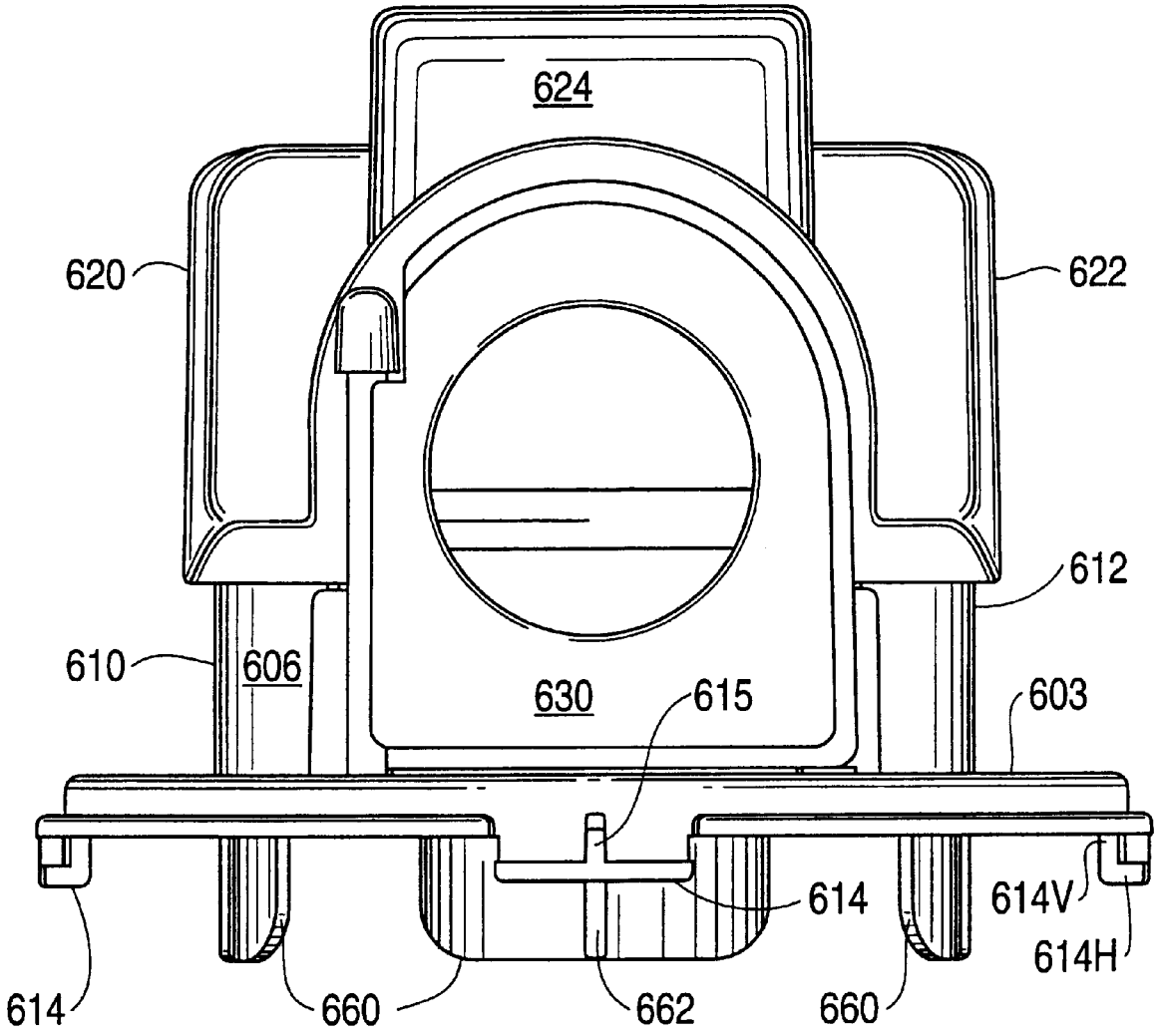
FIG. 13B is a front view of the toy house of FIG. 13.
Figure 13C:
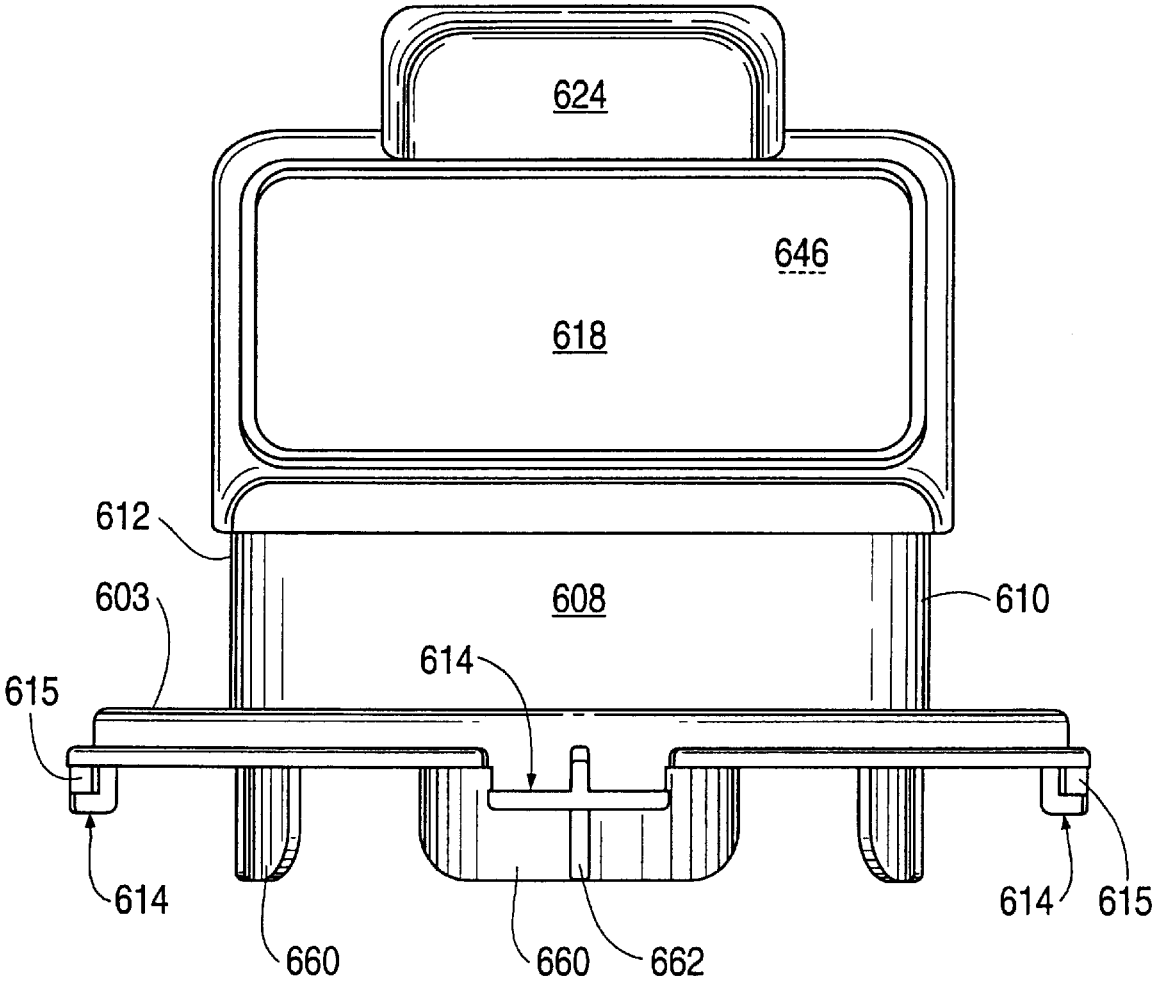
FIG. 13C is a back view of the toy house of FIG. 13.
Figure 13D:
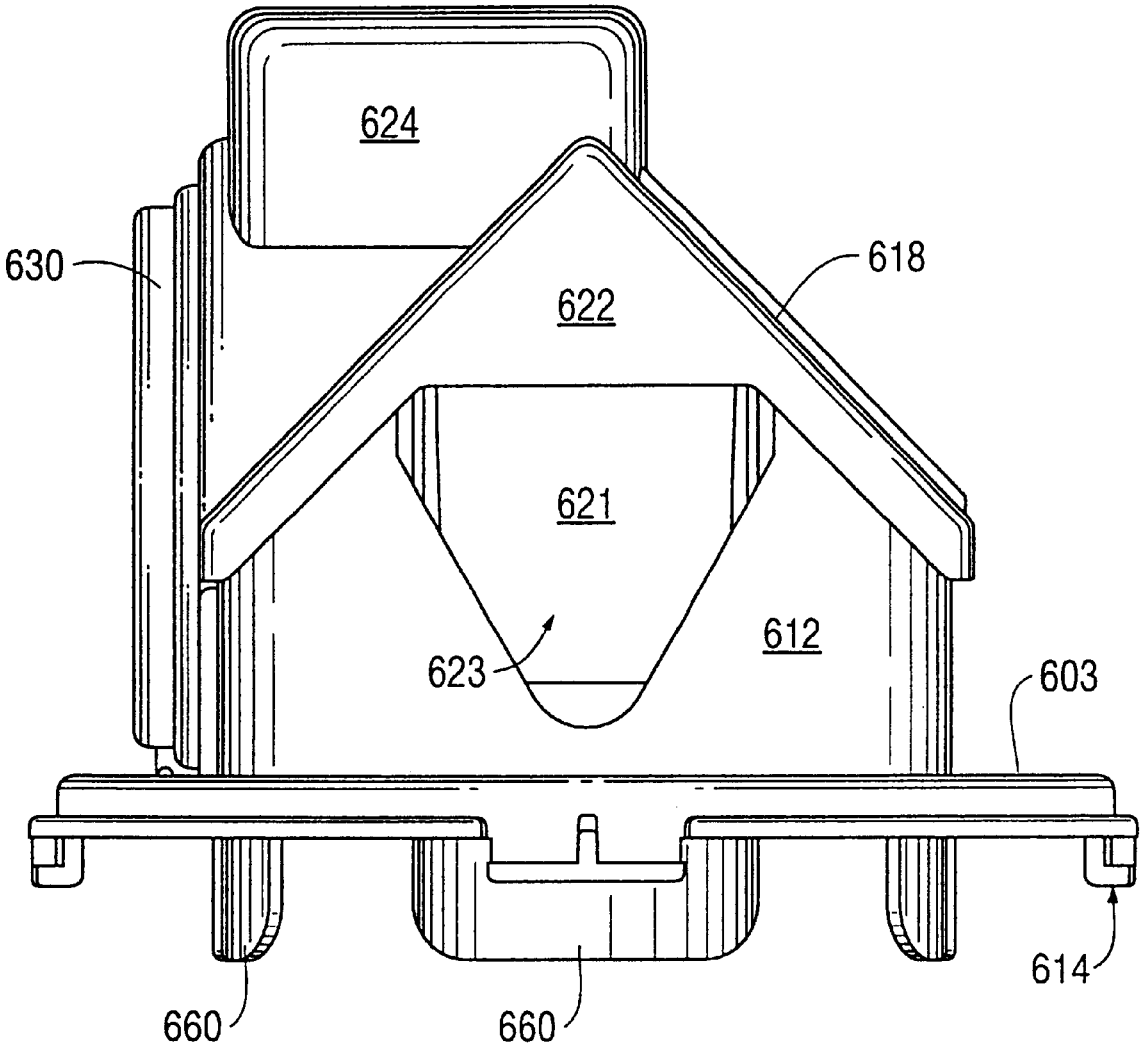
FIG. 13D is a right side view of the toy house of FIG. 13.
Figure 13E:
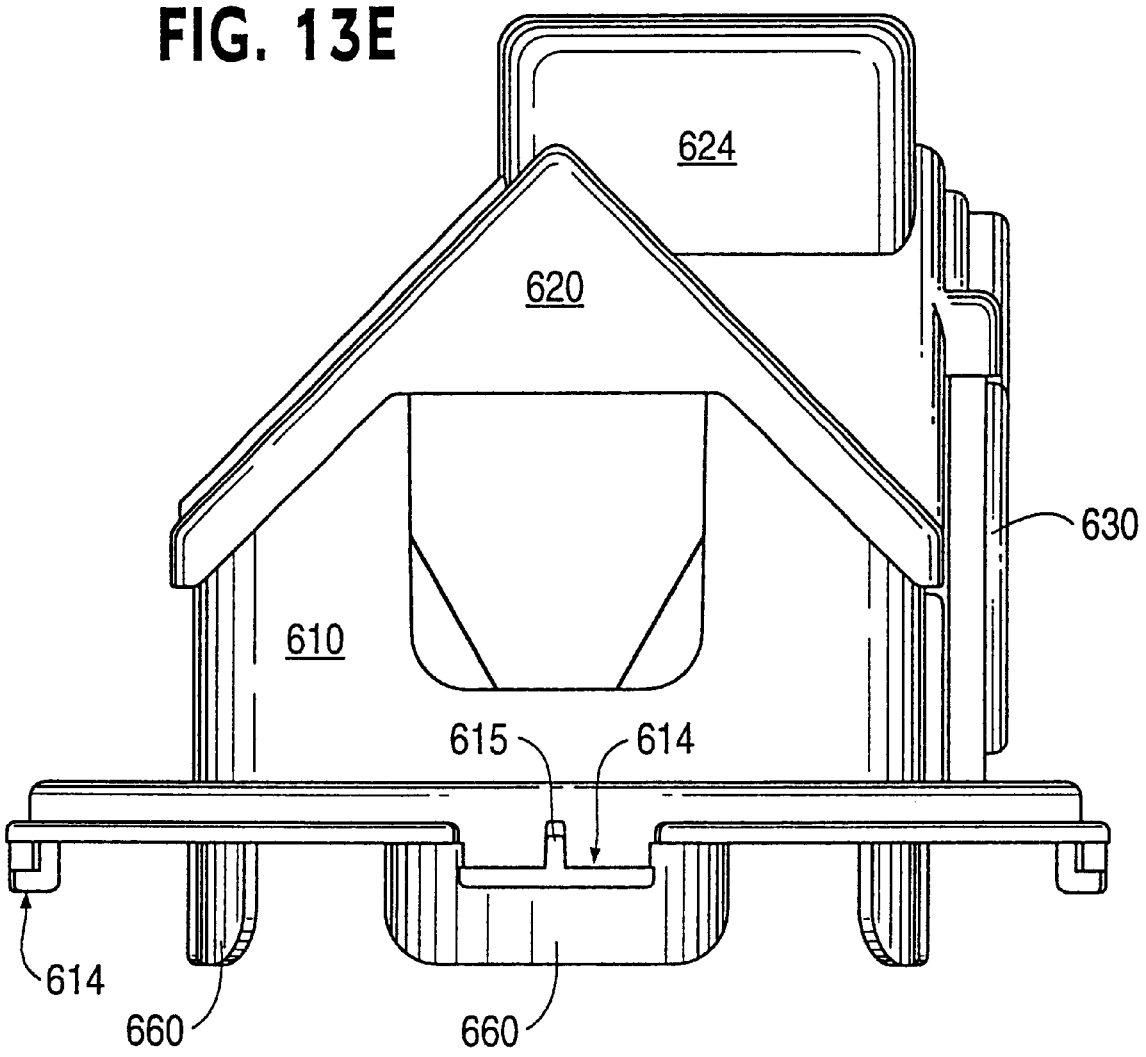
FIG. 13E is a left side view of the toy house of FIG. 13.
Figure 13F:
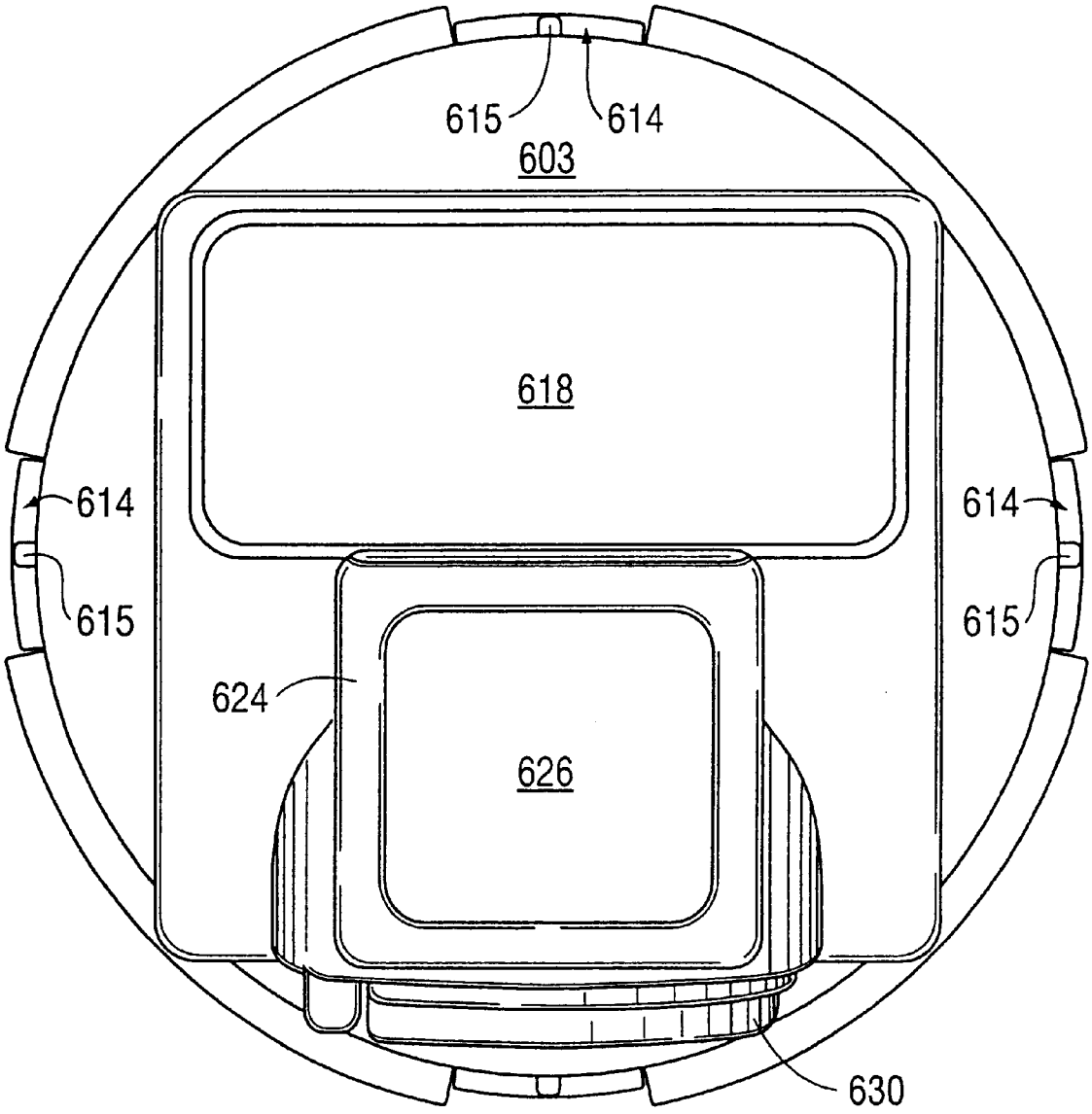
FIG. 13F is a top view of the toy house of FIG. 13.
Figure 13G:
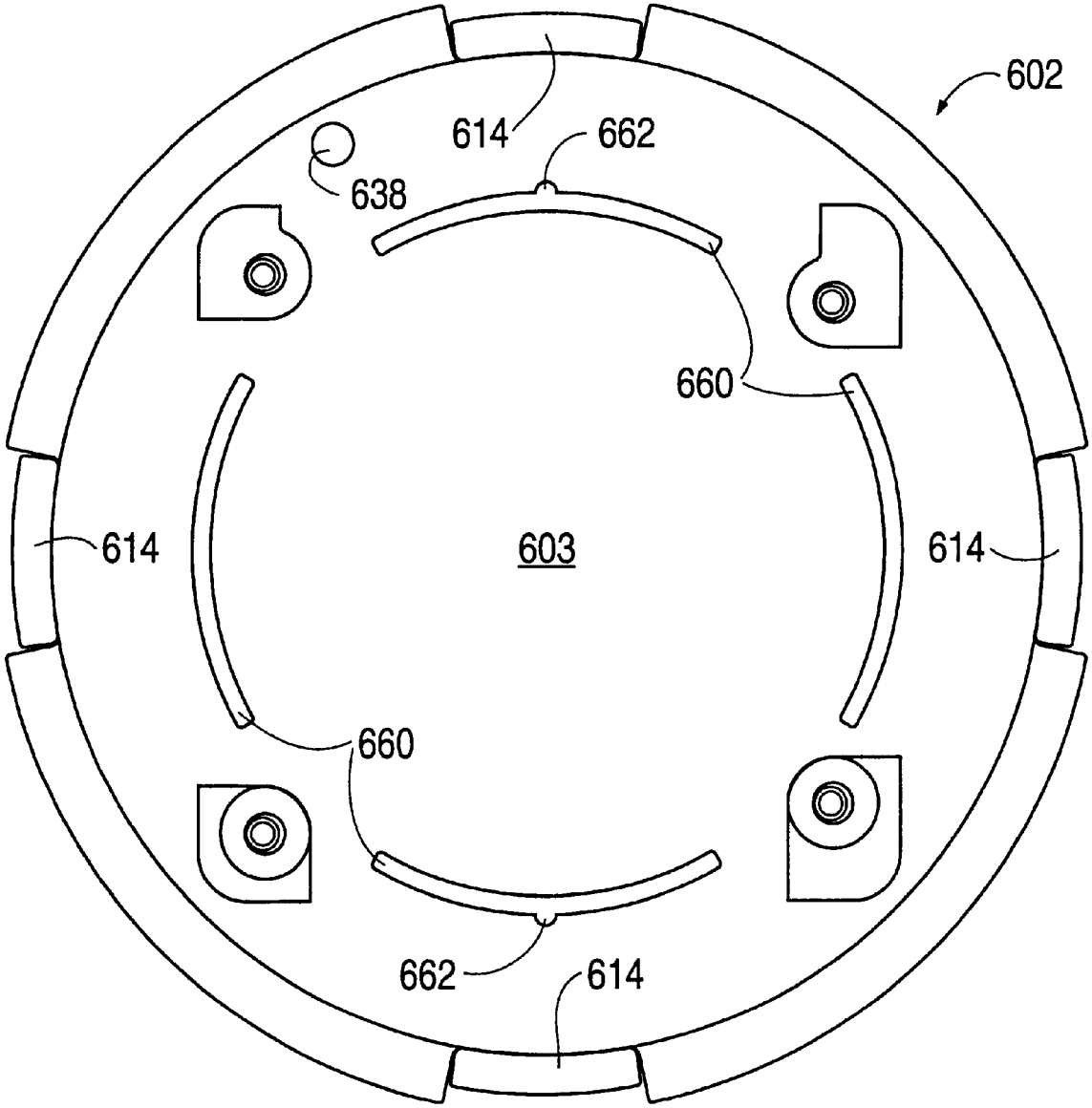
FIG. 13G is a bottom view of the toy house of FIG. 13.

FIGS. 13–13G show the convertible toy house 600. FIG. 1A shows the convertible toy house 600 mounted in an infant configuration to the tray hub 150, which also is configured as an annular toy mount 601, and FIG. 2A shows the convertible toy house 600 in a toddler configuration. The toy house 600 can include a mirror or other reflective surface so that an infant or a toddler can enjoy his or her reflection. The toy house 600 also functions as a shape sorter toy, where the toddler can place the geometric toy pieces 500, 506, and 512 inside the toy house 600 and also remove them from the toy house 600.

The toy house 600 comprises a substantially hollow body having a base portion 602, a top portion 604, and a door 630. The base portion 602 includes a circular floor 603, a front wall section 606, a back wall section 608, and opposing side wall sections 610 and 612. The top portion 604 includes a front roof section 616, a back roof section 618, and opposing side wall sections 620 and 622. The top portion 604 also includes a chimney section 624 having a hole 626 that provides passage to the interior of the toy house 600. The door 630 has a side hinge 632 and a hole 634 extending therethrough.

The top portion 604 is configured to fit with the base portion 602 so that the front wall section 606 and the front roof section 616 mate, the front back wall section 608 and the back roof section 618 mate, side walls sections 610 and 620 mate, and side walls sections 612 and 622 mate. The top portion 604 and the base portion 602 can be screwed together, glued together, or otherwise fastened together, or even formed monolithically. The door 630 is mounted adjacent to the front wall section 606 by inserting the lower end 636 of the hinge 632 into an aperture 638 in the floor 603 and by inserting the upper end 640 into a hole formed in a receiving bracket 642, which is mounted to the front roof section 616. The back roof section 618 can have a reflective surface or a mirror 646 mounted thereon.

The toy house 600 can be used as a shape sorter or puzzle, with toy pieces 500, 506, and 512 described above. The circular hole 634 in the door 630 can be shaped to receive the circular toy piece 506. The side walls 610 and 620 can form a generally rectangular opening 621 that can receive the rectangular toy piece 500. Finally, the side walls 612 and 622 can form a generally triangular opening 623 that can receive the triangular toy piece 512. All of the toy pieces 500, 506, and 512 may be dropped through the hole 626 in the chimney section 624. A toddler may swing open the hinged door 630 to remove the toy pieces from inside the toy house 600.

Referring to FIGS. 1, 2, 4, and 4A, the toy mount 601 includes first engagement members that engage the toy house 600. The toy house 600 has second engagement members that cooperate with the first engagement members to releasably lock the house 600. The first engagement members can be female engagement members, and the second engagement members can be male engagement members. The first engagement members can comprise the T-shaped slots 650 formed in the annular portion 153 of the hub 150. The slots 650 are slightly wider along a central portion (155). Referring to FIGS. 13 and 13A, the second engagement members can comprise tabs 614 located at a periphery of the base portion 602. The tabs 614 releasably engage the slots 650 in the toy mount 601 in a bayonet-type lock. Each tab is L-shaped and has a stop 615 that engages the wider slot portion 155 to align the floor 603 and thus the house 600 relative to the hub 150.

The tabs 614 can engage the slots 650 in at least two engagement orientations. In a first engagement orientation, the toy house 600 is oriented so that the back wall section 608 faces inwardly toward the center of the tray assembly 7. The first engagement orientation is employed in the infant configuration shown in FIG. 1A, where the back roof section 618 faces toward an infant sitting on the activity center 1. In a second engagement orientation, where the toy house 600 is rotated 180 degrees, the door 630 faces the child playing in the activity center. In either orientation, the toy house 600 can sort articles. For instance, the toddler can place the geometric toy pieces 500, 506, and 512 inside the toy house 600 and also remove them from the toy house 600. The toy house 600 may also be rotated 90 degrees and 270 degrees from the first engagement orientation shown in FIG. 1A.

In the embodiment shown, the base portion 602 includes four tabs 614 spaced equidistant from each other, i.e., separated 90 degrees apart. It will be understood that the tabs may be located at different angular relationship to each other, as long as the mating slots in the toy mount 601 have the same angular relationship. The tabs 614 are each L-shaped, having a vertical leg 614V extending down from the plane of the floor 603 and a horizontal leg 615V extending radially outwardly from the lower end of the vertical leg 614V. These tabs 614 may be slid into respective slots 650 in the toy mount 601. The toy house 600 is then slightly rotated to lock the tabs 614 in place in the slots 650. To remove the toy house 600 from the toy mount 601, the toy house 600 is rotated in the opposite direction and the tabs 614 are lifted out of the slots 650, at which time the toy house may be realigned or rotated as desired. The stops 615 engage the ends of the wider portion (155) of the slots 650 to limit and align the house 600.

FIGS. 13, 13A, and 13G show the underside of the base portion 602, which includes guiding ribs 660 that extend downwardly therefrom. At least two opposing ribs 660 each have a vertically extending embossed ridge 662. The ridge 662 can slide between vertically extending embossed ridges 664 formed on the inner surface of the inner cylindrical member 152 of the hub 150. The ridge pair 664 can act as a positive detent indictor to center the ridge 662 between the ridges 664 on the hub 150 when the house 600 is properly oriented, or to prevent the house from over-rotating. The house 600 is rotated by applying a positive, deliberate force. The ribs 660 also can be dimensioned to frictionally engage the inner cylindrical member 152 to more stably support the house 600. The ribs 660 are dimensioned so that they do not interfere with the fastener F that attaches the tray assembly 7 to the leg 90.

In another aspect of the invention, the trays 110, 140 can include one or more receptacles 700 shown in FIGS. 1 and 3 for releasable mounting toys, such as a toy wand 702 shown in FIGS. 2 and 14, 14A, and 14B. The receptacle can be elevated from the upper planar surface 416 of the tray 110 as shown. The receptacle 700 has a hole through which the toy wand may be positioned in an infant configuration position and a toddler configuration position.

Figure 14:
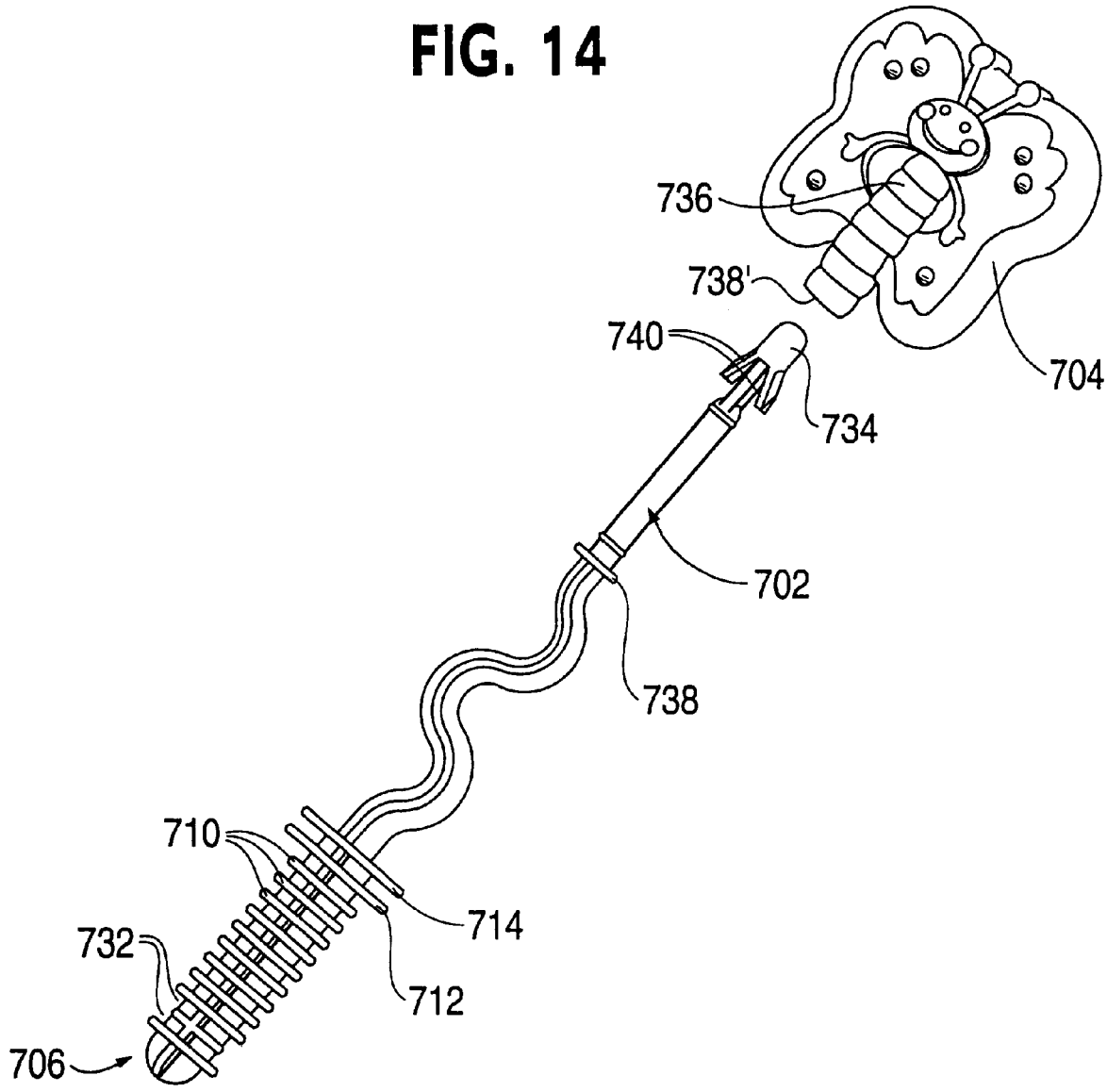
FIG. 14 is an exploded perspective view of a toy wand.
Figure 14A:
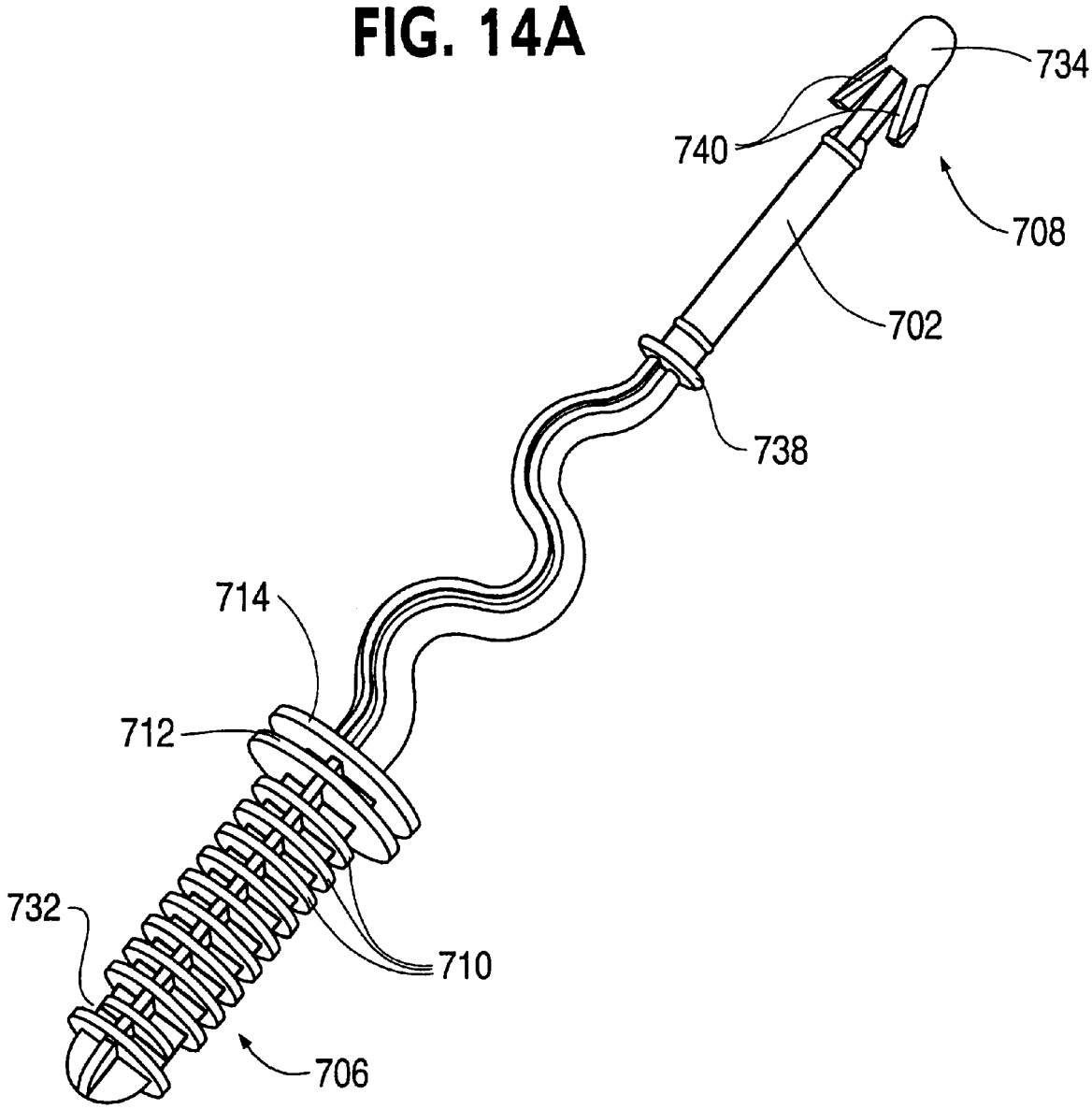
FIG. 14A is an enlarged view of a wand of FIG. 14.
Figure 14B:
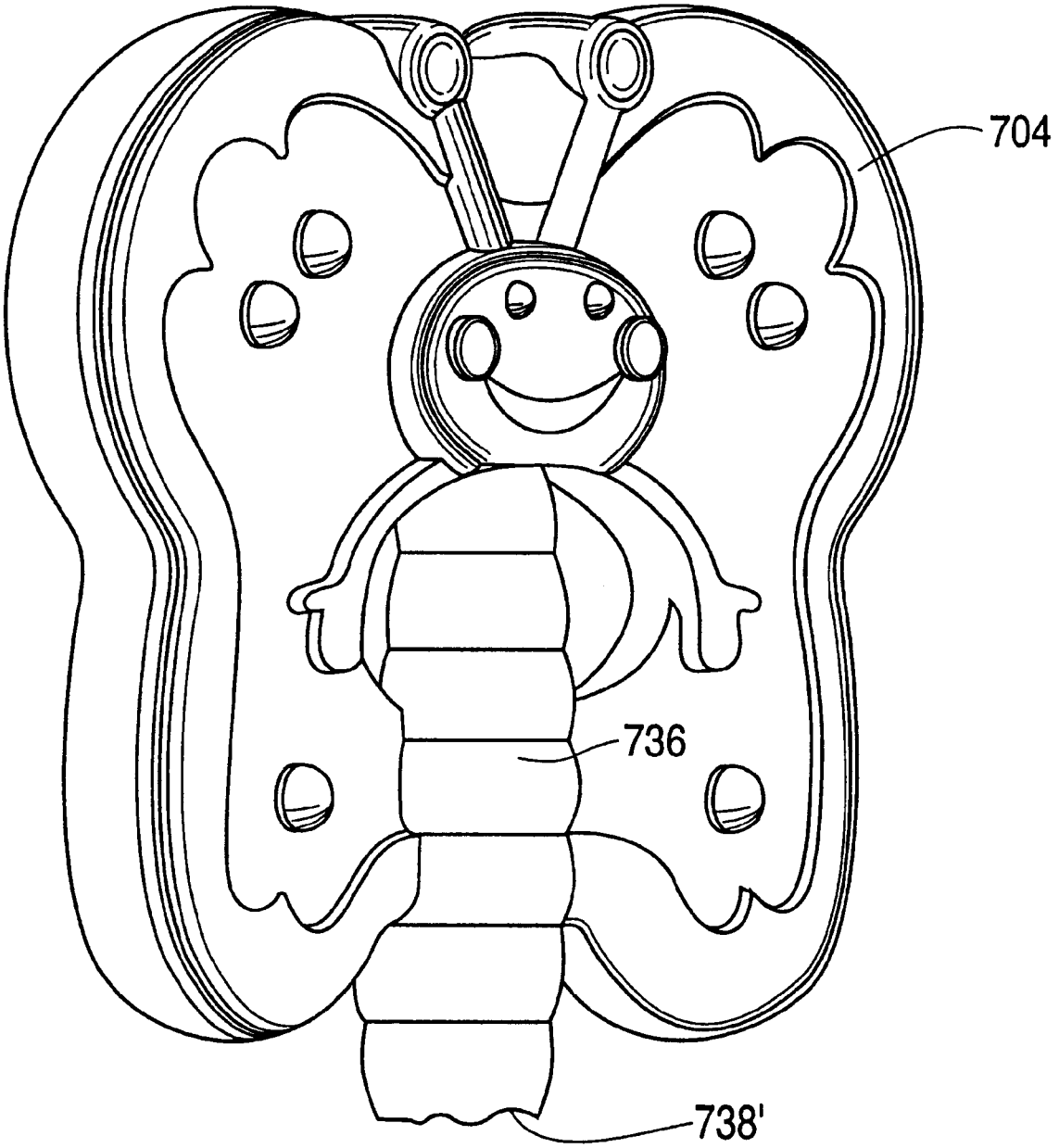
FIG. 14B is a toy figure attachable to the wand of FIG. 14B.

FIGS. 14A and 14B show the toy wand 702 more clearly. This toy functions as a teether attached to the tray for infants and converts to a wand removable by toddlers for imaginative play. The wand 702 includes a first or upper end 708 that can mount various toy figures, such as a butterfly toy 704, and a second or lower end 706 that releasably attaches to the receptacle 700. The lower end 706 has a plurality of smaller annular rings 710 and two larger annular rings 712 and 714, one above the other. In the infant configuration, the wand 702 is positioned in the receptacle 700 so that the higher of the two larger annular rings 714 abuts an upper surface 716 of the receptacle 700. The upper surface 716 is visible in FIG. 1. When the wand is so mounted, it is designed so that the infant cannot (or can only with much difficulty) remove it from the tray assembly 7.

A parent may reposition the wand 702 in the tray 110 to convert the wand 702 from the infant configuration to a toddler configuration. In the toddler configuration shown in FIG. 2, the wand 702 is positioned in the receptacle 700 so that the lower of the two larger annular rings 712 abuts the upper surface 716 of the receptacle 700. In this configuration, the toddler may remove the wand from the tray to play with it.

Figure 3F:
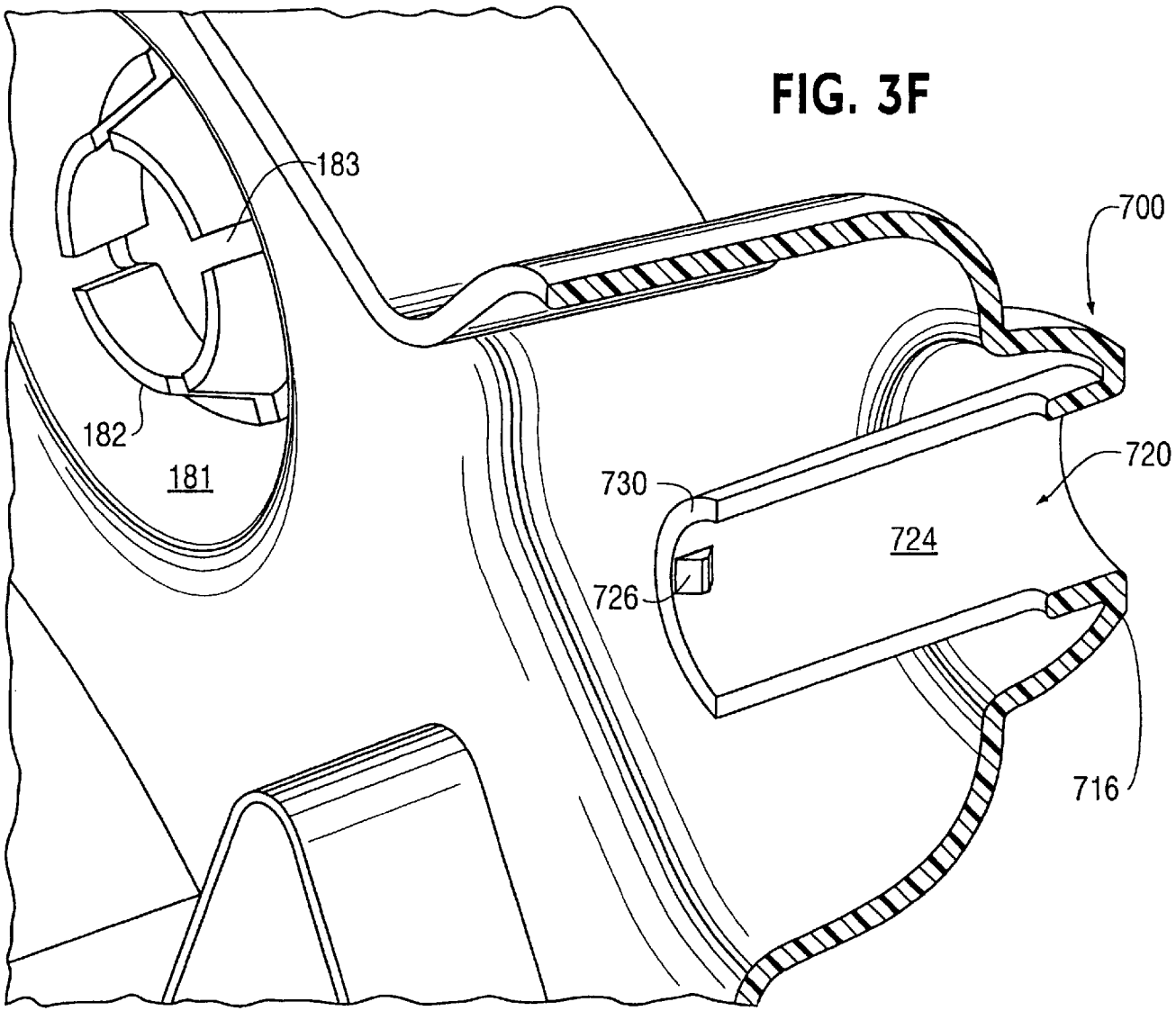
FIG. 3F is a detailed sectional perspective view of the underside of the left-side tray, illustrating another toy mount.

Referring to FIGS. 3A and 3F, the receptacle 700 comprises a substantially cylindrical wall with diametrically opposing slits 722 dividing the same into two semi-circular walls 720, 720 extending down from the upper surface 716 of the receptacle 700. The inner surface 724 of each of the walls 720 includes a nub or protuberance 726 adjacent a terminal end 730 of the respective wall 720. The protuberance 726 can be triangular as shown with the hypotenuse portion oriented vertically so that the rings 710 can slide across its leg portions.

As the toy wand 702 is positioned in the receptacle 700, the walls 720 can move slightly apart so that the smaller annular rings 710 may pass across the protuberances 726. When the wand 702 has been positioned in the infant configuration, the protuberances 726 are located in a groove defined by adjacent smaller annular rings 710, for example groove 732 shown in FIG. 14A. These protuberances make it difficult for an infant to pull the wand 702 off the receptacle 700.

To convert the wand to the toddler configuration, where a toddler may remove the wand 702 from the receptacle 700, a parent can pull upward firmly or push upward on the lower end 730 of the wand 702 so that the opposing protuberances 726 are dislodged from the groove 732 or so that the lower most ring 710 is cleared from them. The toddler then can remove the wand 702 from the receptacle with little resistance since none of the rings 710 engage the protuberances 726.

The first end 708 of the wand includes a bulb 734, which can be inserted into a hollow, generally cylindrical body 736, such as the butterfly toy 704. The butterfly toy 704 may be pushed downward along the wand 702 until the base 738' of the butterfly's body 736 abuts an annular ring 738. Opposing wings 740 extending downwardly at an angle from the bulb 734 can contract inwardly when the butterfly toy 704 is pushed down over the first end 708 of the wand 702. Once the butterfly toy 704 is secured on the wand 702, the wings 740 expand slightly outwardly to a resting position against an inside wall (not shown) of the butterfly's hollow body 736. The inside wall of the hollow body 736 can have one or more inwardly extending rings that can abut the wing ends to prevent the toy 704 from corning off. The toy wand 702 can be made flexible, such as by using EVA. Although the wand 702 is shown with a butterfly toy, it will be understood that toys of other animals, characters, or designs may be used.

The present activity center 1, including the base assembly 3, the tray assembly 7, and the leg assembly 7 can be formed of suitable plastics, particularly, molded plastics.

The term "base" used herein can mean either a base 10 per se or a base assembly 3. The term "leg" used hereafter can mean either a leg 90 per se or a leg assembly 5. The term "tray" or "tray member" used hereafter can mean either a tray assembly 7 or the right or left tray 110, 140 per se. The term "seat" used hereafter can mean a seat per se or a seat assembly. The terms "first", "second", "third", "fourth" used hereafter are merely for purposes of tracking the elements, and do not relate to a particular order of elements or add any special meaning. Moreover, although references have been made to directions in describing the structure, they are made relative to the drawings (as normally viewed) for convenience of description. The directions, such as left, right, upper, lower, vertical, horizontal, etc., are relative terms and not intended to be taken literally.

Given the present disclosure, one versed in the art would appreciate that there may be other embodiments, modifications, and acts, within the scope and spirit of the present invention. Accordingly, all modifications and acts attainable by one versed in the art from the present disclosure within the scope and spirit of the present invention are to be included as the present invention.

We claim:

1. An activity center comprising:

a base;

a plurality of leg assemblies extending from the base, each of the leg assemblies comprising:

a sleeve extending uprightly from the base;

a slider received in the sleeve and movable relative to the sleeve;

a spring positioned between the sleeve and the slider and supporting the slider relative to the sleeve; and a leg received in the slider and adjustably mounted to the slider so that the position of the leg is adjustable relative to the slider; and a tray attached to the legs.

2. The activity center according to claim 1, wherein the tray has a pivotal joint, which is connected to one of the legs and pivotal thereabout, and a pair of free ends that are lockable together to form an enclosure, the tray being pivotal between an opened position where the free ends are spaced apart and a closed position where the free ends are locked together.

3. The activity center according to claim 2, further including a detachable seat attached to the tray when the tray is in the closed position.

4. The activity center according to claim 1, wherein each of the leg assemblies includes a height adjuster for each of the legs, wherein each of the legs has an elongated vertical wall having a plurality of slots formed along a vertical direction thereof, the height adjuster comprising a leg engaging member movably connected to the slider, the leg engaging member being biased toward the elongated wall and movable substantially horizontally, the leg engaging member having a projection dimensioned to extend through the slot and hold the leg relative to the slider.

5. The activity center according to claim 4, wherein a plurality of pairs of slots are formed along the elongated vertical wall, the leg engaging member having a pair of slot engaging projections that extend through the slot pair and hold the leg relative to the slider, wherein the leg engaging member is biased toward the elongated wall by at least one spring.

6. The activity center according to claim 4, wherein each of the legs is adjustable between a spring lock out position, where an upper portion of the leg is substantially flush with an upper portion of the sleeve and an extended position where the leg is positioned higher than the sleeve.

7. The activity center according to claim 1, further including at least one toy that is detachably connectable to the tray and convertible to provide at least two different toy functions.

8. An entertainment system for an infant and a toddler, comprising:

a base;

a plurality of leg assemblies connected to the base;

a tray having a first tray member and a second tray member, wherein the tray is movable between an opened position, in which the first and second tray members are locked against movement relative to the leg assemblies in a first orientation to form an open play space, and a closed position, in which the first and second tray members are locked against movement relative to the leg assemblies in a second orientation to form an enclosure; and at least one convertible toy attachable to the tray.

9. The entertainment system according to claim 8, wherein the convertible toy comprises a sound instrument, a storage compartment formed in the tray, and a lid pivotally mounted to the tray and movable to cover and open the compartment, the sound instrument being connected to the lid, wherein when the tray is moved to close the receptacle, the lid substantially occludes the storage compartment and supports the sound instrument on an exterior surface with respect to the occluded compartment, and wherein when the lid is opened, an interior surface of the compartment is revealed.

10. The entertainment system according to claim 8, wherein the convertible toy comprises at least one planar member pivotally mounted to the tray, each of the planar members having at least on one side a cover adapted to hold a display sheet.

11. The entertainment system according to claim 8, further comprising a plurality of planar members, each having the cover to hold a display sheet, which includes a photo.

12. The entertainment system according to claim 8, wherein the convertible toy comprises a cross member and two spaced apart legs connected together by the cross member, wherein the first toy is detachably attachable to the tray in a first configuration where the legs extend below the tray and with the cross member extending above the tray and in a second configuration where the legs extend above the tray and with the cross member extending below the tray.

13. The entertainment system according to claim 12, further including at least one ring member having an opening, wherein in the first position, the ring member is movable across the cross member and in the second position, the legs extending above the tray receives the ring member.

14. The entertainment system according to claim 13, wherein the two legs and the cross member form a U-shaped member, the cross member forming a bend between the two legs, which extend substantially parallel to each other, wherein the tray has two spaced apart apertures that receive the legs.

15. The entertainment system according to claim 14, wherein each of the two legs includes a groove adapted to engage the tray at a periphery of a respective one of the two apertures and lock the U-shaped member to the tray.

16. The entertainment system according to claim 15, wherein the grooves of the two legs face each other.

17. The entertainment system according to claim 16, wherein each of the two legs has a first flanged portion and a second flange portion spaced from and opposite the first flanged portion, the spacing between the first and second flange portions defining the groove.

18. The entertainment system according to claim 17, wherein the first and second flanged portions of one leg are opposite the first and second flange portions of the other leg.

19. The entertainment system according to claim 18, wherein each of the two apertures are oval to permit the legs to flex away from each other.

20. The entertainment system according to claim 19, wherein each of the two legs further includes a third flanged portion formed diametrically opposite the first flanged portion, the third flanged portions of the two legs face away from each other, wherein a length across the first and third flanged portions of each leg is greater than a longest length of either of the oval apertures.

21. The entertainment system according to claim 20, wherein the tray includes two pairs of opposed stabilizing ribs extending downward from a lower face of the tray, one pair being located adjacent one of the two apertures and an other pair located adjacent the other of the two apertures, the stabilizing ribs laterally supporting the U-shaped member.

22. The entertainment system according to claim 8, wherein the convertible toy comprises a substantially hollow body having a plurality of differently configured openings that are adapted to receive objects having complementary configurations.

23. The entertainment system according to claim 22, wherein the hollow body comprises a base portion detachably attachable to the tray, a top portion attached to the base portion.

24. The entertainment system according to claim 23, wherein the hollow body is configured in a shaped of a house.

25. The entertainment system according to claim 24, wherein the house shaped body has a door hingedly mounted to the top portion and the base portion, a chimney, a roof, and two opposing sides, wherein each of the door, chimney, and the two opposing sides has one of the openings.

26. The entertainment system according to claim 25, wherein each of the openings comprises one of a generally circular, rectangular, and triangular shape.

27. The entertainment system according to claim 26, wherein the door has a generally circular opening for passage of generally circular objects, the two sides respectively have generally rectangular and triangular openings for passage of generally rectangular and triangular objects, respectively, and the opening in the chimney is sufficiently large to allow insertion of rectangular, triangular, and circular objects, and wherein the door is openable to access the objects inserted through the openings.

28. The entertainment system according to claim 27, further including circular, rectangular, and triangular objects, each including apertures extending therethrough, and a toy piece having a tie member, the tie member having a free end threadable through apertures of each of the objects and connected to the tray.

29. The entertainment system according to claim 27, wherein the base portion has securing members depending therefrom for attaching tot he tray and the tray has complementary securing members for intercepting the securing members of the base portion.

30. The entertainment system according to claim 29, wherein the base portion securing members are tabs located at a periphery of base portion and the complementary securing members are apertures that releasably engage the tabs.

31. The entertainment system according to claim 30, wherein the house shaped body further includes a roof section having a front side and a back side, and a reflecting surface on the back side of the roof section.

32. The entertainment system according to claim 31, wherein the tabs and the complementary apertures enables the house shaped body to be mounted in different positions, one of which is with the door directed toward a center of the tray and another one of which is with the reflecting surface directed toward the tray center.

33. The entertainment system according to claim 8, wherein the convertible toy comprises a toy wand, wherein the tray includes a receptacle that holds the toy wand in a locked configuration or a removable configuration.

34. The entertainment system according to claim 33, wherein the toy wand includes at least one annular ring and the receptacle includes at least one protuberance that engages the annular ring to maintain the toy wand secured to the tray, the toy wand being positioned to the removable configuration when the annular ring is cleared from the protuberance.

35. The entertainment system according to claim 8, wherein the convertible toy comprises a ball drop toy having a receptacle for holding an object, including a ball, the ball drop toy having a mount that allows the ball drop toy to pivot to dump or drop the object and that prevents the ball drop toy from pivoting, and wherein the tray has a first aperture that receives the receptacle.

36. The entertainment system according to claim 35, wherein the receptacle has opposing first and second pivot members and the tray has a complementary third and fourth pivot members that receives the first and second pivot members and form a pivot axis.

37. The entertainment system according to claim 36, wherein the first and second pivot members are first and second pivot shafts extending outwardly in the opposing directions and the third and fourth pivot members are third and fourth apertures formed adjacent the first aperture to receive the first and second pivot shafts.

38. The entertainment system according to claim 37, wherein the receptacle has first and second projections that engage the upper surface of the tray adjacent the first aperture, the first aperture being asymmetrical so that when the first and second pivot shafts are respectively inserted in the third and fourth apertures to a stationary configuration, the first and second projections engage the tray from both sides of the pivot axis to prevent the tray from pivoting, and when the first and second pivot shafts are respectively inserted in the fourth and third apertures to a pivot configuration, the second projection engages the tray from one side of the pivot axis, while the first projections clears through the other side of pivot axis to allow the receptacle to pivot and drop the object through the first aperture.

39. The entertainment system according to claim 38, wherein the first aperture is divided into a first section and second section along a generally medial line extending across the pivot axis, wherein the area of the first section is smaller than the area of the second section.

40. The entertainment system according to claim 39, wherein the first and second sections each are substantially semicircular, and the receptacle is substantially hemispherical, the first projection being a lip extending peripherally around an opening thereof and the second projection being a handle extending outwardly beyond the lip.

41. The entertainment system according to claim 40, wherein in the stationary configuration, the lip extends over the periphery of the smaller first section and the handle extends over the periphery of the larger second section, and in the pivoting configuration, the handle extends over the periphery of the smaller first section but the lip is insufficient to extend over the periphery of the second larger second section to allow the receptacle to pivot about the pivot axis and dump or drop the object through the first recess.

42. The entertainment system according to claim 41, wherein the object is a ball in the pivoting configuration and the base has a track that receives the dropped ball and guides that same.

43. The entertainment system according to claim 42, wherein the track extends between a first end and a second end, the first end being located vertically below the first aperture and the second end being located at a relatively lower elevation than the first end.

44. The entertainment system according to claim 8, wherein the convertible toy comprises a toy holder detachably mounted to the tray, the toy holder being mounted to the tray as an article holder in one configuration and as a ball holder in another configuration.

45. The entertainment system according to claim 44, wherein the toy holder comprises a pivotal body having ball holding members at one end and an article holding wall formed at another end, wherein the toy holder is mounted to the tray from the one end to convert to the article holder configuration and the toy holder is mounted to the tray from the other end to convert to the ball holder.

46. The entertainment system according to claim 45, wherein the toy holder comprises first and second arms pivotally connected to each other, each of the arms having a ball holder member, the first and second arms being pivotal between a first position in which the arms move away from each other to allow removal and attachment of the ball thereto and a second position in which the ball holding members are collinearly aligned so as to rotatably support a ball therebetween, wherein the first and second arms each include a floor portion and a side wall portion that mutually form a floor and a side wall when the toy holder is in the second position.

47. The entertainment system according to claim 46, wherein the ball holding members are journals adapted to engage a complementary diametrically opposed holes in the ball.

48. The entertainment system according to claim 47, wherein the tray has a mount for releasably locking the toy holder to the tray, the mount comprising a recess and a lock that engages the first and second arms when the toy holder in positioned to the article holder configuration and that engages the side wall when the toy holder is positioned to the ball holder configuration.

49. The entertainment system according to claim 48, wherein the lock comprises a pair of resiliently biased fingers extending downwardly from the tray, each of the resiliently biased fingers having at least one tab that engages at least one of the arm and the side wall.

50. The entertainment system according to claim 49, wherein the side wall is substantially cylindrical and has an inwardly extending lip to which the tab engages to lock the toy holder to the tray when the toy holder is in the ball holder configuration.

51. The entertainment system according to claim 50, wherein each of the resilient fingers has a pair of tabs, one for engaging the arm and another for engaging the lip, wherein the pair of tabs are offset from each other.

* * * * *